US005484542A

United States Patent [19]

Cahoon et al.

[11] Patent Number: 5,484,542

[45] Date of Patent: Jan. 16, 1996

[54] SULFURIZED OVERBASED COMPOSITIONS

[75] Inventors: John M. Cahoon, Mentor; Jack L. Karn, Richmond Hts.; Nai Z. Huang, Mayfield Hts.; James P. Roski, Euclid, all of Ohio

[73] Assignee: The Lubrizol Corporation, Wickliffe, Ohio

[21] Appl. No.: 312,428

[22] Filed: Sep. 26, 1994

Related U.S. Application Data

[63] Continuation of Ser. No. 940,594, Sep. 4, 1992, abandoned.

[51] Int. Cl.[6] ..... C10M 159/20; C10M 159/24

[52] U.S. Cl. ..... 252/18; 252/33

[58] Field of Search ..... 252/18, 33

[56] References Cited

U.S. PATENT DOCUMENTS

| | | | |
|---|---|---|---|
| 2,623,016 | 12/1952 | Mertes | 252/32.7 |
| 2,695,910 | 11/1954 | Asseff et al. | 260/413 |
| 3,057,896 | 10/1962 | Schlicht et al. | 252/18 |
| 3,453,212 | 7/1969 | Dorer | 252/49.7 |
| 3,488,284 | 1/1970 | LeSuer et al. | 252/33 |
| 3,492,231 | 1/1970 | McMillen | 252/33 |
| 3,515,669 | 6/1970 | LeSuer | 252/39 |
| 3,629,109 | 12/1971 | Gergel et al. | 252/33 |
| 3,766,066 | 10/1973 | McMiller | 252/32.7 E |
| 3,940,341 | 2/1976 | Gray et al. | 252/105 |
| 4,171,269 | 10/1979 | Sung et al. | 252/33 |
| 4,200,545 | 4/1980 | Clason et al. | 252/33.4 |
| 4,230,586 | 10/1980 | Bretz et al. | 252/8.5 P |
| 4,234,435 | 11/1980 | Meinhardt et al. | 252/51.5 A |
| 4,446,039 | 5/1984 | Pindar et al. | 252/52 R |
| 4,468,339 | 8/1984 | Rysek et al. | 252/75 |
| 4,507,215 | 3/1985 | Schraeck | 252/32.7 E |
| 4,526,950 | 7/1985 | Grava | 526/272 |
| 4,579,666 | 4/1986 | Schraeck | 252/32.7 E |
| 4,582,543 | 4/1986 | Bretz | 148/6.15 R |
| 4,751,010 | 6/1988 | Leone et al. | 252/33 |
| 4,755,311 | 7/1988 | Burjes et al. | 252/49.9 |
| 4,804,489 | 2/1989 | Munson et al. | 252/32.7 E |
| 5,064,545 | 11/1991 | Steckel | 252/32.7 HC |
| 5,080,812 | 1/1992 | Parc et al. | 252/18 |
| 5,250,204 | 10/1993 | Karn et al. | 252/33 |

FOREIGN PATENT DOCUMENTS

| | | |
|---|---|---|
| 210448 | 4/1956 | Australia . |
| 583981 | 9/1959 | Canada . |
| 1055700 | 6/1979 | Canada . |
| 0168880 | 7/1985 | European Pat. Off. . |
| 0462762 | 12/1991 | European Pat. Off. . |
| 1242102 | 8/1971 | United Kingdom . |
| 1315848 | 5/1973 | United Kingdom . |
| 8803554 | 5/1988 | WIPO . |
| 8804313 | 6/1988 | WIPO . |
| 8904358 | 5/1989 | WIPO . |

OTHER PUBLICATIONS

Smalheer and Smith, "Lubricant Additives", pp. 1–11, 1967.

European Search Report EP 93 30 6992, Apr. 12, 1994.

*Primary Examiner*—Jerry D. Johnson

*Attorney, Agent, or Firm*—Frederick D. Hunter; John H. Engelmann; William J. Connors

[57] ABSTRACT

This invention relates to a composition comprising at least one sulfurized overbased product made by contacting (A) at least one overbased product or (A') at least one boron-containing overbased product with (B) sulfur and/or at least one source of sulfur; said overbased product (A) or boron-containing overbased product (A') being made using at least one acidic material, with the proviso that when said acidic material is other than $SO_2$ or a source of $SO_2$ said overbased product (A) or boron-containing overbased product (A') is contacted with an effective amount of $SO_2$ or a source of $SO_2$ to displace at least part of said acidic material. In one embodiment the sulfurized overbased product is an overbased thiosulfate or a boron-containing overbased thiosulfate. In one embodiment, the sulfurized overbased product is made using the overbased product (A) and the composition further comprises at least one non-sulfurized boron-containing overbased product. The sulfurized overbased products are thermally stable and are useful as extreme pressure (EP) and/or anti-wear agents or antioxidants for use in lubricants, functional fluids and normally liquid fuels. The functional fluids can be oil-based, water-oil emulsions or water-based. The sulfurized overbased products are particularly suitable for use as EP and/or anti-wear agents for use in gear lubricants and cutting fluids. In one embodiment lubricating compositions are provided that pass both the L-37 High Torque Test and the L-42 High Speed Shock Test without the necessity of employing phosphorus and sulfurized olefin anti-wear systems in their formulation.

48 Claims, No Drawings

SULFURIZED OVERBASED COMPOSITIONS

This is a continuation of application Ser. No. 07/940,594 filed on Sep. 4, 1992 now abandoned.

TECHNICAL FIELD

This invention relates to sulfurized overbased products which are useful as extreme pressure (EP) and/or anti-wear agents or antioxidants for use in lubricants, functional fluids and normally liquid fuels. The functional fluids can be oil-based, water-oil emulsions or water-based. The sulfurized overbased products are thermally stable and are particularly suitable for use as EP and/or anti-wear additives for gear lubricants and cutting fluids.

BACKGROUND OF THE INVENTION

In the automotive and truck markets there is a continuing demand for smaller and lighter vehicles which in turn has resulted in a demand for smaller and lighter engines and drive train components (e.g., transmissions, axles, etc.). Because they are lighter and smaller these engines and drive train components must operate at higher speeds which, among other things, has led to a demand for lubricants having improved EP/anti-wear characteristics as well as high temperature stability characteristics.

EP/anti-wear agents heretofore employed in the art are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The ash-producing detergents/dispersants heretofore used in the art include the oil-soluble neutral and overbased salts of alkali or alkaline earth metals with sulfonic acids, carboxylic acids, and certain organic phosphorus acids. The term "overbased" salt is used herein to designate metal salts wherein the metal is present in stoichiometrically larger amounts than the organic acid radical.

It is known to make overbased salts by contacting a reaction mixture comprising at least one organic material to be overbased, (e.g., sulfonic acid, carboxylic acid, phenol, certain classes of organic phosphorus acids), a reaction medium consisting essentially of at least one inert, organic solvent/diluent for said organic material to be overbased (e.g., mineral oil), a stoichiometric excess of at least one metal base, (e.g., sodium hydroxide, calcium hydroxide, magnesium oxide), at least one promoter, (e.g., methanol, phenol) with at least one acidic material, (e.g., $CO_2$, $SO_2$) at an elevated temperature (e.g., 60°–300° C.). Methods for preparing these overbased salts as well as an extremely diverse group of overbased salts are well known in the art and are disclosed, for example, in the following U.S. Pat. Nos. 2,616,904; 2,616,905; 2,616,906; 2,616,911; 2,616,924; 2,616,925; 2,617,049; 2,695,910; 2,723,234; 2,723,235; 2,723,236; 2,760,970; 2,767,164; 2,767,209; 2,777,874; 2,798,852; 2,839,470; 2,856,359; 2,859,360; 2,856,361; 2,861,951; 2,883,340; 2,915,517; 2,959,551; 2,968,642; 2,971,014; 2,989,463; 3,001,981; 3,027,325; 3,070,581; 3,108,960; 3,147,232; 3,133,019; 3,146,201; 3,152,991; 3,155,616; 3,170,880; 3,170,881; 3,172,855; 3,194,823; 3,223,630; 3,232,883; 3,242,079; 3,242,080; 3,250,710; 3,256,186; 3,274,135; and 3,492,231.

The book "Lubricant Additives" by M. W. Ranney, published by Noyes Data Corporation of Parkridge, N.J. (1973), discloses a number of overbased metal salts of various sulfonic and carboxylic acids and of phenols which are useful as detergent/dispersants in lubricating oil products. The book also entitled "Lubricant Additives" by C. V. Smallheer and R. K. Smith, published by the Lezius-Hiles Co. of Cleveland, Ohio (1967), similarly discloses a number of overbased sulfonates, phenates and carboxylates which are useful as dispersants. U.S. Pat. No. 4,100,082 discloses the use of neutral or overbased metal salts of organic sulfur acids, carboxylic acids and phenols as detergent/dispersants for use in fuels and lubricants. U.S. Pat. No. 4,627,928 discloses the use of overbased magnesium salts of substituted aromatic hydroxy carboxylic acids as dispersants, detergents or antioxidants for lubricants and fuels.

U.K. Patent 1,242,102 discloses a process comprising contacting at a temperature of at least 20° C., (a) at least one compound selected from inorganic acids, the ammonium, amine and metal salts thereof, and inorganic acidic gases (e.g., $SO_2$) which, in water, form acids stronger than carbonic acid, and (b) at least one overbased, carbonated Group I or Group II metal-containing complex in the presence of at least one peptizing agent comprising a material which is effective as a dispersing agent in a lubricating oil but which is not an overbased, carbonated, Group I or Group II metal-containing organic complex for a period of time for at least a portion of (a) to react with (b).

U.S. Pat. Nos. 4,507,215 and 4,579,666 disclose a composition comprising: (A) an acidic, neutral or overbased metal salt of (A)(I) at least one acid of the formula

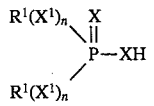

wherein each X and $X^1$ is independently oxygen or sulfur, each n is zero or one, and each $R^1$ is independently the same or different hydrocarbon based group, and (A)(II) at least one carboxylic acid of about 2 to about 40 carbon atoms, the ratio of equivalents of (A)(I) to equivalents of (A)(II) being in the range of about 0.5:1 to about 1:0; and (B) an olefinically unsaturated compound capable of reacting with active sulfur. Compositions comprising the foregoing composition reacted with active sulfur are also disclosed. Lubricants and functional fluids comprising the foregoing compositions are disclosed. A process comprising reacting active sulfur with an olefinically unsaturated compound in the presence of component (A) is also disclosed.

International Publication No. WO89/04358 discloses a composition comprising: (A) at least one neutral or overbased metal salt or boron-containing neutral or overbased metal salt of at least one acidic organic compound, the metal in said salt being selected from the group consisting of alkali metals, alkaline earth metals, zinc, copper, aluminum or a mixture of two or more of said metals; (B) at least one metal deactivator; and (C) at least one compound selected from the group consisting of (C-1) phosphorus-containing amide; (C-2) phosphorus-containing ester; (C-3) sulfur-coupled dithiocarbamate; (C-4) sulfur-coupled functionally-substituted organic compound represented by the formula

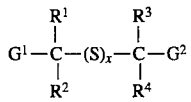

wherein $R^1$, $R^2$, $R^3$ and $R^4$ are each independently H or hydrocarbyl groups; $R^1$ and/or $R^3$ may be $G^1$ or $G^2$; $R^1$ and $R^2$ and/or $R^3$ and $R^4$ together may be alkylene groups containing about 4 to about 7 carbon atoms; $G^1$ and $G^2$ are each independently C(X)R, COOR, C≡N, $R^5$—C=$NR^6$, $CON(R)_2$ or $NO_2$, and $G^1$ also may be $CH_2OH$, wherein X is O or S, each of R and $R^5$ are independently H or a hydrocarbyl group, $R^6$ is H or a hydrocarbyl group; when both $G^1$ and $G^2$ are $R^5C{=}NR^6$, the two $R^6$ groups together may be a hydrocarbylene group linking the two nitrogen atoms; when $G^1$ is $CH_2OH$ and $G^2$ is COOR, a lactone may be formed by intramolecular condensation of $G^1$ and $G^2$; and x is an integer from 1 to about 8; and (C-5) mixture of two or more of any of (C-1) to (C-4). These compositions are useful as additives for lubricants and functional fluids, particularly hydraulic fluids, gear oils, greases and the like.

U.S. Pat. No. 4,755,311 discloses the preparation of monothiophosphoric acid using elemental sulfur or various sulfur sources capable of supplying sulfur to the reaction. The sulfur sources disclosed in this reference include sulfur halides, aromatic and alkyl sulfides, dialkenyl sulfides, sulfurized olefins, sulfurized oils, sulfurized fatty acid esters, sulfurized aliphatic esters of olefinic mono- or dicarboxylic acids, diestersulfides, sulfurized Diels-Alder adducts and sulfurized terpenes.

SUMMARY OF THE INVENTION

This invention relates to a composition comprising at least one sulfurized overbased product made by contacting (A) at least one overbased product or (A') at least one boron-containing overbased product with (B) sulfur and/or at least one source of sulfur; said overbased product (A) or boron-containing overbased product (A') being made using at least one acidic material, with the proviso that when said acidic material is other than $SO_2$ or a source of $SO_2$ said overbased product (A) or boron-containing overbased product (A') is contacted with an effective amount of $SO_2$ or a source of $SO_2$ to displace at least part of said acidic material. In one embodiment the sulfurized overbased product is an overbased thiosulfate or a boron-containing overbased thiosulfate. In one embodiment, the sulfurized overbased product is made using the overbased product (A) and the composition further comprises at least one non-sulfurized boron-containing overbased product. The sulfurized overbased products are thermally stable and are useful as EP and/or anti-wear agents or antioxidants for use in lubricants, functional fluids and normally liquid fuels. The functional fluids can be oil-based, water-oil emulsions or water-based. The sulfurized overbased products are particularly suitable for use as EP and/or anti-wear agents for gear lubricants and cutting fluids. In one embodiment lubricating compositions are provided that pass both the L-37 High Torque Test and the L-42 High Speed Shock Test without the necessity of employing phosphorus and sulfurized olefin anti-wear systems in their formulation.

DESCRIPTION OF THE PREFERRED EMBODIMENTS

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based", "aryl-based", and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

The term "overbased" is a term of art which is generic to well known classes of metal salts or complexes. These materials have also been referred to as "basic", "superbased", "hyperbased", "complexes", "metal complexes", "high-metal containing salts", and the like. Overbased products are metal salts or complexes characterized by a metal content in excess of that which would be present according to the stoichiometry of the metal and the particular acidic organic compound reacted with the metal, e.g., a sulfonic acid. Thus, if a monosulfonic acid,

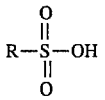

is neutralized with a basic metal compound, e.g., calcium hydroxide, the "neutral" or "normal" metal salt produced will contain one equivalent of calcium for each equivalent of acid, i.e.,

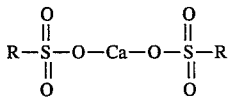

However, as is well known in the art, various processes are available which result in an inert organic liquid solution of a product containing more than the stoichiometric amount of metal. The solutions of these products are referred to herein as overbased products or materials. Following these procedures, the sulfonic acid or an alkali or alkaline earth metal salt thereof can be reacted with a metal base and the product will contain an amount of metal in excess of that necessary to neutralize the acid, for example, 4.5 times as much metal as present in the normal salt or a metal excess of 3.5 equivalents. The actual stoichiometric excess of metal can vary considerably, for example, from about 0.1 equivalent to about 40 or more equivalents depending on the reactions, the process conditions, and the like.

The term "metal ratio" is used herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant (e.g., calcium hydroxide, barium oxide, etc.) according to the known chemical reactivity and stoichiometry of the two reactants. Thus, in the normal calcium sulfonate discussed above, the metal ratio is one, and in the overbased sulfonate, the metal ratio is 4.5. Obviously, if there is present in the material to be overbased more than one compound capable of reacting with the metal, the "metal ratio" of the product will depend upon whether the number of equivalents of metal in the overbased product is compared to the number of equivalents expected to be present for a given single component or a combination of all such components.

Component (A) typically has a metal ratio of in excess of 1 and generally up to about 40 or more. In one embodiment, the metal ratio for component (A) is from an excess of 1 up to about 35, more preferably from an excess of 1 up to about 30. The metal ratio preferably ranges from about 1.1 or about 1.5 to about 40, more preferably about 1.1 or about 1.5 to about 35, more preferably about 1.1 or about 1.5 to about 30, more preferably about 1.1 or about 1.5 to about 26. In one embodiment the metal ratio is from about 1.5 to about 30, more preferably about 6 to about 30, more preferably about 10 to about 30, more preferably about 15 to about 30. In one embodiment, the metal ratio is from about 20 to about 30, more preferably about 23 to about 27, more preferably about 25.

In one embodiment, the overbased products (A) are prepared by contacting a reaction mixture comprising (A)(I) at least one organic material to be overbased, (A)(II) a reaction medium consisting essentially of at least one inert, organic solvent/diluent for said organic material to be overbased, (A)(III) a stoichiometric excess of at least one metal base and (A)(IV) at least one promoter, with (A)(V) at least one acidic material. Methods for preparing the overbased products (A) as well as an extremely diverse group of overbased products are well known in the prior art and are disclosed, for example in the following U.S. Pat. Nos. 2,616,904; 2,616,905; 2,616,906; 2,616,911; 2,616,924; 2,616,925; 2,617,049; 2,695,910; 2,723,234; 2,723,235; 2,723,236; 2,760,970; 2,767,164; 2,767,209; 2,777,874; 2,798,852; 2,839,470; 2,856,359; 2,859,360; 2,856,361; 2,861,951; 2,883,340; 2,915,517; 2,959,551; 2,968,642; 2,971,014; 2,989,463; 3,001,981; 3,027,325; 3,070,581; 3,108,960; 3,147,232; 3,133,019; 3,146,201; 3,152,991; 3,155,616; 3,170,880; 3,170,881; 3,172,855; 3,194,823; 3,223,630; 3,232,883; 3,242,079; 3,242,080; 3,250,710; 3,256,186; 3,274,135; and 3,492,231. These patents disclose processes, organic materials which can be overbased, suitable metal bases, promoters, and acidic materials, as well as a variety of specific overbased products useful in producing the overbased products (A) or boron-containing overbased products (A') used with this invention and are, accordingly, incorporated herein by reference.

ORGANIC MATERIAL TO BE OVERBASED (A)(I)

An important characteristic of the organic material to be overbased (A)(I) is its solubility in the particular reaction medium (A)(II) utilized in the overbasing process. When the reaction medium (A)(II) is a petroleum fraction, particularly mineral oil, the organic material to be overbased (A)(I) is oil-soluble. However, if another reaction medium is employed (e.g., aromatic hydrocarbons, aliphatic hydrocarbons, kerosene, etc.) it is not essential that the organic material to be overbased be soluble in mineral oil as long as it is soluble in the given reaction medium. Obviously, many organic materials which are soluble in mineral oils are soluble in many of the other indicated suitable reaction mediums. When referring to the solubility of the organic material (A)(I) in the reaction medium (A)(II), it is to be understood that the organic material (A)(I) is soluble in the reaction medium (A)(II) to the extent of at least one gram of material (A)(I) per liter of medium (A)(II) at 25° C. The term "oil-soluble" is used herein and throughout the specification and in the appended claims to refer to a material that is soluble in mineral oil to the extent of at least one gram of said material per liter of said mineral oil at 25° C.

The organic material to be overbased is preferably at least one carboxylic acid (A)(I)(a), sulfur-containing acid (A)(I)(b), phosphorus-containing acid (A)(I)(c), functionally-substituted aromatic compound (A)(I)(d), activated methylene compound (A)(I)(e), sulfur-coupled functionally-substituted organic compound (A)(I)(f), precursor of any of the foregoing compounds, or mixture of two or more of any of the foregoing compounds or precursors. These are generally oil-soluble organic acids. Included are the thiophosphorus acids, thiocarboxylic acids, and the like. Also included are the corresponding alkali and alkaline earth metal salts thereof. Representative examples of these organic acids as well as other organic acids, e.g., nitrogen acids, arsenic acids, etc. are disclosed along with the methods of preparing overbased products therefrom in the below cited patents which are incorporated herein by reference. U.S. Pat. Nos. 2,616,904; 2,695,910; 2,767,164; 2,767,209; 3,147,232; 3,274,135; etc. disclose a variety of organic acids suitable for preparing overbased materials as well as representative examples of overbased products prepared from such acids. Overbased acids wherein the acid is a phosphorus acid, a thiophosphorus acid, phosphorus acid-sulfur acid combination, and sulfur acid prepared from polyolefins are disclosed in U.S. Pat. Nos. 2,883,340; 2,915,517; 3,001,981; 3,108,960; and 3,232,883. Overbased phenates are disclosed in U.S. Pat. No. 2,959,551 while overbased ketones are found in U.S. Pat. No. 2,798,852. A variety of overbased materials derived from oil-soluble metal-free, nontautomeric neutral and basic organic polar compounds such as esters, amines, amides, alcohols, ethers, sulfides, sulfoxides, and the like are disclosed in U.S. Pat. Nos. 2,968,642; 2,971,014; and 2,989,463. Another class of materials which can be overbased are the oil-soluble, nitro-substituted aliphatic hydrocarbons, particularly nitro-substituted polyolefins such as polyethylene, polypropylene, polyisobutylene, etc. Materials of this type are illustrated in U.S. Pat. No. 2,959,55 1. Likewise, the oil-soluble reaction product of alkylene polyamines such as propylene diamine or N-alkylated propylene diamine with formaldehyde or formaldehyde producing compound (e.g., paraformaldehyde) can be overbased. Other compounds suitable for overbasing are disclosed in the above-cited patents or are otherwise well-known in the art.

CARBOXYLIC ACIDS (A)(I)(a)

The carboxylic acids (A)(I)(a) useful as the organic material to be overbased (A)(I) in making the overbased products (A) may be aliphatic or aromatic, mono- or polycarboxylic acid or acid-producing compounds. Throughout this specification and in the appended claims, any reference to carboxylic acids is intended to include the acid-producing derivatives thereof such as anhydrides, esters, acyl halides, lactones and mixtures thereof unless otherwise specifically stated.

The carboxylic acids (A)(I)(a) are soluble in the reaction medium (A)(II) and, in one embodiment, the carboxylic acids (A)(I)(a) are oil-soluble. The number of carbon atoms present in the acid is important in contributing to the desired solubility. Usually, in order to provide the desired solubility, the number of carbon atoms in the carboxylic acid should be at least about 8 carbon atoms. These carboxylic acids can have at least about 12 carbon atoms, or at least about 16 carbon atoms, or at least about 20 carbon atoms, or at least about 30 carbon atoms, or at least about 50 carbon atoms. Generally, these carboxylic acids do not contain more than about 400 or about 500 carbon atoms per molecule.

In one embodiment the carboxylic acid is at least one hydrocarbyl-substituted carboxylic acid or anhydride represented by the formulae

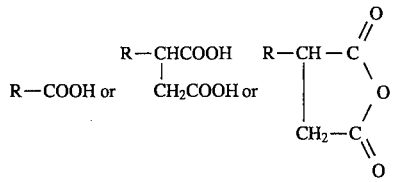

wherein R is a hydrocarbyl group of sufficient length to render the acid or anhydride soluble in reaction medium (A)(II). In one embodiment R is a hydrocarbyl group having at least about 8 carbon atoms, preferably at least about 12 carbon atoms, more preferably at least about 16 carbon atoms. Hydrocarbyl groups having number average molecular weights ($\overline{M}n$) of at least about 200 are useful, and these can have an $\overline{M}n$ in the range of about 200 to about 4000, or about 500 to about 3000, or about 700 to about 2500. The hydrocarbyl group R can be derived from at least one compound selected from the group consisting of ethylene, propylene, 1-butene, isobutylene, 1-pentene, 2-methyl-1-butene, 3-methyl-1 -butene, 1-hexene, 1-heptene, 1-octene, styrene, 1-nonene, 1-decene, 1-undecene, 1-dodecene, 1-tridecene, 1-tetradecene, 1-pentadecene, 1-hexadecene, 1-heptadecene and 1-octadecene. Higher olefin mixtures such as olefins in the range of about 18 to about 24 carbon atoms can be used. The hydrocarbyl group R can be derived from at least one alpha-olefin fraction selected from the group consisting of $C_{15-18}$ alpha-olefins, $C_{12-16}$ alpha-olefins, $C_{14-16}$ alpha-olefins, $C_{14-18}$ alpha-olefins and $C_{16-18}$ alpha-olefins. In one embodiment R is an alkyl or an alkenyl group. In one embodiment R os polypropylene, polybutene, polyisobutylene or a mixture of two or more thereof. In one embodiment, R is $R'X(R''O)_nR'''$— wherein R' is a hydrocarbyl group, preferably an aliphatic hydrocarbon of 1 to about 200 carbon atoms or about 4 to about 100 carbon atoms; R" is ethylene or propylene; R''' is an alkylene group of preferably up to about 30 carbon atoms, or up to about 20 carbon atoms or up to about 10 carbon atoms, or up to about 4 carbon atoms, or up to about 2 carbon atoms, or 1 carbon atom; X is O, S or R""N wherein R"" is hydrogen or a hydrocarbyl group, preferably hydrogen or a lower hydrocarbyl group, more preferably hydrogen or a lower alkyl group; and n is a number in the range of zero to about 10, or zero to about 6, or zero to about 3. Lower alkyl esters of these acids can be used.

The carboxylic acid may contain polar substituents provided that the polar substituents are not present in portions sufficiently large to alter significantly the hydrocarbon character of the carboxylic acid. Typical suitable polar substituents include halo, such as chloro and bromo, oxo, oxy, formyl, sulfenyl, sulfinyl, thio, nitro, etc. Such polar substituents, if present, preferably do not exceed about 10% by weight of the total weight of the hydrocarbon portion of the carboxylic acid, exclusive of the carboxyl groups.

The monocarboxylic acids contemplated herein include saturated and unsaturated acids. Examples of such useful acids include dodecanoic acid, palmitic acid, decanoic acid, oleic acid, lauric acid, stearic acid, myristic acid, linoleic acid, linolenic acid, naphthenic acid, chlorostearic acid, tall oil acid, etc. Anhydrides and lower alkyl esters of these acids can also be used. Mixtures of two or more such agents can also be used. An extensive discussion of these acids is found in Kirk-Othmer "Encyclopedia of Chemical Technology" Third Edition, 1978, John Wiley & Sons New York, pp. 814–871; these pages being incorporated herein by reference. The polycarboxylic acids include dicarboxylic acids and derivatives such as sebacic acid, cetyl malonic acid, tetrapropylene-substituted succinic anhydride, etc.

Acid halides of the afore-described carboxylic acids can be used. These can be prepared by the reaction of such acids or their anhydrides with halogenating agents such as phosphorus tribromide, phosphorus pentachloride, phosphorus oxychloride or thionyl chloride. Esters of such acids can be prepared simply by the reaction of the acid, acid halide or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

The monocarboxylic acids include isoaliphatic acids, i.e., acids having one or more lower acyclic pendant alkyl groups. Such acids often contain a principal chain having from about 14 to about 20 saturated, aliphatic carbon atoms and at least one but usually no more than about four pendant acyclic alkyl groups. The principal chain of the acid is exemplified by groups derived from tetradecane, pentadecane, hexadecane, heptadecane, octadecane, and eicosane. The pendant group is preferably a lower alkyl group such as methyl, ethyl, n-propyl, isopropyl, n-butyl, isobutyl, tert-butyl, n-hexyl, or other groups having up to about 7 carbon atoms. The pendant group may also be a polar-substituted alkyl group such as chloromethyl, bromobutyl, methoxyethyl, or the like, but it preferably contains no more than one polar substituent per group. Specific examples of such isoaliphatic acids include 10-methyl-tetradecanoic acid, 11-methyl-pentadecanoic acid, 3-ethyl-hexadecanoic acid, 15-methyl-heptadecanoic acid, 16-methyl-heptadecanoic acid, 6-methyl-octadecanoic acid, 8-methyl-octadecanoic acid, 10-methyl-octadecanoic acid, 14-methyl-octadecanoic acid, 16-methyl-octadecanoic acid, 15-ethyl-heptadecanoic acid, 3-chloromethyl-nonadecanoic acid, 7,8,9,10-tetramethyl-octadecanoic acid, and 2,9,10-trimethyloctadecanoic acid.

The isoaliphatic acids include mixtures of branch-chain acids prepared by the isomerization of commercial fatty acids of, for example, about 16 to about 20 carbon atoms. A useful method involves heating the fatty acid at a temperature above about 250° C. and a pressure between about 200 and 700 psi, distilling the crude isomerized acid, and hydrogenating the distillate to produce a substantially saturated isomerized acid. The isomerization can be promoted by a catalyst such as mineral clay, diatomaceous earth, aluminum chloride, zinc chloride, ferric chloride, or some other Friedel-Crafts catalyst. The concentration of the catalyst may be as low as about 0.01%, but more often from about 0.1% to about 3% by weight of the isomerization mixture. Water also promotes the isomerization and a small amount, from about 0.1% to about 5% by weight, of water may thus be advantageously added to the isomerization mixture. The unsaturated fatty acids from which the isoaliphatic acids may be derived include oleic acid, linoleic acid, linolenic acid, and commercial fatty acid mixtures such as tall oil acids.

The hydrocarbyl-substituted carboxylic acids suitable for use as the organic material to be overbased are well known in the art and have been described in detail, for example, in the following U.S., British and Canadian patents: U.S. Pat. Nos. 3,024,237; 3,087,936; 3,163,603; 3,172,892; 3,215,707; 3,219,666; 3,231,587; 3,245,910; 3,254,025; 3,271,310; 3,272,743; 3,272,746; 3,278,550; 3,288,714; 3,306,907; 3,307,928; 3,312,619; 3,341,542; 3,346,354; 3,367,943; 3,373,111; 3,374,174; 3,381,022; 3,394,179; 3,454,607; 3,346,354; 3,470,098; 3,630,902; 3,652,616; 3,755,169; 3,868,330; 3,912,764; 4,234,435; and 4,368,133; British Patents 944,136; 1,085,903; 1,162,436; and 1,440,219; and Canadian Patent 956,397. These patents are incorporated herein by reference.

As disclosed in the foregoing patents, there are several processes for preparing these hydrocarbyl-substituted carboxylic acids. Generally, these processes involve the reaction of (1) an ethylenically unsaturated carboxylic acid, acid halide, anhydride or ester reactant with (2) an ethylenically unsaturated hydrocarbon or a chlorinated hydrocarbon at a temperature within the range of about 100°–300° C.

When preparing the hydrocarbyl-substituted carboxylic acids, the carboxylic acid reactant usually corresponds to the formula $R_o$—$(COOH)_n$, where $R_o$ is characterized by the presence of at least one ethylenically unsaturated carbon-to-carbon covalent bond and n is an integer from 1 to about 6 and preferably 1 or 2. The acidic reactant can also be the corresponding carboxylic acid halide, anhydride or ester. Ordinarily, the total number of carbon atoms in the acidic reactant will not exceed about 20, preferably this number will not exceed about 10 and generally will not exceed about 6. Preferably the acidic reactant will have at least one ethylenic linkage in an alpha, beta-position with respect to at least one carboxyl function. Exemplary acidic reactants are acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, and the like. Preferred acid reactants include acrylic acid, methacrylic acid, maleic acid, and maleic anhydride.

The ethylenically unsaturated hydrocarbon reactant and the chlorinated hydrocarbon reactant used in the preparation of these hydrocarbyl-substituted carboxylic acids can be substantially saturated petroleum fractions and substantially saturated olefin polymers and the corresponding chlorinated products. Polymers and chlorinated polymers derived from mono-olefins having from 2 to about 30 carbon atoms are preferred. Especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

Interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with chloroprene, isobutene with p-methyl-styrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of oil solubility, the interpolymers contemplated for use in preparing the hydrocarbyl-substituted carboxylic acids are preferably substantially aliphatic and substantially saturated, that is, they should contain at least about 80% and preferably about 95%, on a weight basis, of units derived from aliphatic mono-olefins. Preferably, they will contain no more than about 5% olefinic linkages based on the total number of the carbon-to-carbon covalent linkages present.

In one embodiment of the invention, the polymers and chlorinated polymers are obtained by the polymerization of a $C_4$ refinery stream having a butene content of about 35% to about 75% by weight and an isobutene content of about 30% to about 60% by weight in the presence of a Lewis acid catalyst such as aluminum chloride or boron trifluoride. These polyisobutenes preferably contain predominantly (that is, greater than about 80% of the total repeat units) isobutene repeat units of the configuration.

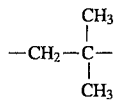

The chlorinated hydrocarbons and ethylenically unsaturated hydrocarbons used in the preparation of the hydrocarbyl-substituted carboxylic acids can have an $\overline{M}n$ of up to about 10,000 or even higher, although preferred higher molecular weight carboxylic acids have molecular weights up to about 5000, more preferably up to about 4000, more preferably up to about 3000. Useful hydrocarbyl-substituted carboxylic acids are those containing hydrocarbyl groups having an $\overline{M}n$ of at least about 280, preferably at least about 420, more preferably at least about 560, more preferably at least about 700.

The hydrocarbyl-substituted carboxylic acids may also be prepared by halogenating a hydrocarbon such as the above-described olefin polymers to produce a polyhalogenated product, converting the polyhalogenated product to a polynitrile, and then hydrolyzing the polynitrile. They may be prepared by oxidation of a polyhydric alcohol with potassium permanganate, nitric acid, or a similar oxidizing agent. Another method involves the reaction of an olefin or a polar-substituted hydrocarbon such as a chloropolyisobutene with an unsaturated polycarboxylic acid such as 2-pentene-1,3,5-tricarboxylic acid prepared by dehydration of citric acid.

Monocarboxylic acids may be obtained by oxidizing a monoalcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

Monocarboxylic and polycarboxylic acids can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281, this patent being incorporated herein by reference.

The monocarboxylic and polycarboxylic acid anhydrides can be obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid groups separated by no more than three carbon atoms such as substituted succinic or glutaric acid, whereas linear anhydrides are usually obtained from polycarboxylic acids having the acid groups separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

In one embodiment, the carboxylic acid is at least one substituted succinic acid or anhydride, said substituted succinic acid or anhydride consisting of substituent groups and succinic groups wherein the substituent groups are derived from a polyalkene, said acid or anhydride being characterized by the presence within its structure of an average of at least about 0.9 succinic group for each equivalent weight of substituent groups, preferably about 0.9 to about 2.5 succinic groups for each equivalent weight of substituent groups. The polyalkene preferably has an ($\overline{M}n$) of at least about 700, preferably about 700 to about 2000, more preferably about 900 to about 1800. The ratio between the weight average molecular weight ($\overline{M}w$) and the ($\overline{M}n$) (that is, the $\overline{M}w/\overline{M}n$) can range from about 1 to about 10, or about 1.5 to about 5. In one embodiment the polyalkene has an $\overline{M}w/\overline{M}n$ value of about 2.5 to about 5. For purposes of this invention, the number of equivalent weights of substituent groups is deemed to be the number corresponding to the quotient obtained by dividing the $\overline{M}n$ value of the polyalkene from which the substituent is derived into the total weight of the substituent groups present in the substituted succinic acid. Thus, if a substituted succinic acid is characterized by a total weight of substituent group of 40,000 and the $\overline{M}n$ value for the polyalkene from which the substituent groups are derived is 2000, then that substituted succinic acylating agent is characterized by a total of 20 (40,000/2000=20) equivalent weights of substituent groups. The substituent groups can be derived from one or more polyalkenes selected from the group consisting of homopolymers and interpolymers of terminal olefins of from 2 to about 20 carbon atoms with the proviso that said interpolymers can optionally contain up to about 25% of polymer units derived from internal olefins of up to about 20 carbon atoms. These are preferably polybutene, polyisobutylene, ethylenepropylene copolymer, polypropylene, and mixtures of two or more of any of these. Included in this group are those derived from polybutene in which at least about 50% of the total units derived from butenes is derived from isobutylene.

In one embodiment the carboxylic acid is at least one substituted succinic acid or anhydride, said substituted succinic acid or anhydride consisting of substituent groups and succinic groups wherein the substituent groups are derived from polybutene in which at least about 50% of the total units derived from butenes is derived from isobutylene. The polybutene is characterized by an $\overline{M}n$ value of about 1500 to about 2000 and an $\overline{M}w/\overline{M}n$ value of about 3 to about 4. These acids or anhydrides are characterized by the presence within their structure of an average of about 1.5 to about 2.5 succinic groups for each equivalent weight of substituent groups.

In one embodiment the carboxylic acid is at least one substituted succinic acid or anhydride, said substituted succinic acid or anhydride consisting of substituent groups and succinic groups wherein the substituent groups are derived from polybutene in which at least about 50% of the total units derived from butenes is derived from isobutylene. The polybutene has an $\overline{M}n$ value of about 800 to about 1200 and an $\overline{M}w/\overline{M}n$ value of about 2 to about 3. The acids or anhydrides are characterized by the presence within their structure of an avenge of about 0.9 to about 1.2 succinic groups for each equivalent weight of substituent groups.

A group of carboxylic acids that are useful are the lactones represented by the formula

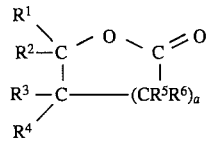

wherein $R^1$, $R^2$, $R^3$, $R^4$, $R^5$ and $R^6$ are independently H or hydrocarbyl groups of from 1 to about 30 carbon atoms, with the proviso that the total number of carbon atoms must be sufficient to render the lactones soluble in the reaction medium (A)(II); $R^2$ and $R^3$ can be linked together to form an aliphatic or aromatic ring; and a is a number in the range of zero to about 4. Within this group the lactones represented by the following formula are particularly useful

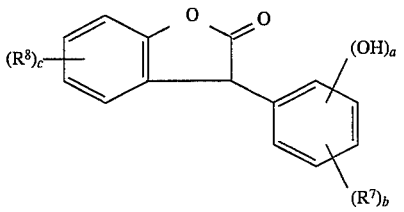

wherein $R^7$ and $R^8$ are aliphatic hydrocarbyl groups of from 1 to about 30 carbon atoms, a and b are numbers in the range of zero to 5 with the proviso that the sum of a and b does not exceed 5, and c is a number in the range of zero to 4. The procedures for preparing lactones of this type through intramolecular cyclization of hydroxy-containing carboxylic acids accompanied by the elimination of water are well known in the art. Generally, the cyclization is promoted by the presence of materials such as acetic anhydride, and the reaction is effected by heating the mixtures to elevated temperatures such as the reflux temperature while removing volatile materials including water.

A useful group of carboxylic acids are the aromatic carboxylic acids. These acids can be represented by the formula

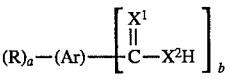

(I)

wherein R is an aliphatic hydrocarbyl group of preferably about 4 to about 400 carbon atoms, a is a number in the range of zero to about 4, Ar is an aromatic group, $X^1$ and $X^2$ are independently sulfur or oxygen, and b is a number in the range of from 1 to about 4, with the proviso that the sum of a and b does not exceed the number of unsatisfied valences of Ar. Preferably, R and a are such that there is an average of at least about 8 aliphatic carbon atoms provided by the R groups. The aromatic group Ar may have the same structure as any of the aromatic groups Ar discussed below under the heading "Functionally-Substituted Aromatic Compounds (A)(I)(d)". Examples of the aromatic groups that are useful herein include the polyvalent aromatic groups derived from benzene, naphthalene, anthracene, phenanthrene, indene, fluorene, biphenyl, and the like. Generally, the Ar groups used herein are polyvalent nuclei derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc. These Ar groups may contain non-hydrocarbon substituents, for example, such diverse substituents as lower alkoxy, lower alkyl mercapto, nitro, halo, alkyl or alkenyl groups of less than about 4 carbon atoms, hydroxy, mercapto, and the like. Examples of the R groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylene-propylene copolymers, and the like.

A group of useful carboxylic acids are those of the formula

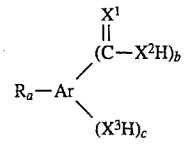

wherein R, Ar, $X^1$, $X^2$, a and b are as defined in Formula I, $X^3$ is oxygen or sulfur, and c is a number in the range of 1 to about 4, usually 1 to about 2, with the proviso that the sum of a, b and e does not exceed the unsatisfied valences of Ar. Within this group are the carboxylic acids of the formula

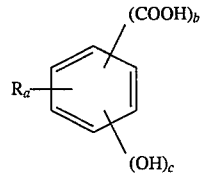

wherein R is an aliphatic hydrocarbyl group preferably containing from about 4 to about 400 carbon atoms, a is a number in the range of from zero to about 4, preferably 1 to about 3; b is a number in the range of 1 to about 4, preferably 1 to about 2, c is a number in the range of 1 to about 4, preferably 1 to about 2, and more preferably 1; with the proviso that the sum of a, b and c does not exceed 6. Preferably, R and a are such that the acid molecules contain at least an average of about 12 aliphatic carbon atoms in the aliphatic hydrocarbon substituents per acid molecule. Also useful are the aliphatic hydrocarbon-substituted salicylic acids wherein each aliphatic hydrocarbon substituent contains an average of at least about 8 carbon atoms per substituent and 1 to 3 substituents per molecule. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms are particularly useful. The aromatic carboxylic acids corresponding to the above formulae are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791, which are incorporated herein by reference.

SULFUR-CONTAINING ACIDS (A)(I)(b)

The sulfur-containing acids include the sulfonic, sulfamic, thiosulfonic, sulfinic, sulfenic, partial ester sulfuric, sulfurous and thiosulfuric acids. Generally they are salts of carbocyclic or aliphatic sulfonic acids.

The carbocyclic sulfonic acids include the mono- or polynuclear aromatic or cycloaliphatic compounds. The sulfonates, which must be soluble in the reaction medium (A)(II), can be represented for the most part by the following formulae:

$$(R^1{}_a—T—(SO_3)_b)_cM_d$$

or $$(R^2—(SO_3)_b)_cM_d$$

In the above formulae, T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc.; $R^1$ is an aliphatic group such as alkyl, alkenyl, alkoxy, alkoxyalkyl, carboalkoxyalkyl, etc.; a is at least 1, and $R^1{}_a$+T contains a total of at least about 15 carbon atoms. $R^2$ is an aliphatic hydrocarbyl group containing at least about 15 carbon atoms. Examples of $R^2$ are alkyl, alkenyl, alkoxyalkyl, carboalkoxyalkyl, etc. Specific examples of $R^2$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^1$, and $R^2$ in the above formulae can also contain other inorganic or organic substituents in addition to those enumerated above such as, for example, hydroxy, mercapto, halogen, nitro, amino, nitroso, sulfide, disulfide, etc. M is hydrogen or a metal cation (e.g., alkali or alkaline earth metal), and a, b, c and d are each at least 1.

In one embodiment the sulfur containing acid is a compound represented by the formula

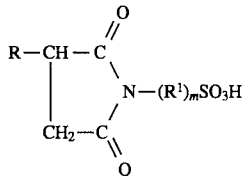

or

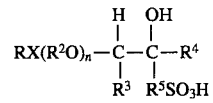

wherein: R and $R^4$ are independently alkylene groups of 1 to about 10 carbon atoms, preferably 1 to about 4 carbon atoms; $R^1$ and $R^5$ are independently alkylene groups of 1 to about 10 carbon atoms, preferably 1 to about 4 carbon atoms; $R^2$ is an alkylene group of 2 to about 10 carbon atoms, preferably 2 to about 4 carbon atoms, more preferably 2 or 3 carbon atoms; $R^3$ is hydrogen or a hydrocarbyl group, preferably hydrogen or a lower alkyl group; X is O, S or $NR^6$ wherein $R^6$ is hydrogen or a hydrocarbyl group, preferably hydrogen or a lower alkyl group; and n and m are independently numbers in the range of zero to about 50, or 1 to about 20, or 1 to about 10.

The following oil-soluble sulfonic acids are useful: mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, dicapryl nitronaphthalene sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,233,676; 2,239,974; 2,263,312; 2,276,090; 2,276,097; 2,315,514; 2,319,121; 2,321,022; 2,333,568; 2,333,788; 2,335,359; 2,337,552; 2,346,568; 2,366,027; 2,374,193; 2,383,319; 3,312,618; 3,471,403; 3,488,284; 3,595,790; and 3,798,012. These patents are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, mono- or poly-wax-substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum whim oils by a sulfuric acid process.

Generally neutral and basic salts of the above-described synthetic and petroleum sulfonic acids are useful in the practice of this invention.

PHOSPHORUS-CONTAINING ACIDS (A)(I)(c)

The phosphorus-containing acids can be represented by the formula

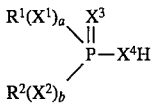

wherein $X^1$, $X^2$, $X^3$ and $X^4$ are independently O, S or $NR^3$ wherein $R^3$ or a hydrocarbyl group, preferably hydrogen or a lower alkyl group; a and b are independently zero or one, and $R^1$ and $R^2$ are independently hydrocarbyl groups. These phosphorus-containing acids include the phosphorus- and sulfur-containing acids. They include those acids wherein at least one $X^3$ or $X^4$ is sulfur, and more preferably both $X^3$ and $X^4$ are sulfur, at least one $X^1$ or $X^2$ is oxygen or sulfur, more preferably both $X^1$ and $X^2$ are oxygen, and a and b are each 1. Mixtures of these acids may be employed in accordance with this invention. $R^1$ and $R^2$ are independently hydrocarbyl groups that are preferably free from acetylenic unsaturation and usually also from ethylenic unsaturation and are of sufficient length to render the compound soluble in the reaction medium (A)(II). Preferably, $R^1$ and $R^2$ are independently hydrocarbyl groups of at least about 12 carbon atoms, more preferably at least about 16 carbon atoms, more preferably at least about 20 carbon atoms. In one embodiment, $R^1$ and $R^2$ independently have up to about 400 or about 500 carbon atoms. Each $R^1$ and $R^2$ can be the same as the other, although they may be different and either or both may be mixtures. Examples of useful $R^1$ and $R^2$ groups include dodecyl, eicosyl, dodecenyl, naphthyl, alkylphenyl, alkylnaphthyl, phenylalkyl, naphthylalkyl, alkylphenylalkyl, alkylnaphthylalkyl, and the like. Useful acids include those represented by the formula

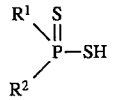

wherein $R^1$ and $R^2$ are as defined above.

The phosphorus-containing acids can be at least one phosphate, phosphonate, phosphinate or phosphine oxide. These pentavalent phosphorus derivatives can be represented by the formula

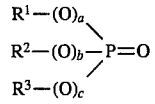

wherein $R^1$, $R^2$ and $R^3$ are independently hydrocarbyl groups, and a, b and c are independently zero or 1. The phosphorus-containing acid can be at least one phosphite, phosphonite, phosphinite or phosphine. These trivalent phosphorus derivatives can be represented by the formula

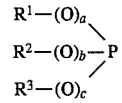

wherein $R^1$, $R^2$ and $R^3$ are independently hydrocarbyl groups, and a, b and c are independently zero or 1. The total number of carbon atoms in $R^1$, $R^2$ and $R^3$ in each of the above formulae must be sufficient to render the compound soluble in the reaction medium (A)(II). Preferably, the total number of carbon atoms in $R^1$, $R^2$ and $R^3$ is at least about 8, more preferably at least about 12, more preferably at least about 16. There is no limit to the total number of carbon atoms in $R^1$, $R^2$ and $R^3$ that is required, but a practical upper limit is about 400 or about 500 carbon atoms. In one embodiment, $R^1$, $R^2$ and $R^3$ in each of the above formulae are independently hydrocarbyl groups of preferably 1 to about 100 carbon atoms, or 1 to about 50 carbon atoms, or 1 to about 30 carbon atoms, with the proviso that the total number of carbons is at least about 8. Each $R^1$, $R^2$ and $R^3$ can be the same as the other, although they may be different. Examples of useful $R^1$, $R^2$ and $R^3$ groups include t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

FUNCTIONALLY-SUBSTITUTED AROMATIC COMPOUNDS (A)(I)(d)

The organic material to be overbased (A)(I) can be at least one functionally substituted aromatic compound (A)(I)(d) represented by the formula $$R_a—Ar—(XH)_b$$

wherein R is an aliphatic hydrocarbyl group of preferably about 4 to about 400 carbon atoms; Ar is an aromatic group; X is O, S, $CH_2O$ or $CH_2NR^1$, wherein $R^1$ is hydrogen or a hydrocarbyl group (preferably alkyl or alkenyl) of preferably 1 to about 30 carbon atoms, more preferably 1 to about 20 carbon atoms, more preferably 1 to about 10 carbon atoms; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. R and a are such that there is a sufficient number of aliphatic carbon atoms in the R groups to render the compound soluble in the reaction medium (A)(II). Preferably, there is an average of at least about 8 aliphatic carbon atoms, more preferably at least about 12 carbon atoms, provided by the R groups.

In one embodiment X is 0 and the functionally-substituted aromatic compound (A)(I)(d) is a phenol. With such phenols, however, it is to be understood that the aromatic group Ar is not a limited benzene, as discussed below.

The R group is a hydrocarbyl group that is directly bonded to the aromatic group Ar. R preferably contains about 6 to about 80 carbon atoms, more preferably about 6 to about 30 carbon atoms, more preferably about 8 to about 25 carbon atoms, and advantageously about 8 to about 15 carbon atoms. Examples of R groups include butyl, isobutyl, pentyl, octyl, nonyl, dodecyl, dodecosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, propylene tetramer and tri(isobutene).

The attachment of the hydrocarbyl group R to the aromatic group Ar can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, aluminum chloride, aluminum bromide, zinc dichloride, etc.). Methods and conditions for carrying out such reactions are well known to those skilled in the art. See, for example, the discussion in the article entitled, "Alkylation of Phenols" in "Kirk- Othmer Encyclopedia of Chemical Technology", Second Edition, Vol. 1, pages 894–895, Interscience Publishers, a division of John Wiley and Company, New York, 1963. Other equally appropriate and convenient techniques for attaching the hydrocarbyl group R to the aromatic group Ar will be apparent to those skilled in the art.

As will be appreciated from inspection of the above formula, these compounds contain at least one R group, as defined above, and at least one functional group XH. Each of the foregoing must be attached to a carbon atom which is a part of an aromatic nucleus in the Ar group. They need not, however, each be attached to the same aromatic ring if more than one aromatic nucleus is present in the Ar group.

It is to be understood that the aromatic group as represented by "Ar" in the above formula, as well as elsewhere in other formulae in this specification and in the appended claims, can be mononuclear such as a phenyl, a pyridyl, a thienyl, or polynuclear. The polynuclear groups can be of the fused type wherein an aromatic nucleus is fused at two points to another nucleus such as found in naphthyl, anthranyl, azanaphthyl, etc. The polynuclear group can also be of the linked type wherein at least two nuclei (either mononuclear or polynuclear) are linked through bridging linkages to each other. These bridging linkages can be chosen from the group consisting of carbon-to-carbon single bonds, ether linkages, keto linkages, sulfide linkages, polysulfide linkages of 2 to about 6 sulfur atoms, sulfinyl linkages, sulfonyl linkages, alkylene linkages, alkylidene linkages, lower alkylene ether linkages, alkylene keto linkages, lower alkylene sulfur linkages, lower alkylene polysulfide linkages of 2 to about 6 carbon atoms, amino linkages, polyamino linkages and mixtures of such divalent bridging linkages. In certain instances, more than one bridging linkage can be present in Ar between two aromatic nuclei; for example, a fluorene nucleus having two benzene nuclei linked by both a methylene linkage and a covalent bond. Such a nucleus may be considered to have three nuclei but only two of them are aromatic. Normally, however, Ar will contain only carbon atoms in the aromatic nuclei per se (plus any alkyl or alkoxy substituent present).

The number of aromatic nuclei, fused, linked or both, in Ar can play a role in determining the integer values of a and b in Formula XII. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The single ring aromatic nucleus which can be the Ar group can be represented by the general formula $$ar(Q)_m$$

wherein ar represents a single ring aromatic nucleus (e.g., benzene) of 4 to 10 carbons, each Q independently represents a lower alkyl group, lower alkoxy group, nitro group, or halogen atom, and m is 0 to 4. Halogen atoms include fluorine, chlorine, bromine and iodine atoms; usually, the halogen atoms are fluorine and chlorine atoms.

Specific examples of when Ar is a single ring aromatic group include the following:

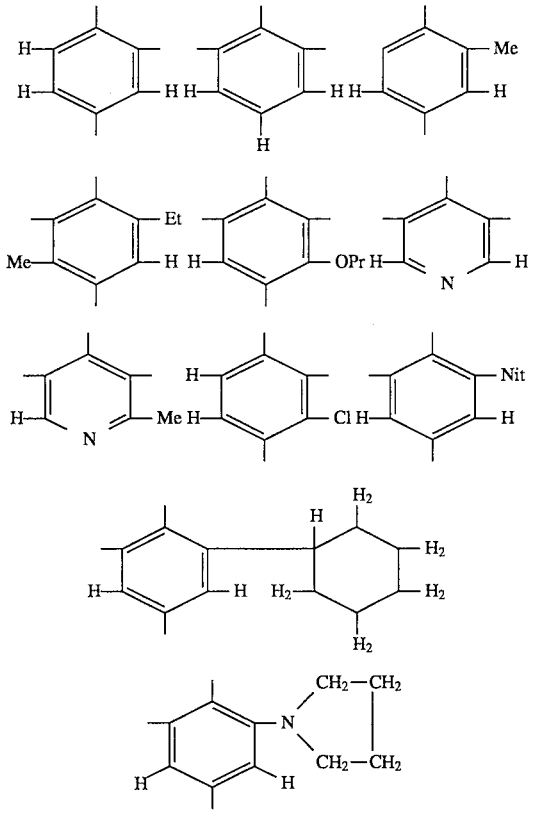

etc., wherein Me is methyl, Et is ethyl, Pr is propyl, and Nit is nitro.

When Ar is a polynuclear fused-ring aromatic group, it can be represented by the general formula $$a\,\mathfrak{T}\,a\,\mathfrak{T}\,m',(Q)mm'$$

wherein ar, Q and m are as defined hereinabove, m' is 1 to 4 and $\mathfrak{T}$ represent a pair of fusing bonds fusing two rings so as to make two carbon atoms part of the rings of each of two adjacent rings. Specific examples of when Ar is a fused ring aromatic group include:

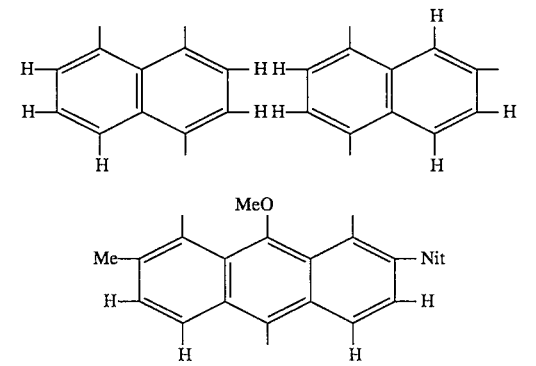

-continued

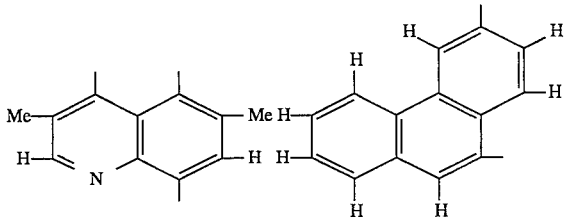

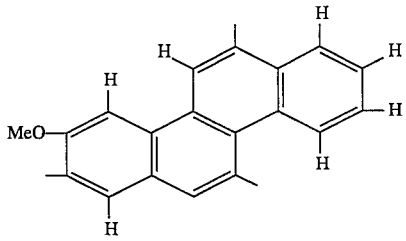

When the aromatic group Ar is a linked polynuclear aromatic group it can be represented by the general formula $$ar\text{-}(Lng\text{-}ar)_w(Q)_{mw}$$

wherein w is an integer of 1 to about 20, ar is as described above with the proviso that there are at least two unsatisfied (i.e., free) valences in the total of ar groups, Q and m are as defined hereinbefore, and each Lng is a bridging linkage individually chosen from the group consisting of carbon-to-carbon single bonds, ether linkages (e.g., —O—), keto linkages (e.g., $$-\overset{O}{\overset{\|}{C}}-),$$

sulfide linkages (e.g., —S—), polysulfide linkages of 2 to 6 sulfur atoms (e.g., $—S—_{2\text{-}6}$), sulfinyl linkages (e.g., —S(O)—), sulfonyl linkages (e.g., $—S(O)_2—$), lower alkylene linkages (e.g., $$-CH_2-,\ -CH_2-CH_2-,\ -CH-\underset{R^\bullet}{\underset{|}{CH}}-,$$

etc.), di(lower alkyl)-methylene linkages (e.g., $CR^\bullet{}_2—$), lower alkylene ether linkages (e.g., $$-CH_2O-,\ -CH_2O-CH_2-,\ -CH_2-CH_2-O-,$$

$$-CH_2CH_2OCH_2CH_2-,\ -CH_2\underset{R^\bullet}{\underset{|}{C}}HOCH_2\underset{R^\bullet}{\underset{|}{C}}H-$$

$$-CH_2\underset{R^\bullet}{\underset{|}{C}}HO\underset{R^\bullet}{\underset{|}{C}}HCH_2-,$$

etc.), lower alkylene sulfide linkages (e.g., wherein one or more —O—'s in the lower alkylene ether linkages is replaced with an —S— atom), lower alkylene polysulfide linkages (e.g., wherein one or more —O—'s is replaced with a $—S—_{2\text{-}6}$ group), amino linkages (e.g., $$-\underset{H}{\underset{|}{N}}-,\ -\underset{R^\bullet}{\underset{|}{N}}-,\ -CH_2N-,\ -CH_2NCH_2-,\ \text{-alk-}\underset{|}{N}-,$$

where alk is lower alkylene, etc.), polyamino linkages (e.g., $$-\underset{|}{N}(alk\underset{|}{N})_{1\text{-}10}-$$

where the unsatisfied free N valences are taken up with H atoms or $R^\bullet$groups), and mixtures of such bridging linkages (each $R^\bullet$ being a lower alkyl group). It is also possible that one or more of the ar groups in the above-linked aromatic group can be replaced by fused nuclei such as ar ⊥ar ⊥m. Specific examples of when Ar is a linked polynuclear aromatic group include:

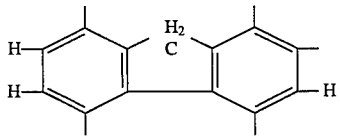

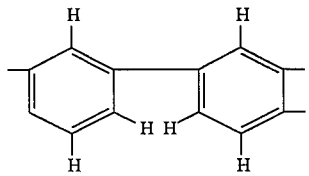

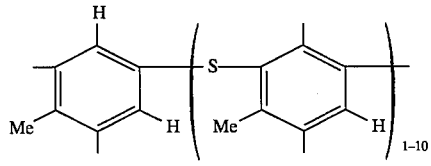

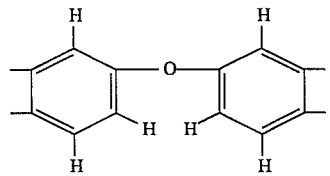

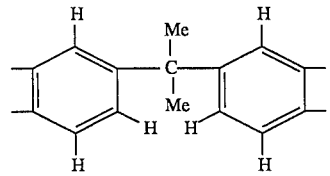

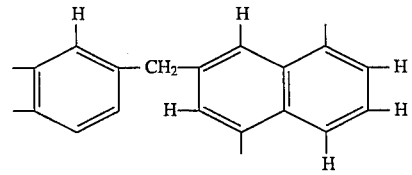

-continued

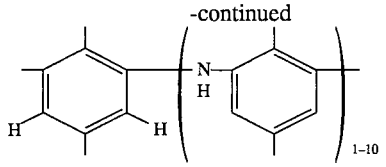

Usually all these Ar groups are unsubstituted except for the R and —O— groups (and any bridging groups). For such reasons as cost, availability, performance, etc., the Ar group is normally a benzene nucleus, lower alkylene bridged benzene nucleus, or a naphthalene nucleus.

In one embodiment, the organic material to be overbased is at least one phenol represented by the formula

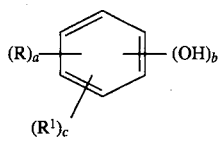

wherein: R is a hydrocarbyl group of about 4 to about 400 carbon atoms; $R^1$ is a lower alkyl, lower alkoxyl, amino, aminomethyl, mercapto, amido, thioamido, nitro or halo group; a is a number in the range of 1 to about 3; b is 1 or 2; and c is 0 or 1. Usually R is derived from a homo- or interpolymer of monoolefins having from 2 to about 20 carbon atoms and is in a position para to the —OH group. Specific examples of the substituent R are a polypropylene group of about 60 to about 340 carbons, a poly(ethylene/propylene) group of about 110 to about 260 carbons (equimolar monomer ratio), a poly(isobutene) group of about 70 to about 320 carbon atoms, and a poly(1-hexene/1-octene/1-decene) group of about 400 to about 750 carbons (equimolar monomer ratios).

A preferred source of the group R are polybutenes, especially poly(isobutene)s, obtained by polymerization of a $C_4$ refinery stream having a total butene content of about 20 to about 75 weight percent and, more specifically, isobutene content of about 15 to about 60 weight percent in the presence of a Lewis acid catalyst such as aluminum trichloride or boron trifluoride. The balance of the stream can contain materials such as ethylene, propylene, butadiene and the saturated analogs as well as other materials typically found in $C_4$ refinery streams. These polybutenes contain predominantly (greater than 80% of total repeat units) isobutene repeating units of the configuration

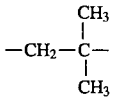

ACTIVATED METHYLENE COMPOUNDS (A)(I)(e)

The activated methylene compounds (A)(I)(e) useful as the organic material to be overbased (A)(I) in making the overbased product (A) are characterized by the presence of certain unsaturated functional groups (e.g., nitro, carbonyl, cyano, sulfone, phenyl, etc.) at a saturated carbon atom which renders any hydrogen atoms bonded to that carbon atom relatively acidic. In one embodiment the activated methylene compounds contemplated for use herein are represented by the formula

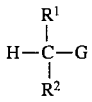

wherein: G is C(X)R, COOR, CN, $R^3C{=}NR^4$, $CXN(R)_2$, S(O)R, $SO_2R$, $R^3C{=}CR^4R^5$, $C_6H_5$ or $NO_2$, wherein X is 0 or S, and R, $R^3$, $R^4$ and $R^5$ ar independently H or hydrocarbyl groups, and when $R^3$ and $R^4$ are hydrocarbyl groups they can be joined together to form a cyclic group; and $R^1$ and $R^2$ are independently H, hydrocarbyl groups G, and when $R^1$ and $R^2$ are hydrocarbyl groups they can be joined together to form a cyclic group.

The total number of carbons in the compound must be sufficient to render the compound soluble in the reaction medium (A)(II). Preferably the total number of carbons is at least about 8 carbon atoms, more preferably at least about 12 carbon atoms, more preferably at least about 16 carbon atoms. There is no upper limit on the number of carbon atoms that is required, although a practical upper limit is about 700 carbon atoms or about 500 carbon atoms.

Examples of the activated methylene compounds include phenyl benzyl ketone, acetophenone, indene, isopropyl t-butyl ketone, diphenyl methane, triphenyl methane, octyl acetoacetate, dodecyl acetoacetate and hexadecyl acetoacetate.

SULFUR-COUPLED FUNCTIONALLY-SUBSTITUTED ORGANIC COMPOUNDS (A)(I)(f)

The organic material to be overbased (A)(I) can be at least one sulfur-coupled functionally-substituted organic compound represented by the formula

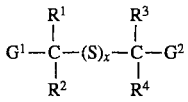

(II)

wherein $R^1$, $R^2$, $R^3$ and $R^4$ are each independently H or hydrocarbyl groups;

$R^1$ and/or $R^3$ may be $G^1$ or $G^2$;

$R^1$ and $R^2$ and/or $R^3$ and $R^4$ together may be alkylene groups containing about 4 to about 7 carbon atoms;

$G^1$ and $G^2$ are each independently C(X)R, COOR, C≡N, $R^5$—C=$NR^6$, $CON(R)_2$, or $NO_2$, and $G^1$ may be $CH_2OH$, wherein X is O or S, each of R and $R^5$ are independently H or a hydrocarbyl group, $R^6$ is H or a hydrocarbyl group;

when both $G^1$ and $G^2$ are $R^5C{=}NR^6$, the two $R^6$ groups together may be a hydrocarbylene group linking the two nitrogen atoms;

when $G^1$ is $CH_2OH$ and $G^2$ is COOR, a lactone may be formed by intramolecular combination of $G^1$ and $G_2$; and x is an integer from 1 to about 8.

$R^1$, $R^2$, $R^3$ and $R^4$ in Formula II are each independently hydrogen or hydrocarbyl groups. The total number of carbon atoms must be sufficient to render the compound soluble in the reaction medium (A)(II). Preferably the total number carbon atoms in $R^1$, $R^2$, $R^3$ and $R^4$ is at least about 8, more preferably at least about carbon atoms that is required, although a practical upper limit is about 500 or about 700. The hydrocarbyl groups may be aliphatic or aromatic groups such as alkyl, cycloalkyl, alkaryl, aralkyl or aryl groups. $R^1$ and $R^2$ and/or $R^3$ and $R^4$ together may be alkylene groups containing from about 4 to about 7 carbon atoms. In these embodiments, $R^1$ and $R^2$ together with the carbon atom bonded to $R^1$ and $R^2$ in Formula II can form a cycloalkyl group. Similarly, $R^3$ and $R^4$ together with the carbon atom bonded to $R^3$ and $R^4$ can form a cycloalkyl group. Also, $R^1$ and/or $R^3$ may be $G^1$ or $G^2$.

Specific examples of hydrocarbyl groups $R^1$, $R^2$, $R^3$ and $R^4$ include methyl, ethyl, isopropyl, isobutyl, secondary butyl, cyclohexyl, cyclo- pentyl, octyl, dodecyl, octadecyl, eicosyl, behenyl, triacontonyl, phenyl, naphthyl, phenethyl, octyl-phenyl, tolyl, xylyl, dioctadecyl-phenyl, triethyl-phenyl, chloro-phenyl, methoxy-phenyl, dibromo-phenyl, nitro-phenyl, 3-chlorohexyl, etc.

The compounds represented by Formula II may be thia-aldehydes or thia-ketones. That is, $G^1$ and $G^2$ in Formula II are C(O)R groups. Various thia-bisaldehyde compounds are known, and the synthesis of such compounds have been described in the prior art such as in U.S. Pat. Nos. 3,296,137 and 2,580,695. Thia-aldehydes and thia-ketones are most conveniently prepared by the sulfurization of a suitable aldehyde or ketone such as one having the structural formula $$R^1R^2CHC(O)R$$

wherein $R^1$ is hydrogen, hydrocarbyl groups or C(O)R, $R^2$ is hydrogen or a hydrocarbyl group, and R is hydrogen or a hydrocarbyl group. In these instances, $R^3$ and $R^4$ in Formula II will be the same as $R^1$ and $R^2$, respectively, and both $G^1$ and $G^2$ are C(O)R groups. When $R^1$ is C(O)R, the Formula II product contains four C(O)R groups.

The sulfurization can be accomplished by reacting the aldehyde or ketone with a sulfur halide such as sulfur monochloride (i.e., $S_2Cl_2$), sulfur dichloride, sulfur monobromide, sulfur dibromide, and mixtures of sulfur halide with sulfur flowers in varying amounts.

The reaction of an aldehyde or ketone with a sulfur halide may be effected simply by mixing the two reactants at the desired temperature which may range from about −30° C. to about 250° C. or higher. The preferred reaction temperature generally is within the range of from about 10° C. to about 80° C. The reaction may be carded out in the presence of a diluent or solvent such as benzene, naphtha, hexane, carbon tetrachloride, chloroform, mineral oil, etc. The diluent/solvent facilitates the control of the reaction temperature and a thorough mixing of the reactants.

The relative amounts of the aldehyde or ketone and the sulfur halide may vary over wide ranges. In most instances, the reaction involves two moles of the aldehyde or ketone and one mole of the sulfur halide. In other instances, an excess of either one of the reactants may be used. When sulfur compounds are desired which contain more than two sulfur atoms, (e.g., x is an integer from 3–8) these compounds can be obtained by reacting the aldehydes with a mixture of sulfur halide and sulfur. Sulfurization products wherein $G^1$ and $G^2$ are different and may be obtained by sulfurizing mixtures of aldehydes and ketones or mixtures of ketones containing different C(O)R groups.

Specific examples of thia-aldehydes and thia-ketones include compounds as represented by Formula I wherein $G^1$ and $G^2$ are C(O)R groups, x is 1 to 4 and $R^1$, $R^2$, $R^3$, $R^4$ and R are as follows:

| $R^1$ | $R^2$ | $R^3$ | $R^4$ | R |
|---|---|---|---|---|
| $C_{25}$ | H | $C_2H_5$ | H | H |
| $C_2H_5$ | $C_4H_{11}$ | $C_2H_5$ | $C_4H_{11}$ | H |

The thia-aldehydes and thia-ketones which can be prepared as described above can be convened to derivatives containing other functional groups which are normally derivable therefrom. Thus, in some of the embodiments of the invention, a thia-aldehyde or thia-ketone is converted to a derivative through contemporaneous conversion of the aldehyde or ketone groups to other terminal groups by chemical reactants and/or reagents. In such reactions, the thia group ($S_x$) and the $R^1$-$R^4$ groups are inert and remain unchanged in the compound. For example, the thia-bisaldehydes can be converted to hydroxy-acid derivatives wherein one of the aldehyde groups ($G^1$) is converted to a COOH group, and the other aldehyde group ($G^2$) is converted to a $CH_2OH$ group. The hydroxy-acid derivatives are obtainable most conveniently by treating the corresponding thia-bisaldehyde with an alkaline reagent such as an alkali metal hydroxide or alkaline earth metal hydroxide, preferably a dilute aqueous solution thereof containing from about 5 to about 50% by weight of the hydroxide in water. Such alkaline reagents may be sodium hydroxide, potassium hydroxide, lithium hydroxide, barium hydroxide, calcium hydroxide, strontium hydroxide, etc. The hydroxy-acid is isolated from the reaction mixture by acidification with a mineral acid such as hydrochloric acid. The hydroxy-acid derivatives of thia-bisaldehydes can be represented by Formula III below.

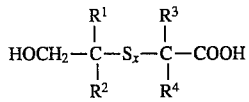

(III)

wherein $R^1$, $R^2$, $R^3$, $R^4$ and x are as previously defined. Specific examples of such hydroxy-acid derivatives include 6-hydroxy-2,2-diethyl-5-propyl-5-butyl-3,4-dithiahexanoic acid; 6-hydroxy-2,2,5,5-tetraethyl-3,4-dithiahexanoic acid; etc.

By virtue of the presence of the hydroxy group and the carboxylic group in the hydroxy-acids described by Formula III above, various other compounds useful as the organic material to be overbased can be obtained by the conversion of such hydroxy group and/or the carboxylic group to other polar groups normally derivable therefrom. Examples of such derivatives include esters formed by esterification of either or both of the hydroxy group and the carboxylic group; amides, imides, and acyl halides formed through the carboxylic group; and lactones formed through intramolecular cyclization of the hydroxy acid accompanied with the elimination of water. The procedures for preparing such derivatives are well known to those skilled in the art, and it is not believed necessary to unduly lengthen the specification by including a detailed description of such procedures. More specifically, the carboxylic group (COOH) in Formula III can be converted to ester groups (COOR) and amide groups ($CON(R)_2$) wherein the R groups may be hydrogen or hydrocarbyl groups containing from 1 to 30 carbon atoms and more generally from 1 to about 10 carbon atoms. Specific examples of such R groups include ethyl, propyl, butyl, phenyl, etc.

The procedures for preparing lactones through intramolecular cyclization of hydroxy-acids of Formula III accompanied by the elimination of water are well known in the art. Generally, the cyclization is promoted by the presence of materials such as acetic anhydride, and the reaction is effected by heating the mixtures to elevated temperatures such as the reflux temperature while removing volatile materials including water.

The compounds characterized by Formula II wherein $G^1$ and/or $G^2$ are $R^5C{=}NR^6$ can be prepared from the corresponding thia-aldehydes and thia-ketones. These mono- and di-imine compounds are prepared by reacting one mole of the dialdehyde (C(O)H) or diketone ($C(O)R^5$) with one and two moles of an amine, respectively. The amines may be monoamines or polyamines. When polyamines are reacted with the thia-aldehydes or thia-ketones ($-C(O)R^5$), cyclic di-imines can be formed. For example, when both $G^1$ and $G^2$ in Formula II are $R^5C{=}NR^6$, the two $R^6$ groups together may be a hydrocarbylene group linking the two nitrogen atoms. The amines which are reacted with the thia-aldehydes and thia-ketones to form the imines may be characterized by the formula $$R^6NH_2$$

wherein $R^6$ is hydrogen, or hydrocarbyl, or an amino hydrocarbyl group. Generally, the hydrocarbyl groups will contain up to about 30 carbon atoms and will more often be aliphatic hydrocarbyl groups containing from 1 to about 30 carbon atoms.

In one embodiment, the hydrocarbyl amines which are useful in preparing the imine derivatives are primary hydrocarbyl amines containing from about 2 to about 30 carbon atoms in the hydrocarbyl group, and more preferably from about 4 to about 20 carbon atoms in the hydrocarbyl group. The hydrocarbyl group may be saturated or unsaturated. Representative examples of primary saturated amines are the lower alkyl amines such as methyl amine, ethyl amine, n-propyl amine, n-butyl amine, n-amyl amine, n-hexyl amine; those known as aliphatic primary fatty amines and commercially known as "Armeen" primary amines (products available from Armak Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides and imides will form in reactions with the amines of technical grade. Also suitable are mixed fatty amines such as Armak's Armeen-C, Armeen-O, Armeen-OL, Armeen-T, Armeen-HT, Armeen S and Armeen SD.

In one embodiment, the amine salts are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

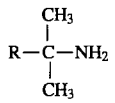

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiarydecyl primary amine, tertiary-dodecyl primary amine, tertiary-tetradecyl primary amine, tertiaryhexadecyl primary amine, tertiary-octadecyl primary amine, tertiary-tetracosanyl primary amine, tertiary-octacosanyl primary amine.

Mixtures of amines are also useful. Illustrative of amine mixtures of this type are "Primene 81R" which is a mixture of $C_{11}$–$C_{14}$ tertiary alkyl primary amines and "Primene JM-T" which is a similar mixture of $C_{18}$–$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are useful. Thus, the $R^6$ group may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

The thia-aldehydes and thia-ketones also can be reacted with polyamines. Examples of useful polyamines include diamines such as mono- or dialkyl, symmetrical or asymmetrical ethylene diamines, propane aliamines (1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" (N-tallow-1,3-diaminopropane), or "Duomeen O" (N-oleyl-1,3-diaminopropane). "Duomeens" are commercially available diamines described in Product Dam Bulletin No. 7-10R1 of Armak Chemical Co., Chicago, Ill.

The reaction of thia-aldehydes (and ketones) with primary amines or polyamines can be carried out by techniques well known to those skilled in the art. Generally, the thia-bisaldehyde or ketone is reacted with the amine or polyamine by reaction in a hydrocarbon solvent at an elevated temperature, generally in an atmosphere of nitrogen. As the reaction proceeds, the water which is formed is removed such as by distillation.

Compounds characterized by Formula II wherein $G^1$ and $G^2$ may be COOR, C=N and $NO_2$ can be prepared by the reaction of compounds characterized by the structural formula

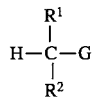

(IV)

wherein $R^1$ and $R^2$ are as defined above, and G is COOR, C=N or $NO_2$, or mixtures of different compounds represented by Formula IV with a sulfur halide or a mixture of sulfur halides and sulfur. Generally, about one mole of sulfur halide is reacted with about two moles of the compounds represented by Formula IV. In one embodiment, $R^1$ also may G. In such instances, the sulfur compounds which are formed as a result of the reaction with the sulfur halide will contain four G groups which may be the same or different depending upon the starting material. For example, when a di-ketone such as 2,4-pentanedione is reacted with sulfur monochloride, the resulting product contains four ketone groups; when the starting material contains a ketone group and an ester group (e.g., ethylacetoacetate), the resulting product contains two ketone groups and two ester groups; and when the starting material contains two ester groups (e.g., diethylmalonate), the product contains four ester groups. Other combinations of functional groups can be introduced into the sulfur compounds represented by Formula II by selecting various starting materials containing the desired functional groups.

Sulfur compounds represented by Formula II wherein $G^1$ and/or $G^2$ are C=N groups can be prepared by the reaction of compounds represented by Formula IV wherein G is C=N and $R^1$ and $R^2$ are hydrogen or hydrocarbyl groups. Preferably, $R^1$ is hydrogen and $R^2$ is a hydrocarbyl group. Examples of useful starting materials include, for example, propionitrile, butyronitrile, etc.

Compounds of Formula II wherein $G^1$ and $G^2$ are $NO_2$ groups can be prepared by (1) reacting a nitro hydrocarbon $R^1R^2C(H)NO_2$ with an alkali metal or alkaline earth metal alkoxide to form the salt of the nitro hydrocarbon, and (2) reacting said salt with sulfur monochloride in an inert, anhydrous nonhydroxylic medium to form a bis (1-nitrohydrocarbyl) disulfide. Preferably the nitro hydrocarbon is a primary nitro hydrocarbon ($R^1$ is hydrogen and $R^2$ is hydrocarbyl).

The starting primary nitro compounds used in carrying out this synthesis are well known. Illustrative compounds are nitroethane, 1-nitropropane, 1-nitrobutane, 1-nitro-4-methylhexane, (2-nitroethyl)benzene, etc.

The nature of the alkanol used in obtaining the alkali or alkaline earth metal salt of the starting primary nitro compound is not critical. It is only necessary that it be appropriate for reaction with the metal to form the alkoxide. Because they are easily obtainable and inexpensive, the lower alkanols (i.e., alkanols of 1 to 4 carbon atoms) such as methanol, ethanol and butanol will usually be employed in the synthesis.

The medium in which the salt is reacted with $S_2Cl_2$ must be inert to both the reactants. It is also essential that the medium be anhydrous and nonhydroxylic for the successful formation of the novel bis(1-nitrohydrocarbyl) disulfides. Examples of suitable media are ether, hexane, benzene, dioxane, higher alkyl ethers, etc.

Ordinarily, it is preferable to maintain a temperature of about 0°–10° C. during the preparation of the metal salt. However, temperatures from about 0° to 25° C. may be used in this step of the process. In the preparation of the bisdisulfide temperatures in the range of −5° to +15° C. may be used. Preferably, temperatures between about 0° to 5° C. are used in this step of the process.

The preparation of various thia-bisnitro compounds represented by Formula II is described in some detail in U.S. Pat. No. 3,479,413, and the disclosure of this patent is hereby incorporated by reference. Representative examples of useful nitro sulfides are: bis(1-nitro-2-phenylethyl) disulfide, bis(1-nitrodecyl) disulfide, bis(1-nitrododecyl) disulfide, bis(1-nitro-2-phenyldecyl) disulfide, bis( 1-nitro-2-cyclohexylethyl) disulfide, bis(1-nitropentadecyl) disulfide, bis(1-nitro-3-cyclobutylpropyl) disulfide bis(1-nitro-2-naphthylethyl) disulfide, bis(1-nitro-3-p-tolylpropyl) disulfide, bis(1-nitro-2-cyclooctylethyl) disulfide, and the like.

The carboxylic ester-containing sulfur compounds (i.e., $G^1$ is COOR) described above can be utilized to prepare other sulfur compounds represented by Formula II. For example, the ester (COOR) can be hydrolyzed to the carboxylic acid (COOH) which can be converted to other esters by reaction with various alcohols or to amides by reaction with various amines including ammonia in primary or secondary amines such as those represented by the formula $(R)_2NH$ wherein each R is hydrogen or a hydrocarbyl group. These hydrocarbyl groups may contain from 1 to about 30 carbon atoms and more generally will contain from about 1 to 10 carbon atoms.

As mentioned above, $R^1$ and $R^2$ and/or $R^3$ and $R^4$ together may be alkylene groups containing from about 4 to about 7 carbon atoms. In this embodiment, $R^1$ and $R^2$ (and $R^3$ and $R^4$) form a cyclic compound with the common carbon atom (i.e., the carbon atom which is common to $R^1$ and $R^2$ in Formula II. Such derivatives of Formula II can be prepared by reacting the appropriately substituted saturated cyclic material with sulfur halides as described above. Examples of such cyclic starting materials include cyclohexane carboxaldehyde ($C_6H_{11}CHO$), cyclohexane carbonitrile ($C_6H_{11}CN$), cyclohexane carboxamide ($C_6H_{11}CONH_2$), cyclohexane carboxylic acid ($C_6H_{11}COOH$), cyclobutane carboxylic acid ($C_4H_7$ COOH), cycloheptane carboxylic acid ($C_7H_{13}COOH$), cycloheptyl cyanide ($C_7H_{13}CN$), etc.

REACTION MEDIUM (A)(II)

The reaction medium (A)(II) used to prepare the overbased product (A) is a substantially inert, organic solvent/diluent for the organic material to be overbased (A)(I). Examples include the alkanes and haloalkanes of about 5 to about 18 carbons, polyhalo- and perhalo-alkanes of up to about 6 carbons, the cycloalkanes of about 5 or more carbons, the corresponding alkyl- and/or halo-substituted cycloalkanes, the aryl hydrocarbons, the alkylaryl hydrocarbons, the haloaryl hydrocarbons, ethers such as dialkyl ethers, alkyl aryl ethers, cycloalkyl ethers, cycloalkylalkyl ethers, alkanols, alkylene glycols, polyalkylene glycols, alkyl ethers of alkylene glycols and polyalkylene glycols, dibasic alkanoic acid diesters, silicate esters, and mixtures of these. Specific examples include petroleum ether, Stoddard Solvent, pentane, hexane, octane, isooctane, undecane, tetradecane, cyclopentane, cyclohexane, isopropylcyclohexane, 1,4-dimethylcyclohexane, cyclooctane, benzene, toluene, xylene, ethyl benzene, tert-butyl-benzene, halobenzenes such as mono- and polychlorobenzenes including chlorobenzene per se and 3,4-dichlorotoluene, mineral oils, n-propylether, isopropylether, isobutylether, n-amylether, methyl-n-amylether, cyclohexylether, ethoxycyclohexane, methoxybenzene, isopropoxybenzene, p-methoxytoluene, methanol, ethanol, propanol, isopropanol, hexanol, n-octyl alcohol, n-decyl alcohol, alkylene glycols such as ethylene glycol and propylene glycol, diethyl ketone, dipropyl ketone, methylbutyl ketone, acetophenone, 1,2-difluorotetrachloroethane, dichlorofluoromethane, 1,2-dibromotetrafluoroethane, trichlorofluoromethane, 1-chloropentane, 1,3-dichlorohexane, formamide, dimethylformamide, acetamide, dimethylacetamide, diethylacetamide, propionamide, diisoctyl azelate, polyethylene glycols, polypropylene glycols, hexa-2-ethylbutoxy disiloxane, etc.

Also useful as the reaction medium are the low molecular weight liquid polymers, generally classified as oligomers, which include the dimers, tetramers, pentamers, etc. Illustrative of this large class of materials are such liquids as the propylene tetramers, isobutylene dimers, and the like.

From the standpoint of availability, cost, and performance, the alkyl, cycloalkyl, and aryl hydrocarbons represent a useful class of reaction mediums. Liquid petroleum fractions represent another useful class. Included within these classes are benzenes and alkylated benzenes, cycloalkanes and alkylated cycloalkanes, cycloalkenes and alkylated cycloalkenes such as found in naphthene-based petroleum fractions, and the alkanes such as found in the paraffin-based petroleum fractions. Petroleum ether, naphthas, mineral oils, Stoddard Solvent, toluene, xylene, etc., and mixtures thereof are examples of economical sources of suitable inert organic liquids which can function as the reaction medium. Particularly useful are those containing at least some mineral oil as a component of the reaction medium.

METAL BASE (A)(III)

The metal base used in preparing the overbased products is selected from the group consisting of alkali metals, alkaline-earth metals, titanium, zirconium, molybdenum, iron, copper, zinc, aluminum, mixture of two or more thereof, or basically reacting compounds thereof. Preferably, the metal is an alkali metal, alkaline-earth metal, zinc, aluminum, or a mixture of two or more thereof. Lithium, sodium, potassium, magnesium, calcium and barium are useful, with lithium, sodium, and potassium being especially useful. Sodium is particularly preferred.

The basically reacting compound can be any compound of any of the foregoing metals or mixtures of metals that is more basic than the corresponding metal salt of the acidic material (A)(V) used in preparing the overbased product. These compounds include alkoxides, nitrites, carboxylates, phosphites, sulfites, hydrogen sulfites, carbonates, hydrogen carbonates, borates, hydroxides, oxides, alkoxides, amides, etc. The nitrites, carboxylates, phosphites, alkoxides, carbonates, borates, hydroxides and oxides are useful. The hydroxides, oxides, alkoxides and carbonates are especially useful.

Examples of metal bases that can be used include ferrous acetate, ferric benzoate, ferrous carbonate, ferric formate, ferrous lactate, ferrous oxide, ferric oxide, ferric hypophosphite, ferrous sulfite, ferric hydrosulfite, cupric propionate, cupric acetate, cupric metaborate, cupric benzoate, cupric formate, cupric laurate, cupric nitrite, cupric palmitate, cupric salicylate, cuprous oxide, copper carbonate, copper naphthenate, zinc benzoate, zinc borate, zinc lactate, zinc oxide, zinc stearate, zinc sulfite, sodium acetate, sodium benzoate, sodium bicarbonate, sodium bisulfite, sodium carbonate, sodium citrate, sodium hydroxide, sodium hypophosphite, sodium metabisulfite, sodium naphthenate, sodium nitrite, sodium sulfite, potassium acetate, potassium benzoate, potassium bicarbonate, potassium bisulfite, potassium carbonate, potassium citrate, potassium hydroxide, potassium hypophosphite, potassium metabisulfite, potassium naphthenate, potassium nitrite, potassium pentaborate, potassium sulfite, titanium dioxide, titanium monoxide, titanium oxalate, zirconium acetate, zirconium oxide, zirconium carbonate, zirconium hydroxide, zirconium lactate, zirconium naphthenate, molybdenum sesquioxide, molybdenum trioxide, molybdic acid, calcium acetate, calcium bisulfite, calcium carbonate, calcium hydroxide, calcium laurate, calcium naphthenate, calcium nitrite, calcium oxalate, calcium phosphite, calcium stearate, calcium sulfite, magnesium acetate, magnesium bisulfite, magnesium carbonate, magnesium hydroxide, magnesium laurate, magnesium naphthenate, magnesium nitrite, magnesium oxalate, magnesium phosphite, magnesium stearate, magnesium sulfite, strontium acetate, strontium bisulfite, strontium carbonate, strontium hydroxide, strontium laurate, strontium naphthenate, strontium nitrite, strontium oxalate, strontium phosphite, strontium stearate, strontium sulfite, barium acetate, barium bisulfite, barium carbonate, barium hydroxide, barium laurate, barium naphthenate, barium nitrite, barium oxalate, barium phosphite, barium stearate, barium sulfite, aluminum borate, aluminum hydroxide, etc. Hydrates of the above compounds are useful.

PROMOTERS (A)(IV)

The promoters, that is, the materials which permit the incorporation of the excess metal into the overbased product, are also quite diverse and well known in the art as evidenced by the cited patents. These materials must be less acidic than the acidic material (A)(V) used in making the overbased products. A particularly comprehensive discussion of suitable promoters is found in U.S. Pat. Nos. 2,777,874; 2,695,910; and 2,616,904, which are incorporated herein by reference. These include the alcoholic and phenolic promoters which are preferred. The alcohol promoters include the alkanols of one to about 12 carbon atoms. Phenolic promoters include a variety of hydroxy-substituted benzenes and naphthalenes. A particularly useful class of phenols are the alkylated phenols of the type listed in U.S. Pat. No. 2,777,874, e.g., heptylphenol, octylphenol, nonylphenol, dodecyl phenol, propylene tetramer phenol, etc. Mixtures of various promoters can be used.

Useful promoters include water, ammonium hydroxide, nitromethane, organic acids of up to about 8 carbon atoms, metal complexing agents such as the salicylaldoximes (e.g., alkyl ($C_1$–$C_{20}$) salicylaldoxime), and alkali metal hydroxides such as lithium hydroxide, sodium hydroxide and potassium hydroxide, and mono- and polyhydric alcohols of up to about 30 carbon atoms, preferably up to about 20 carbon atoms, more preferably up to about 10 carbon atoms. Examples of the alcohols include methanol, ethanol, isopropanol, amyl alcohol, cyclohexanol, octanol, dodecanol, decanol, behenyl alcohol, ethylene glycol, diethylene glycol, triethylene glycol, monomethylether of ethylene glycol, trimethylene glycol, hexamethylene glycol, glycerol, pentaerythritol, benzyl alcohol, phenylethyl alcohol, sorbitol, nitropropanol, chloroethanol, aminoethanol, cinnamyl alcohol, allyl alcohol, and the like. Especially useful are the monohydric alcohols having up to about 10 carbon atoms and mixtures of methanol with higher monohydric alcohols.

ACIDIC MATERIAL (A)(V)

Suitable acidic materials are also disclosed in the above cited patents, for example, U.S. Pat. No. 2,616,904. Included within the known group of useful acidic materials are carbamic acid, acetic acid, formic acid, boric acid, trinitromethane, $SO_2$, $CO_2$, sources of said acids, and mixtures thereof. $CO_2$ and $SO_2$, and sources thereof, are preferred. Useful sources of $CO_2$ include urea, carbamates and ammonium carbonates. Useful sources of $SO_2$ include sulfurous acid, thiosulfuric acid and dithionous acid. $CO_2$ is especially preferred.

Preparation of the Overbased Products (A):

In one embodiment, the overbased products (A) are prepared by contacting a mixture of the organic material to be overbased (A)(I), the reaction medium (A)(II), the metal base (A)(III), and the promoter(A)(IV), with the acidic material (A)(V). A chemical reaction ensues. The temperature at which the acidic material (A)(V) contacts the remainder of the reaction mass depends to a large measure upon the promoter (A)(IV) that is used. With a phenolic promoter, the temperature usually ranges from about 60° C. to about 300° C., and often from about 100 ° C. to about 200° C. When an alcohol or mercaptan is used as the promoter, the temperature usually does not exceed the reflux temperature of the reaction mixture and preferably does not exceed about 100° C. The exact nature of the resulting overbased product (A) is not known. However, it can be adequately described for purposes of the present specification as a single phase homogeneous mixture of the reaction medium and (1) either a metal complex formed from the metal base, the acidic material, and the organic material to be overbased and/or (2) an amorphous metal salt formed from the reaction of the acidic material with the metal base and the organic material to be overbased. Thus, if mineral oil is used as the reaction medium, petrosulfonic acid as the organic material which is overbased, $Ca(OH)_2$ as the metal base, and carbon dioxide as the acidic material, the resulting overbased product (A) can be described for purposes of this invention as an oil solution of either a metal containing complex of the acidic material, the metal base, and the petrosulfonic acid or as an oil solution of amorphous calcium carbonate and calcium petrosulfonate. Since the overbased products (A) are well known and as they are used merely as intermediates in the preparation of the sulfurized overbased products employed herein, the exact nature of these materials is not critical to the present invention.

Boron-Containing Overbased Products (A'):

In one embodiment, the overbased product is at least one boron-containing overbased product (A'). These can be prepared by contacting at least one overbased product (A) with at least one boron compound. The boron compound can be boron oxide, boron oxide hydrate, boron trioxide, boron trifluoride, boron tribromide, boron trichloride, boron acids such as boronic acid (i.e., alkyl-B(OH)2 or aryl-$B(OH)_2$), boric acid (i.e., $H_3BO_3$), tetraboric acid (i.e., $H_2B_4O_7$), metaboric acid (i.e., $HBO_2$), boron anhydrides, and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl ester, boron trifluoridephosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, ?carbitol?, Cellosolve, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ethylene chlorohydrin, o-chlorophenol, m-nitrophenol, 6-bromooctanol, and 7-keto-decanol. Lower alcohols, 1,2-glycols, and 1-3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

The contacting of the overbased product (A) with the boron compound can be effected using standard mixing techniques. The ratio of equivalents of the boron compound to equivalents of the overbased product (A) can range up to about 40:1 or higher, and is typically in the range of about 0.05:1 to about 30:1, and is often in the range of about 0.2:1 to about 20:1. Equivalent ratios of about 0.5:1 to about 5:1, preferably about 0.5:1 to about 2:1, and often about 1:1 are often used. For purposes of this invention, an equivalent of a boron compound is based upon the number of moles of boron in said compound. Thus, boric acid has an equivalent weight equal to its molar weight, while tetraboric acid has an equivalent weight equal to one-fourth of its molar weight. An equivalent weight of an overbased product (A) is based upon the number of equivalents of metal in said overbased product available to react with the boron. An equivalent of a metal is dependent upon its valence. Thus, one mole of a monovalent metal such as sodium provides one equivalent of the metal, whereas two moles of a divalent metal such as calcium are required to provide one equivalent of such metal. This number can be measured using standard techniques (e.g., titration using bromophenol blue as the indicator to measure total base number). Thus, an overbased product (A) having one equivalent of metal available to react with the boron has an equivalent weight equal to its actual weight. An overbased product (A) having two equivalents of metal available to react with the boron has an equivalent weight equal to one-half its actual weight.

The temperature can range from about room temperature up to the decomposition temperature of the reactants or desired products having the lowest such temperature, and is preferably in the range of about 20° C. to about 200° C., more preferably about 20° C. to about 150° C., more preferably about 50° C. to about 150° C., more preferably about 80° C. to about 120° C.

The contacting time is the time required to form the desired concentration of metal borate (e.g., sodium borate) in the boron-containing overbased product (A'). This concentration can be measured using standard techniques (e.g., measurement of the concentration of dissolved solids when the boron compound is a solid, measurement of the water of reaction formed by the borating process, measurement of the displacement of acidic material (A)(V), e.g., $CO_2$, from the overbased product (A), etc.). Generally, the contacting time is from about 0.5 to about 50 hours, and often is from about 1 to about 25 hours, preferably about 1 to about 15 hours, more preferably about 4 to about 12 hours.

The following Examples A-1 to A-45 illustrate the preparation of the overbased products (A) or (A'). Unless otherwise indicated in the examples as well as throughout the specification and the appended claims, all parts and percentages are by weight, and all temperatures are in degrees centigrade.

EXAMPLE A-1

A mixture of 853 grams of methyl alcohol, 410 grams of blend oil, 54 grams of sodium hydroxide, and a neutralizing amount of additional sodium hydroxide is prepared. The amount of the latter addition of sodium hydroxide is dependent upon the acid number of the subsequently added sulfonic acid. The temperature of the mixture is adjusted to 49° C. 1070 grams of a mixture of straight chain dialkyl benzene sulfonic acid (Mw=430) and blend oil (42% by weight active content) are added while maintaining the temperature at 49°–57° C. 145 grams of polyisobutenyl (number average Mw=950)-substituted succinic anhydride are added. 838 grams of sodium hydroxide are added. The temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35% by weight.

EXAMPLE A-2

A mixture of 160 grams of blend oil, 111 grams of polyisobutenyl (number average Mw=950) succinic anhydride, 52 grams of n-butyl alcohol, 11 grams of water, 1.98 grams of Peladow (a product of Dow Chemical identified as containing 94–97% $CaCl_2$) and 90 grams of hydrated lime are mixed together. Additional hydrated lime is added to neutralize the subsequently added sulfonic acid, the amount of said additional lime being dependent upon the acid number of the sulfonic acid. 1078 grams of an oil solution (42% by weight active content) of a straight chain dialkyl benzene sulfonic acid (Mw=430) are added with the temperature of the reaction mixture not exceeding 79° C. The temperature is adjusted to 60° C. 64.5 grams of the reaction product of heptyl phenol, lime and formaldehyde, and 217 grams of methyl alcohol are added. The reaction mixture is blown with carbon dioxide to a base number (bromophenol blue) of 20–30. 112 grams of hydrated lime are added to the reaction mixture, and the mixture is blown with carbon dioxide to a base number (phenolphthalein) of 45–60, while maintaining the temperature of the reaction mixture at 46°–52° C. The latter step of hydrated lime addition followed by carbon dioxide blowing is repeated three more times with the exception with the last repetition the reaction mixture is carbonated to a base number (phenolphthalein) of 45–55. The reaction mixture is flash dried at 93°–104° C., kettle dried at 149°–160° C., filtered and adjusted with oil to a 12.0% Ca level. The product is an overbased calcium sulfonate having a total base number (bromophenol blue) of 300, a metal content of 12.0% by weight, a metal ratio of 12, a sulfate ash content of 40.7% by weight, and a sulfur content of 1.5% by weight.

EXAMPLE A-3

A mixture of 1000 grams of a primarily branched chain monoalkyl benzene sulfonic acid (Mw=500), 771 grams of o-xylene, and 75.2 grams of polyisobutenyl (number average Mw=950) succinic anhydride is prepared and the temperature is adjusted to 46° C. 87.3 grams of magnesium oxide are added. 35.8 grams of acetic acid are added. 31.4 grams of methyl alcohol and 59 grams of water are added. The reaction mixture is blown with 77.3 grams of carbon dioxide at a temperature of 49°–54° C. 87.3 grams of magnesium oxide, 31.4 grams of methyl alcohol and 59 grams of water are added, and the reaction mixture is blown with 77.3 grams of carbon dioxide at 49°–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.3% by weight, a metal ratio 14.7, a sulfate ash content of 46.0%, and a sulfur content of 1.6% by weight.

EXAMPLE A-4

A mixture of 790 grams of an alkylated benzene sulfonic acid, 71 grams of a polybutenyl succinic anhydride (equivalent weight about 560) and 176 grams of mineral oil is prepared in a reactor at room temperature. Sodium hydroxide (320 grams) is added to this mixture followed by the addition of 640 grams of methanol. The temperature of the resulting mixture increases to 89° C. (reflux) over a period of 10 minutes due to exotherming of this reaction mixture. During this period, the reaction mixture is carbonated with carbon dioxide at a rate of 4 cfh (cubic feet/hour). Carbonation is continued for about 30 minutes as the temperature of the reaction mixture gradually decreases to 74° C. The methanol and other volatile materials are stripped from the carbonated mixture by blowing nitrogen through the mixture at a rate of 2 cfh, while slowly increasing the temperature to 150° C., over a period of about 90 minutes. After completion of the stripping, the reaction mixture is held at a temperature in the range of 155°–165° C. for about 30 minutes, and then filtered to yield an oil solution of the desired basic sodium sulfonate having a metal ratio of about 7.75.

EXAMPLE A-5

A mixture of 780 grams of an alkylated benzene sulfonic acid, 119 grams of a polybutenyl succinic anhydride (equivalent weight about 560), and 442 grams of mineral oil is prepared and mixed with 800 grams of sodium hydroxide and 704 grams of methanol. This reaction mixture is carbonated by intimately contacting it with carbon dioxide at a rate of 7 cfh for a period of 11 minutes, as the temperature slowly increases to 97° C. The rate of carbon dioxide flow is reduced to 6 cfh and the temperature of the mixture decreases slowly to 88° C. over a period of about 40 minutes. The rate of carbon dioxide flow is reduced to 5 cfh for a period of about 35 minutes and the reaction temperature slowly decreases to 73° C. The volatile materials are stripped by blowing nitrogen through the carbonated mixture at a rate of 2 cfh for 105 minutes as the temperature is slowly increased to 160° C. After the stripping is completed, the mixture is held at a temperature of 160° C. for an additional 45 minutes and then filtered to yield an oil solution of the desired basic sodium sulfonate, having a metal ratio of about 19.75.

EXAMPLE A-6

A mixture of 3120 grams of an alkylated benzene sulfonic acid, 284 grams of the polybutenyl succinic anhydride (equivalent weight about 560), and 704 grams of mineral oil is prepared and mixed with 1280 grams of sodium hydroxide and 2560 grams of methanol. This reaction mixture is carbonated using carbon dioxide at a rate of 10 cfh for a total period of about 65 minutes. During this time, the temperature of the reaction mixture increases to 90° C. and then slowly decreases to 70° C. The volatile material is stripped by blowing with nitrogen gas at the rate of 2 cfh for 2 hours as the temperature of the mixture is slowly increased to 160° C. After the stripping is complete, the mixture is held at a temperature of 160° C. for 0.5 hour, and then filtered to yield a clear oil solution of the desired sodium sulfonate having a metal ratio of 7.75.

EXAMPLE A-7

A mixture of 3200 grams of an alkylated benzene sulfonic acid, 284 grams of a polybutenyl succinic anhydride (equivalent weight of about 560) and 623 grams of mineral oil is prepared and mixed with 1280 grams of sodium hydroxide and 2560 grams of methanol. The reaction mixture is carbonated using carbon dioxide at a rate of 10 cfh for a total period of about 77 minutes. During this time the temperature of the reaction mixture increases to 92° C. and then gradually drops to 73° C. The volatile materials are stripped by blowing with nitrogen gas at a rate of 2 cfh for a period of about 2 hours as the temperature of the reaction mixture is slowly increased to 160° C. The final tracing of the volatile material is stripped from the reaction mixture using a vacuum of 30 mm/Hg and a temperature of 170° C. After the stripping is complete the mixture is held at a temperature of 170° C. and then filtered to yield a clear oil solution of the desired sodium sulfonate having a metal ratio of about 7.72.

EXAMPLE A-8

A mixture of 780 grams of an alkylated benzene sulfonic acid, 86 grams of a polybutenyl succinic anhydride (equivalent weight about 560), and 254 grams of mineral oil is prepared and mixed with 480 grams of sodium hydroxide and 640 grams of methanol. This reaction mixture is carbonated using carbon dioxide at a rate of 6 cfh for a total period of about 45 minutes. During this time the temperature of the reaction mixture increases to 95° C. and then gradually cools to 4° C. The volatile material is stripped by blowing with nitrogen gas at a rate of 2 cfh for a period of about one hour as the temperature of the mixture is increased to 160° C. After stripping is complete the mixture is held at a temperature of 160° C. for 0.5 hour and then filtered to yield an oil solution of the desired overbased sodium sulfonate having a metal ratio of 11.8.

EXAMPLE A-9

A mixture of 3120 grams of an alkylated benzene sulfonic acid, 344 grams of polybutenyl succinic anhydride (equivalent weight about 560), and 1016 grams of mineral oil is prepared and mixed with 1920 grams of sodium hydroxide and 2560 grams of methanol. This mixture is carbonated over a period of about two hours using carbon dioxide at a rate of 10 cfh. During this period of carbonation the temperature of the mixture increases to 96° C. and then gradually cools to 74° C. The volatile materials are stripped from the reaction mixture by nitrogen at a rate of 2 cfh, for a period of two hours, as the temperature is increased from 74° C. to 160° C. by external heating. This stripped mixture is heated for an additional one hour at 160° C., and then filtered. The filtrate is vacuum stripped (30 mm/Hg) at 160° C., to remove a small amount of water, and again filtered to give a solution of the desired overbased sodium sulfonate having a metal ratio of about 11.8.

EXAMPLE A-10

A mixture of 2800 grams of an alkylated benzene sulfonic acid, 302 grams of polybutenyl succinic anhydride (equivalent weight of about 560), and 818 grams of mineral oil is prepared and mixed with 1680 grams of sodium hydroxide and 2240 grams of methanol. This mixture is carbonated over a period of about 90 minutes using carbon dioxide at a rate of 10 cfh. During this period of carbonation, the temperature of the mixture increases to 96° C. and then slowly cools to 76° C. The volatile materials are stripped from the reaction mixture using nitrogen at a rate of 2 cfh, as the temperature is slowly increased from 76° C. to 165° C. by external heating. Water is removed from the reaction mixture by stripping under vacuum, 35 mm/Hg at 165° C. After filtration, a solution of the desired overbased sodium sulfonate is obtained. The metal ratio is about 10.8.

EXAMPLE A-11

A mixture of 780 grams of an alkylated benzene sulfonic acid, 103 grams of a polybutenyl succinic anhydride (equivalent weight about 560), and 350 grams of mineral oil is prepared and mixed with 640 grams of sodium hydroxide and 640 grams of methanol. This mixture is carbonated over a period of about one hour using carbon dioxide at a rate of 6 cfh. During this period of carbonation, the temperature of the mixture increases to 95° C. and then gradually cools to 75° C. The volatile material is stripped from the reaction mixture by nitrogen gas at a rate of 2 cfh over a period of 95 minutes. During this period of stripping, the temperature of the reaction mixture initially drops to 70° C., over a period of 30 minutes, and then slowly rises to 78° C. over a period of 15 minutes. The mixture is then heated to 155° C. over a period of 80 minutes. The stripped mixture is heated for an additional 30-minute period at a temperature in the range of 155°–160° C., and then filtered. The filtrate is an oil solution of the desired overbased sodium sulfonate having a metal ratio of about 15.2.

EXAMPLE A-12

A mixture of 2400 grams of an alkylated benzene sulfonic acid, 308 grams of a polybutenyl succinic anhydride (equivalent weight of about 560), and 991 grams of mineral oil is prepared and mixed with 1920 grams of sodium hydroxide and 1920 grams of methanol. This reaction mixture is carbonated by intimately contacting it with carbon dioxide at a rate of 10 cfh for a total period of 110 minutes. During this period of time, the temperature of the reaction mixture initially rises to 98° C. and then slowly decreases to 76° C. over a period of about 95 minutes. The methanol and water are stripped from the reaction mixture by nitrogen gas at a rate of 2 cfh, as the temperature of the reaction mixture slowly increases to 165° C. The last traces of volatile material are stripped from the reaction mixture using a vacuum of 30 mm/Hg at a temperature of 160° C. After vacuum stripping, the mixture is filtered to yield an oil solution of the desired overbased sodium sulfonate having a metal ratio of 15.1.

EXAMPLE A-13

A mixture of 780 grams of an alkylated benzene sulfonic acid, 119 grams of a polybutenyl succinic anhydride (equivalent weight about 560) and 442 grams of mineral oil is prepared and mixed with 800 grams of sodium hydroxide and 640 grams of methanol. This mixture is carbonated over a period of about 55 minutes, using carbon dioxide at a rate flow of 8 cfh. During this period of carbonation, the temperature of the mixture increases to 95° C. and then slowly decreases to 67° C. The methanol and water are stripped from the reaction mixture by the use of nitrogen gas at 2 cfh for a period of about 40 minutes, while the temperature of the reaction mixture is slowly increased to 160° C. After this stripping, the temperature of the mixture is maintained for about 30 minutes at a temperature in the range of 160°–165° C. It is then filtered to give a solution of the corresponding sodium sulfonate, having a metal ratio of about 16.8.

EXAMPLE A-14

836 grams of a sodium petroleum sulfonate in an oil solution containing 48% oil, and 63 grams of a polybutenyl succinic anhydride (equivalent weight about 560) are introduced into a reactor and heated to 60° C. This mixture is mixed with 280 grams of sodium hydroxide and 320 grams of methanol. The reaction mixture is carbonated using carbon dioxide at a rate of 4 cfh for a total period of about 45 minutes. During this time, the temperature of the reaction mixture increases to 85° C. and then slowly decreases to 74° C. The volatile material is stripped by blowing with nitrogen gas at a rate of 2 cfh, while the temperature of the mixture is gradually increased to 160° C. After the stripping has been completed, the mixture is heated an additional 30 minutes at 160° C., and then is filtered to yield the corresponding sodium salt in solution. The product has a metal ratio of 8.0.

EXAMPLE A-15

1256 grams of a sodium petroleum sulfonate in an oil solution containing 48% by weight oil, and 95 grams of polybutenyl succinic anhydride (equivalent weight about 560) are introduced into a reactor and heated to 60° C. This solution is mixed with 420 grams of sodium hydroxide and 960 grams of methanol. Carbonation of this mixture is accomplished using carbon dioxide at the rate of 4 cfh for a total period of 60 minutes. During this time, the temperature of the mixture is increased to 90° C. and then slowly decreases to 70° C. The volatile materials are stripped from the carbonated mixture using nitrogen gas while slowly increasing the temperature to 160° C. After stripping the reaction mixture is allowed to stand at 160° C. for approximately 30 minutes and then is filtered to yield an oil solution of the sodium sulfonate having a metal ratio of about 8.0.

EXAMPLE A-16

To a mixture of 3245 grams of a mineral oil solution of barium petroleum sulfonate (sulfate ash of 7.6%), 32.5 grams of octylphenol, and 197 grams of water, there is added 73 grams of barium oxide within a period of 30 minutes at 57°–84° C. The mixture is heated to 100° C. and maintained at 100° C. for one hour to remove substantially all water. The reaction mixture is blown with 75 parts of carbon dioxide at 133°–170° C. over a period of 3 hours. A mixture of 1000 grams of the above carbonated intermediate product, 121.8 grams of octylphenol, and 234 grams of barium hydroxide is heated at 100° C. and then at 150° C. for one hour. The mixture is then blown with carbon dioxide at 150° C. for one hour at a rate of 3 cfh. The carbonated product is filtered and the filtrate is found to have a sulfate ash content of 39.8% and a metal ratio of 9.3.

EXAMPLE A-17

A mixture of 1285 grams of 40% barium petroleum sulfonate and 500 milliliters of methanol is stirred at 55°–60° C. while 301 grams of barium oxide is added portionwise over a period of one hour. The mixture is stirred an additional 2 hours at 45°–55° C., then treated with carbon dioxide at 55°–65° C. for 2 hours. The resulting mixture is stripped of methanol by heating to 150° C. The residue is filtered through a siliceous filter aid, the clear, brown filtrate analyzing as: sulfate ash, 33.2%; and metal ratio, 4.7.

EXAMPLE A-18

A stirred mixture of 57 grams of nonyl alcohol and 301 grams of barium oxide is heated at 150°–175° C. for one hour, then cooled to 80° C. whereupon 400 grams of methanol is added. The resultant mixture is stirred at 70°–75° C. for 30 minutes, then treated with 1285 grams of 40% barium petroleum sulfonate. This mixture is stirred at reflux temperature for one hour, then blown with carbon dioxide at 60°–70° C. for 2 hours. The mixture is heated to 160° C. at a pressure of 18 mm. Hg. and thereafter filtered. The filtrate is a clear, brown oily material having the following analysis: sulfate ash, 32.5%; and metal ratio, 4.7.

EXAMPLE A-19

To a mixture of 1145 grams of a 40% by weight mineral oil solution of barium mahogany sulfonate and 100 grams of methyl alcohol at 55° C., there is added 220 grams of barium oxide while the mixture is blown with carbon dioxide at a rate of 2 to 3 cfh. To this mixture there is added an additional 78 grams of methyl alcohol and then 460 grams of barium oxide while the mixture is blown with carbon dioxide. The carbonated product is heated to 150° C. for one hour and filtered. The filtrate has a sulfate ash content of 53.8% by weight and a metal ratio of 8.9.

EXAMPLE A-20

A normal calcium mahogany sulfonate is prepared by metathesis of 750 grams of a 60% by weight oil solution of sodium mahogany sulfonate with a solution of 67 grams of calcium chloride and 63 grams of water. The reaction mass is heated for 4 hours at 90°–100 ° C. to effect the conversion of the sodium mahogany sulfonate to calcium mahogany sulfonate. Then 54 grams of lime are added and the reaction mixture is heated to 150° C. over a period of 5 hours. The mixture is cooled to 40° C. 98 grams of methanol are added and 152 grams of carbon dioxide are introduced over a period of 20 hours at 42°–43° C. Water and alcohol are then removed by heating the mass to 150° C. The residue in the reaction vessel is diluted with 100 parts of low viscosity mineral oil. The filtered oil solution of the desired carbonated calcium sulfonate overbased material shows the following analysis: sulfate ash content, 16.4%; and a metal ratio of 2.5. By adding barium or calcium oxide or hydroxide to this product with subsequent carbonation, the metal ratio can be increased to a ratio of 3.5 or greater as desired.

EXAMPLE A-21

A mixture of 880 grams of a 57.5% by weight oil solution of the calcium sulfonate of tridecylbenzene bottoms (the bottoms constitute a mixture of mono-, di-, and tri-decylbenzene), 149 grams of methanol, and 59 grams of calcium hydroxide are introduced into a reaction vessel and stirred vigorously. The mixture is heated to 40°–45° C. and carbon dioxide is introduced for 0.5 hour at the rate of 2 cfh. The carbonated reaction mixture is then heated to 150° C. to remove alcohol and any water present, and the residue is filtered for purposes of purification. The product, a 61% by weight oil solution of the desired overbased carbonated calcium sulfonate material shows the following analysis: ash content, 16.8%; and metal ratio, 2.42. By further carbonation in the presence of an alkali or alkaline earth metal oxide, hydroxide, or alkoxide, the metal ratio can readily be increased to 3.5 or greater.

EXAMPLE A-22

A mixture of 2090 grams of a 45% by weight oil solution of calcium mahogany sulfonate containing 1% by weight water, 74 grams of calcium hydroxide, and 25 1 grams of ethylene glycol is heated for one hour at 100° C. Carbon dioxide is then bubbled through the mixture at 40°–45° C. for 5.5 hours. The ethylene glycol and any water present are removed by heating the mixture to a temperature of 185° C. at 10.2 mm. Hg. The residue is filtered, yielding the desired overbased calcium sulfonate material, having the following analysis: sulfate ash, 12.9%; and a metal ratio of 2.0. The metal ratio can be increased to 3.5 or greater as desired by carbonation in the presence of calcium oxide or hydroxide.

EXAMPLE A-23

A mixture of 1595 grams of the overbased material of Example A-20, 167 grams of the calcium phenate prepared as indicated below, 616 grams of mineral oil, 157 grams of 91% calcium hydroxide, 288 grams of methanol, 88 grams of isobutanol, and 56 grams of mixed isomeric primary amyl alcohols (containing about 65% normal amyl, 3% isoamyl and 32% of 2-methyl-1-butyl alcohols) is stirred vigorously at 40° C. 25 grams of carbon dioxide is introduced over a period of 2 hours at 40°–50° C. Thereafter, three additional portions of calcium hydroxide, each amounting to 157 grams, are added and each such addition is followed by the introduction of carbon dioxide as previously illustrated. After the fourth calcium hydroxide addition and the carbonation step is completed, the reaction mass is carbonated for an additional hour at 43°–47° C. The substantially neutral, carbonated reaction mixture is stripped of alcohol and any water of reaction by heating to 150° C. and simultaneously blowing it with nitrogen. The residue in the reaction vessel is filtered. The filtrate, an oil solution of the desired overbased calcium sulfonate, shows the following analysis: sulfate ash content, 41.11%; and a metal ratio of 12.55.

The calcium phenate used above is prepared by adding 2250 grams of mineral oil, 960 grams of heptylphenol, and 50 grams of water to a reaction vessel and stirring at 25° C. The mixture is heated to 40° C. and 7 grams of calcium hydroxide and 231 grams of 91% commercial paraformaldehyde is added over a period of one hour. The mixture is heated to 80° C. and 200 additional grams of calcium hydroxide (making a total of 207 grams) are added over a period of one hour at 80°–90° C. The mixture is heated to 150° C. and maintained at that temperature for 12 hours while nitrogen is blown through the mixture to assist in the removal of water. The reaction mass is then filtered. The filtrate, a 33.6% by weight oil solution of the desired calcium phenate of heptylphenol-formaldehyde condensation product, has a 7.56% sulfate ash content.

EXAMPLE A-24

A mixture of 574 grams of 40% by weight barium petroleum sulfonate oil solution, 98 grams of furfuryl alcohol, and 762 grams of mineral oil is heated with stirring at 100° C. for one hour, then mixed portionwise over a 15-minute period with 230 grams of barium oxide. During this latter period, the temperature exothermically rises to 120° C. The mixture then is heated to 150°–160° C. for one hour, and treated subsequently at this temperature for 1.5 hours with carbon dioxide. The material is concentrated by heating to a temperature of 150° C. and a pressure of 10 mm. Hg. and thereafter filtered to yield a clear, oil-soluble filtrate having the following analysis: sulfate ash content, 21.4%; and a metal ratio of 6.1.

EXAMPLE A-25

To a mixture of 1614 grams of a polyisobutenyl succinic anhydride (prepared by the reaction of a chlorinated polyisobutene having an average chlorine content of 4.3% by weight and an average of 67 carbon atoms with maleic anhydride at about 200° C.), 4313 grams of mineral oil, 345 grams of heptylphenol, and 200 grams of water, at 80° C., there is added 1038 grams of lithium hydroxide monohydrate over a period of 0.75 hour while heating to 105° C. 75 grams of isooctanol are added while the mixture is heated to 150° C. over a 1.5-hour period. The mixture is maintained at 150°–170° C. and blown with carbon dioxide at a rate of 4 cfh for 3.5 hours. The reaction mixture is filtered through a filter aid and the filtrate is the desired product having a sulfate ash content of 18.9% by weight and a metal ratio of 8.0.

EXAMPLE A-26

A mixture of 244 grams of oleic acid, 180 grams of primary isooctanol, and 400 grams of mineral oil is heated to 70° C. whereupon 172.6 grams of cadmium oxide is added. The mixture is heated for 3 hours at a temperature of 150°–160° C. while removing water. 324 grams of barium hydroxide monohydrate are added to the mixture over a period of one hour while continuing to remove water by means of a side-arm water trap. Carbon dioxide is blown through the mixture at a temperature of from 150°–160° C. until the mixture is slightly acidic to phenolphthalein. Upon completion of the carbonation, the mixture is stripped to a temperature of 150° C. at 35 mm. Hg. to remove substantially all the remaining water and alcohol. The residue is the desired overbased product containing both barium and cadmium metal.

EXAMPLE A-27

A sulfoxide is prepared by treating polyisobutylene (average molecular weight 750) with 47.5% of its weight of $SOCl_2$ for 4.5 hours at 220° C. A mixture of 787 grams of this sulfoxide, 124 grams of diisobutylphenol, 550 grams of mineral oil, and 200 grams of water are warmed to 70° C. and treated with 360 grams of barium oxide. This mixture is heated at reflux temperature for one hour and treated at 150° C. with carbon dioxide until the mixture is substantially neutral (phenolphthalein) and thereafter filtered to yield a clear, oil-soluble liquid having the following analysis: sulfate ash, 22.8%; and metal ratio, 5.8.

EXAMPLE A-28

To a mixture of 268 grams of oleyl alcohol, 675 grams of mineral oil, 124 grams of diisobutylphenol, and 146 grams of water, at 70° C. there is added 308 grams of barium oxide. This mixture is heated at reflux temperature for one hour, then at 150° C. carbon dioxide is bubbled therethrough until substantial neutrality (phenolphthalein) of the mixture is achieved. The resulting reaction mass is filtered resulting in a clear, brown, oil-soluble filtrate having the following analysis: sulfate ash content, 29.8%; and metal ratio, 6.0.

EXAMPLE A-29

A mixture of 423 grams of sperm oil, 124 grams of heptylphenol, 500 grams of mineral oil, and 150 grams of water is prepared. The temperature is adjusted to 70° C. 308 grams of barium oxide are added. This mixture is heated at reflux temperature for one hour, dried by heating at about 150° C. and thereafter carbonated by treatment with carbon dioxide at the same temperature until the reaction mass is slightly acidic (phenolphthalein). Filtration yields a clear, light brown, non-viscous overbased liquid material having the following analysis: sulfate ash content, 32%; and metal ratio, 6.5.

EXAMPLE A-30

To a mixture of 174 grams of N-octadecyl propylene diamine, 124 grams of diisobutylphenol, 766 grams of mineral oil, 146 grams of water, there is added 306 grams of barium oxide and the whole is refluxed for one hour. Water is subsequently removed by raising the temperature to 150° C. and thereafter carbon dioxide is bubbled therethrough while maintaining this temperature. When the reaction mass is substantially neutral (phenolphthalein), carbon dioxide addition is ceased and the reaction mass filtered producing a clear, oil-soluble liquid having the following analysis: sulfate ash content, 28.9%; and metal ratio, 5.8.

EXAMPLE A-31

A mixture of 6000 grams of a 30% by weight oil solution of barium petroleum sulfonate (sulfate ash 7.6%), 348 grams of paratertiary butylphenol, and 2911 grams of water is heated to a temperature of 60° C. 1100 grams of barium oxide are added while raising the temperature to 94°–98° C. The temperature is held within this range for about one hour and then slowly raised over a period of 7.5 hours to 150° C. and held at this level for an additional hour assuring substantial removal of all water. The resulting overbased material is a brown liquid having the following analysis: sulfate ash content, 26%; metal ratio, 4.35. This product is then blown with $SO_2$ until 327 grams of the $SO_2$ is combined with the overbased material. The product thus obtained has a neutralization number of zero. The $SO_2$-treated material is a brown liquid. 1000 grams of the $SO_2$-treated overbased material are mixed with 286 grams of water and heated to a temperature of about 60° C. Subsequently, 107.5 grams of barium oxide are added slowly and the temperature is maintained at 94°–98° C. for one hour. Then the total reaction mass is heated to 150° C. over a period of about one hour and held there for an addition period of one hour. The resulting overbased material is purified by filtration, the filtrate being the brown, liquid overbased material having the following analysis: sulfate ash content, 33.7%; and metal ratio, 6.3.

EXAMPLE A-32

A polyisobutylene having a molecular weight of 700–800 is prepared by the aluminum chloride-catalyzed polymerization of isobutylene at 0°–30° C., is nitrated with a 10% excess of 70% aqueous nitric acid at 70°–75° C. for 4 hours. The volatile components of the product mixture are removed by heating to 75° C. at a pressure of 75 mm of mercury. To a mixture of 151 grams of this nitrated polyisobutylene, 113 grams of heptylphenol, 155 grams of water, and 2057 grams of mineral oil at 70° C. there is added 612 grams of barium oxide. This mixture is heated at 150° C. for an hour, then treated with carbon dioxide at this same temperature until the mixture is neutral (phenolphthalein indicator; ASTM D-974-53T procedure at 25° C.). The product mixture is filtered and filtrate found to have the following analysis: sulfate ash content, 27.6%; percent N, 0.06; and metal ratio, 9.

EXAMPLE A-33

A mixture of 630 grams of a rosin amine (consisting essentially of dehydroabietyl amine) having a nitrogen content of 44% and 245 grams of heptylphenol having a hydroxyl content of 8.3% is heated to 90° C. and thereafter mixed with 230 grams of barium oxide at 90°–140° C. The mixture is purged with nitrogen at 140° C. A 600 gram portion is diluted with 400 grams of mineral oil and filtered. The filtrate is blown with carbon dioxide, diluted with benzene, heated to remove the benzene, mixed with xylene, and filtered. The filtrate, a 20% xylene solution of the product has a barium sulfate ash content of 25.1%, a nitrogen content of 2%, and a reflux base number of 119. (The basicity of the metal composition is expressed in terms of milligrams of KOH which are equivalent to one gram of the composition.) For convenience, the basicity thus determined is referred to as a "reflux base number".

EXAMPLE A-34

An amine-aldehyde condensation product is obtained as follows: 420 grams of formaldehyde are added in small increments to a mixture comprising 1392 grams of N-octadecylpropylenediamine, 300 grams of mineral oil, 200 grams of water, and 42 grams of calcium hydroxide at the reflux temperature, i.e., 100°–105° C. The rate of addition of formaldehyde is such as to avoid excessive foaming. The mixture is heated at reflux temperature for one hour, slowly heated to 155° C., and blown with nitrogen at 150°–155° C. for 2 hours to remove all volatile components. It is then filtered. The filtrate is a 65.4% by weight oil solution of the amine-aldehyde condensation product having a nitrogen content of 2.4%.

1850 grams of this filtrate are mixed with 185 grams of heptylphenol 1485 grams of mineral oil, and 1060 grams of 90% pure barium oxide and heated to 70° C. Over a period of one hour, 500 grams of water are added while maintaining the temperature in the range of 70°–100° C. The mixture is heated at 110°–115° C. for 4.7 hours and thereafter to 150° C. While maintaining the temperature within the range of 140°–150° C., the reaction mixture is carbonated and subsequently filtered. The filtrate is a 57.8% by weight oil solution of the overbased amine-aldehyde condensation product having a nitrogen content of 0.87% and a barium sulfate ash content of 29.5%.

EXAMPLE A-35

A mixture of 5846 grams of a neutral calcium sulfonate oil solution having a calcium sulfate ash content of 4.68% (66% by weight mineral oil), 464 grams of heptylphenol, and 3.4 grams of water is heated to 80° C. 1480 grams of barium oxide are added over a period of 0.6 hour. The reaction is exothermic and the temperature of the reaction mixture reaches 100° C. The mixture is heated to 150° C. and carbonated at this temperature. During the carbonation, 24 grams of barium chloride are added to the mixture. Oil is removed from the reaction mixture during the carbonation procedure. Carbonation is continued at this temperature until the mixture has a base number (phenolphthalein) of 80. 164 grams of octyl alcohol and a filter aid are added to the mixture and the mixture is filtered while hot. The filtrate is the desired overbased barium sulfonate having a barium sulfate ash content of 26.42%, a metal ratio of 4.6 and a reflux base number of 104.

EXAMPLE A-36

A mixture of 1000 grams of a polyisobutene having a molecular weight of 1000 and 90 grams of phosphorus pentasulfide is prepared at room temperature, heated to 260° C. over 5 hours, and maintained at this temperature for an additional hours. The resulting hydrolyzed acid has a phosphorus content of 2.4% by weight and a sulfur content of 2.8% by weight. In a separate vessel, a mixture of oil and barium hydroxide is prepared by mixing 2200 grams of a mineral oil and 1150 grams of barium oxide at 88° C. and blowing the mixture with steam for 3 hours at 150° C. To this mixture there is added portionwise throughout a period of 3 hours, 1060 grams of the above hydrolyzed acid while maintaining the temperature at 145°–150° C., and then 360 grams of heptylphenol are added over a 1.5-hour period. The resulting mixture is blown with carbon dioxide at the rate of 100 grams per hour for 3 hours at 150°–157° C. The carbonated product is mixed with 850 grams of a mineral oil and dried by blowing it with nitrogen at a temperature of 150° C. The product is filtered and the filtrate is diluted with mineral oil to a solution having a barium sulfate ash content of 25%. The final solution has a phosphorus content of 0.48%, a reflux base number of 109, and a metal ratio of 7.2.

EXAMPLE A-37

(a) To a mixture of 268 grams of oleyl alcohol, 124 grams of heptylphenol, 988 grams of mineral, and 160 grams of water there is added 168 grams of lithium hydroxide monohydrate. The mixture is heated at reflux temperature for an hour and then carbonated at 150° C. until it is substantially neutral. The filtration of this carbonated mixture yields a liquid having a lithium sulfate content of 12.7%.

(b) To a mixture of 1614 grams of a polyisobutenyl succinic anhydride prepared by the reaction of a chlorinated polyisobutene having an average chlorine content of 4.3% and an average of 67 carbon atoms with maleic anhydride at about 200° C., 4313 grams of mineral oil, 345 grams of heptylphenol, and 200 grams of water, at 80° C., there is added 1038 grams of lithium hydroxide monohydrate over a period of 0.75 hour while heating to 105° C. 75 grams of isooctanol are added while the mixture is heated to 150° C. in about 1.5 hours. The mixture is maintained at 150°–170° C. and blown with carbon dioxide at the rate of 4 cfh for 3.5 hours. The reaction mixture is filtered through a filter aid and the filtrate is the desired product having a sulfate ash content of 18.9% and a metal ratio of 8.

EXAMPLE A-38

A thiophosphorus acid is prepared as set forth in Example A-36 above. A mixture of 890 grams of this acid, 2945 grams of mineral oil, 445 grams of heptylphenol, and 874 grams of lithium hydroxide monohydrate formed by adding the metal base to the mineral oil solution of the acid and the heptylphenol over a 1.5-hour period while maintaining the temperature at 100°–110° C. Thereafter the mixture is dried at 150° C. for 2 hours. Carbon dioxide is bubbled therethrough at the rate of 4 cfh until the reaction mixture is slightly acidic to phenolphthalein, about 3.5 hours, while maintaining the temperature within the range of 150°–160° C. The reaction mixture is then filtered twice through a diatomaceous earth filter. The filtrate is the desired lithium overbased thiophosphorus acid material having a metal ratio of 6.3.

EXAMPLE A-39

(a) A reaction mixture of 2442 grams of strontium petrosulfonate, 3117 grams of mineral oil, 150 grams of isooctanol, and 910 grams of methanol is heated to 55° C. Thereafter 615 grams of strontium oxide are added over a 10-minute period while maintaining the temperature at 55°–65° C. The mixture is heated an additional hour at this same temperature range and thereafter blown with carbon dioxide at a rate of 4 cfh for about 3 hours until the reaction mixture is slightly acidic to phenolphthalein. Thereafter, the reaction mixture is heated to 160° C. and held there for about one hour while blowing the nitrogen at 5 cfh. Thereafter, the product is filtered, the filtrate being the desired overbased material having a metal ratio of 3.8.

(b) To a mixture of 3800 grams of a 50% by weight mineral oil solution of lithium petroleum sulfonate (sulfate ash of 6.27%), 460 grams of heptylphenol, 1920 grams of mineral oil, and 300 grams of water at 70° C., there is added 1216 grams of lithium hydroxide monohydrate over a period of 0.25 hour. This mixture is stirred at 110° C. for one hour, heated to 150° C. over a 2.5-hour period, and blown with carbon dioxide at the rate of 4 cfh over a period of about 3.5 hours until the reaction mixture is substantially neutral. The mixture is filtered and the filtrate is the desired product having a sulfate ash content of 25.23% and a metal ratio of 7.2.

EXAMPLE A-40

A mixture of 406 grams of naphtha and 214 grams of amyl alcohol is heated to 38° C. with stirring. 27 grams of barium oxide are added. Then 27 grams of water are added slowly and the temperature rises to 45° C. Stirring is maintained while slowly adding over 0.25 hours 73 grams of oleic acid. The mixture is heated to 95° C. with continued mixing. Heating is discontinued and 523 grams of barium oxide are slowly added to the mixture. The temperature rises to about 115° C. and the mixture is permitted to cool to 90° C. whereupon 67 grams of water are slowly added to the mixture and the temperature rises to 107° C. The mixture is then heated within the range of 107°–120° C. to remove water over a 3.3-hour period while bubbling nitrogen through the mass. Subsequently, 427 grams of oleic acid are added over a 1.3-hour period while maintaining a temperature at 120°–125° C. Thereafter heating is terminated and 236 grams of naphtha are added. Carbonation is commenced by bubbling carbon dioxide through the mass at 2 cfh for 1.5 hours while maintaining the temperature at 108°–117° C. The mixture is heated under a nitrogen purge to remove water. The reaction mixture is filtered twice producing a filtrate analyzing as follows: sulfate ash content, 34.42%, and metal ratio, 3.3.

EXAMPLE A-41

A reaction mixture of 1800 grams of a calcium overbased petrosulfonic acid containing 21.7% by weight mineral oil, 36.14% by weight naphtha, 426 grams naphtha, 255 grams of methanol, and 127 grams of an equal molar amount of isobutanol and amyl alcohol are heated to 45° C. under reflux conditions. 148 grams of Mississippi lime (commercial calcium hydroxide) are added. The reaction mass is then blown with carbon dioxide at the rate of 2 cfh and thereafter 148 grams of additional Mississippi lime are added. Carbonation is continued for another hour at the same rate. Two additional 147 gram increments of Mississippi lime are added to the reaction mixture, each increment followed by about a one-hour carbonation process. Thereafter, the reaction mass is heated to a temperature of 138° C. while bubbling nitrogen therethrough to remove water and methanol. After filtration, 2220 grams of a solution of the barium overbased petrosulfonic acid is obtained having a metal ratio of 12.2.

EXAMPLE A-42

A mixture of 1122 grams of polyisobutenyl (number average Mw=950) succinic anhydride, 1122 grams of xylene and 2000 grams of blend oil is heated to 80 ° C. with stirring. 580 grams of sodium hydroxide are added over a ten-minute period. The reaction mixture is heated to 120° C. over a period of 1.3 hours. The reaction mixture is heated under reflux conditions for 6 hours during which time the temperature rises to 150° C. and 300 ml of water distillate are collected. The reaction mixture is cooled to room temperature and maintained at that temperature for 16 hours. The reaction mixture is heated to 77° C. and 540 grams of sodium hydroxide are added. The reaction mixture is heated to 140° C. over a period of 1.7 hours resulting in the removal of 150 ml of water at reflux conditions. The reaction mixture is blown with $CO_2$ for 5 hours with azeotropic removal of 150 ml of water. The reaction mixture is cooled to room temperature and maintained at that temperature for 16 hours. The reaction mixture is heated to 77° C. and 560 grams of sodium hydroxide are added. The reaction mixture is heated to 140° C. over a period of 1.7 hours resulting in the removal of 150 ml of water at reflux conditions. The reaction mixture is blown with $CO_2$ for 5 hours with azeotropic removal of 150 ml of water. The reaction mixture is cooled to room temperature and maintained at that temperature for 16 hours. The reaction mixture is heated to 77° C. and 640 grams of sodium hydroxide are added. The reaction mixture is heated to 140° C. over a period of 1.7 hours resulting in the removal of 150 ml of water at reflux conditions. The reaction mixture is blown with $CO_2$ for 5 hours with azeotropic removal of 150 ml of water. The reaction mixture is cooled to room temperature and maintained at that temperature for 16 hours. The reaction mixture is heated to 77° C. and 560 grams of sodium hydroxide are added. The reaction mixture is heated to 140° C. over a period of 1.7 hours resulting in the removal of 150 ml of water at reflux conditions. The reaction mixture is blown with $CO_2$ for 5 hours with azeotropic removal of 150 ml of water. The reaction mixture is cooled to room temperature and maintained at that temperature for 16 hours. 1000 grams of diluent oil are added. The reaction mixture is stripped to 115° C. at a pressure of 30 mm Hg. 200 grams of diatomaceous earth filter aid are added to the reaction mixture. The reaction mixture is filtered on a preformed 80-gram filter aid over a period of 15 hours. The resulting product sulfate ash content of 43.4% by weight, a base number (bromophenol blue) of 361, and a specific gravity of 1.11.

EXAMPLE A-43

A mixture of 794.5 Kg of polyisobutenyl (number average Mw=950) succinic anhydride, 994.3 Kg of SC-100 Solvent (a product of Ohio Solvents identified as an aromatic hydrocarbon solvent), 858.1 Kg of blend oil, 72.6 Kg of propylene tetramer phenol, 154.4 Kg of water, 113.5 grams of a kerosene solution of Dow Corning 200 having a viscosity 1000 cSt at 25° C., and 454 grams of caustic soda flake is prepared at room temperature. The reaction mixture exotherms by 10° C. The reaction mixture is heated with stirring under reflux conditions to 137.8° C. over a period of 1.5 hours. The reaction mixture is blown with $CO_2$ at a rate of 45.4 Kg per hour for 5.9 hours. The reaction mixture is cooled to 82.2° C. 146.2 Kg of aqueous distillate are removed from the reaction mixture, and 429 Kg of organic distillate are added back to the reaction mixture. The reaction mixture is heated to 138° C. and 454 Kg of caustic soda are added. The reaction mixture is blown with $CO_2$ at a rate of 45.4 Kg per hour for 5.9 hours while maintaining the temperature at 135°–141° C. The reaction mixture is heated to 149° C. and maintained at that temperature until distillation ceases. 149.4 Kg of aqueous distillate and 487.6 Kg of organic distillate are removed over a 5-hour period. The reaction mixture is flash stripped to 160° C. at a pressure of 70 mm Hg absolute. 32.7 Kg of aqueous distillate and 500.3 Kg of organic distillate are removed from the reaction mixture. 858.1 Kg of blend oil are added. 68.1 Kg of diatomaceous earth filter aid are added to the reaction mixture. The reaction mixture is filtered to provide the desired product. The resulting product has a sulfate ash content of 38.99% by weight, a sodium content of 12.63% by weight, a $CO_2$ content of 12.0% by weight, a base number (bromophenol blue) of 320, a viscosity of 94.8 cSt at 100° C., and a specific gravity of 1.06.

EXAMPLE A-44

A mixture of 1000 grams of the product from Example A-1, 0.13 gram of an antifoaming agent (kerosene solution of Dow Corning 200 Fluid having a viscosity of 1000 cSt at 25° C.) , and 133 grams of blend oil is heated to 74°–79° C. with stirring. 486 grams of boric acid are added. The reaction mixture is heated to 121° C. to liberate water of reaction and 40–50% by weight of the $CO_2$ contained in the product from Example A-1. The reaction mixture is heated to 154°–160° C. and maintained at that temperature until the free and total water contents are reduced to 0.3% by weight or less and approximately 1–2% by weight, respectively. The reaction product is cooled to room temperature and filtered.

EXAMPLE A-45

A mixture of 1000 grams of the product from Example A-3 and 181 grams of diluent oil is heated to 79° C. 300 grams of boric acid are added and the reaction mixture is heated to 124° C. over a period of 8 hours. The reaction mixture is maintained at 121°–127° C. for 2–3 hours until the magnesium content remains constant at 6.85% by weight. A nitrogen sparge is started and the reaction mixture is heated to 149° C. to remove water until the water content is 3% by weight or less. The reaction mixture is filtered to provide the desired product.

EXAMPLE A-46

A mixture of 68 grams of propylene tetramer phenol, 374 grams of a 100 solvent neutral blend oil, 561 grams of an oil solution of sodium petroleum sulfonate having an oil content of 40% by weight, and 99 grams of polyisobutenyl (number average Mw=950) substituted succinic anhydride is prepared. 306 grams of caustic soda beads are added to the mixture with stirring. The reaction mixture is heated to 156° C. under nitrogen at a flow rate of 0.5 cfh. The mixture is blown with $CO_2$ at a rate of 0.7 cfh for 4.5 hours. A simultaneous nitrogen sweep at a rate of 0.5 cfh is used to remove accumulated water of reaction. The batch is maintained at 156° C. for 0.5 hours while maintaining a nitrogen sweep at a rate of 0.5 cfh. The mixture is cooled to 50° C.

305 grams of caustic soda beads are added to the reaction mixture. The mixture is heated to 156° C. with stirring and a nitrogen sweep at 0.5 cfh. The reaction mixture is blown with $CO_2$ at a rate of 0.6 cfh for 5 hours. A simultaneous nitrogen sweep at a rate of 0.5 cfh is used during the carbonation step. The mixture is vacuum stripped to a temperature of 160° C. at 20 mm/Hg to remove the remainder of the water of reaction. The mixture is filtered using 190 grams of a diatomaceous filter aid to provide 1343 grams of product. The product has a total base number of 435, a specific gravity at 15.6° C. of 1.258, and a kinematic viscosity at 100° C. of 85.09.

The above examples illustrate various means for preparing overbased products (A) or boron-containing overbased products (A') suitable for conversion to the sulfurized overbased products of the present invention. It is within the skill of the art to vary these examples to produce any desired overbased material. Thus, other acidic materials (A)(V) such as mentioned hereinbefore (particularly $SO_2$) can be substituted for the $CO_2$ used in the above examples. Similarly, other metal bases (A)(III) can be employed in lieu of the metal base used in any given example. Or mixtures of bases and/or mixtures of materials which can be overbased can be utilized. Similarly, the amount of mineral oil or other nonpolar, inert, organic liquid used as the overbasing or reaction medium (A)(II) can be varied widely both during overbasing and in the overbased product.

Displacement of Acidic Material (A)(V) With $SO_2$ or a Source of $SO_2$:

In one embodiment, the acidic material (A)(V) used in the preparation of the overbased product (A) or boron-containing overbased product (A') is $SO_2$ or a source of $SO_2$, and in this embodiment the overbased product is sulfurized subsequent to its production using the sulfur or sulfur source (B), as discussed below, to form the sulfurized overbased product of the invention. In other embodiments, however, the acidic material (A)(V) is other than $SO_2$ or a source of $SO_2$ (that is, the acidic material is $CO_2$, carbamic acid, acetic acid, formic acid, boric acid, trinitromethane, etc.), and in these embodiments the overbased product (A) or boron-containing overbased product (A') is contacted with an effective amount of $SO_2$ or a source of $SO_2$ for an effective period of time to displace at least part of the acidic material (A)(V) from the overbased product prior to or during sulfurization with the sulfur or sulfur source (B).

The contacting of the overbased product (A) or boron-containing overbased product (A') with the $SO_2$ or source of $SO_2$ is preferably effected using standard gas-liquid contacting techniques (e.g., blowing, sparging, etc.). In one embodiment, $SO_2$ flow rates of about 0.1 to about 100 cfh, preferably about 0.1 to about 20 cfh, more preferably about 0.1 to about 10 cfh, more preferably about 0.1 to about 5 cfh, can be used. Contacting of the overbased product with the $SO_2$ or source of $SO_2$ is continued until a desired amount of the acidic material has been displaced by the $SO_2$ or source of $SO_2$. Generally, it is preferred to effect a complete or substantially complete displacement of the acidic material with the $SO_2$ or source of $SO_2$. However the weight ratio of non-displaced acidic material to displaced acidic material can range up to about 20:1, and in some instances can be from about 20:1 to about 1:20, and often about 1:1 to about 1:20. Techniques known to those skilled in the art such as infrared spectral analysis, base number measurement, etc., can be used to determine the progress of the reaction and the desired end point.

The sources of $SO_2$ include the oxo acids of sulfur. These include sulfurous acid, thiosulfuric acid and dithionous acid.

The temperature of the reaction can be from about room temperature up to the decomposition temperature of the reactants or desired product having the lowest such temperature, and is preferably in the range of about 70° C. to about 250° C., with the ranges of about 100° C. to about 200° C. and about 120° C. to about 170° C. being useful.

The time of the reaction is dependent upon the desired extent of displacement. The reaction can be conducted over a period of about 0.1 to about 50 hours, and often is conducted over a period of about 3 to about 18 hours.

As indicated above, displacement of the acidic material with the or source of $SO_2$ can be effected prior to or during the sulfurization of the overbased product with the sulfur or sulfur source (B). When displacement of the acidic material with the $SO_2$ or source of $SO_2$ is effected simultaneously with the sulfurization of the overbased product with the sulfur or sulfur source (B), unexpected rapid rates of formation of desired thiosulfate products have been observed.

The following Examples A-47 to A-50 are provided to illustrate procedures for displacing acidic material (A)(V) from the overbased product with $SO_2$ or a source of $SO_2$.

EXAMPLE A-47

1610 grams (12.6 equivalents) of the product from Example A-1 are blown with 403 grams (12.6 equivalents) of $SO_2$ over an 8-hour period at a temperature of 135°–155° C. and a flow rate of 0.5–2 cfh. The $CO_2$ level in the resulting product is 1.47% by weight. The total base number (bromophenol blue) is 218. The sulfur content is 12.1% by weight and the sodium content is 17.6% by weight.

EXAMPLE A-48

3000 grams (23.5 equivalents) of the product from Example A-1 are blown with 376 grams (11.75 equivalents) of $SO_2$ at a temperature of 140°–150° C. and a flow rate of 1.4 cfh for 8 hours. The resulting product is stored at room temperature for 16 hours under a nitrogen blanket and then filtered using diatomaceous earth. The product has a sulfur content of 8.2% by weight and a sodium content of 18.2% by weight.

EXAMPLE A-49

1750 grams (10.0 equivalents) of the product from Example A-44 are blown with 320 grams (10.0 equivalents) of $SO_2$ at a temperature of 130° C. and a flow rate of 1.0 cfh for 15.5 hours. The resulting product is filtered using diatomaceous earth. The product has a sulfur content of 7.26% by weight, a sodium content of 12.6% by weight, and a boron content of 6.06% by weight.

EXAMPLE A-50

3480 grams (20 equivalents) of the product from Example A-43 are blown with 640 grams (20 equivalents) of $SO_2$ over an 15-hour period at a temperature of 140° C. and a flow rate of 1.35 cfh. The reaction mixture is then blown with nitrogen for 0.5 hour. The mixture is filtered using diatomaceous earth to provide 3570 grams of the desired product. The sulfur content is 8.52% by weight and the sodium content is 13.25% by weight.

Sulfur or Sulfur Source (B):

Component (B) can be elemental sulfur and/or at least one sulfur source. The sulfur source can be any of a variety of materials which are capable of supplying sulfur to the reaction. Examples of useful sulfur sources include sulfur halides, combinations of sulfur or sulfur oxides with hydrogen sulfide, and various sulfurized organic compounds as described below. Elemental sulfur is a readily available, useful and reactive sulfur source. The sulfur halides which are useful include sulfur monochloride, sulfur dichloride, etc. Combinations of sulfur and sulfur oxides (such as sulfur dioxide), with hydrogen sulfide also are useful sulfur sources.

In one embodiment, the sulfur source is one or more of the sulfur-coupled compounds described above under the subtitle "Sulfur-Coupled Functionally Substituted Organic Compounds (A)(I)(f)". A useful sulfur source is 2,2'-dithiodiisobutyraldehyde.

The sulfur source can be at least one phosphorus sulfide. Examples include $P_2S_5$, $P_4S_7$, $P_4S_3$ and $P_2S_3$.

The sulfurized organic compounds utilized as the sulfur source (B) in preparing the inventive sulfurized overbased products may be aromatic and alkyl sulfides such as dibenzyl sulfide, dixylyl sulfide, dicetyl sulfide, diparaffin wax sulfide and polysulfide, cracked wax oleum sulfides, etc. One method of preparing the aromatic and alkyl sulfides includes the condensation of a chlorinated hydrocarbon with an inorganic sulfide whereby the chlorine atom from each of two molecules is displaced, and the free valence from each molecule is joined to a divalent sulfur atom. Generally, the reaction is conducted in the presence of elemental sulfur.

Examples of dialkenyl sulfides which are useful in preparing the inventive sulfurized overbased products of the present invention are described in U.S. Pat. No. 2,446,072. These sulfides can be prepared by interacting an olefinic hydrocarbon containing from 3 to 12 carbon atoms with elemental sulfur in the presence of zinc or a similar metal generally in the form of an acid salt. Examples of sulfides of this type include 6,6'-dithiobis(5-methyl-4-nonene), 2-butenyl monosulfide and disulfide, and 2-methyl-2-butenyl monosulfide and disulfide.

The sulfurized olefins which are useful as a sulfur source include sulfurized olefins prepared by the reaction of an olefin (preferably containing 3 to 6 carbon atoms) or a lower molecular weight polyolefin derived therefrom, with a sulfur-containing compound such as sulfur, sulfur monochloride and/or sulfur dichloride, hydrogen sulfide, etc.

The sulfurized organic compounds may be sulfurized oils which may be prepared by treating natural or synthetic oils including mineral oils, lard oil, carboxylic acid esters derived from aliphatic alcohols and fatty acids or aliphatic carboxylic acids (e.g., myristyl oleate and oleyl oleate), sperm whale oil and synthetic sperm whale oil substitutes, and synthetic unsaturated esters or glycerides. Stable sulfurized mineral lubricating oils can be obtained by heating a suitable mineral lubricating oil with from about 1 to about 5% of sulfur at a temperature above about 175° C. and preferably at about 200° C. to about 260° C. for several hours so as to obtain a reaction product which is substantially non-corrosive to copper. The mineral lubricating oils sulfurized in this manner may be distillate or residual oils obtained from paraffinic, naphthenic or mixed base crudes. Similarly, sulfurized fatty oils such as a sulfurized lard oil can be obtained by heating lard oil with about 10 to 15% of sulfur at a temperature of about 150° C. for a time sufficient to obtain a homogeneous product.

The sulfurized fatty acid esters useful as sulfur sources can be prepared by reacting sulfur, sulfur monochloride, and/or sulfur dichloride with an unsaturated fatty ester at elevated temperatures. Typical esters include $C_1$–$C_{20}$ alkyl esters of $C_8$–$C_{24}$ unsaturated fatty acids such as palmitoleic, oleic, ricinoleic, petroselic, vaccenic, linoleic, linolenic, oleostearic, licanic, etc. Sulfurized fatty acid esters prepared from mixed unsaturated fatty acid esters such as are obtained from animal fats and vegetable oils such as tall oil, linseed oil, olive oil, castor oil, peanut oil, rape oil, fish oil, sperm oil, etc also are useful. Specific examples of the fatty esters which can be sulfurized include methyl oleate, ethyl oleate, lauryl oleate, cetyl oleate, cetyl linoleate, lauryl ricinoleate, oleyl linoleate, oleyl stearate, and alkyl glycerides.

Another class of organic sulfur-containing compounds which can be used as a sulfur source includes sulfurized aliphatic esters of an olefinic mono- or dicarboxylic acid. For example, aliphatic alcohols of from 1 to 30 carbon atoms can be used to esterify monocarboxylic acids such as acrylic acid, methacrylic acid, 2,4-pentadienic acid, etc. or fumaric acid, maleic acid, muconic acid, etc. Sulfurization of these esters is conducted with elemental sulfur, sulfur monochloride and/or sulfur dichloride.

Another class of sulfurized organic compounds are diestersulfides characterized by the following general formula $$S_y((CH_2)_xCOOR)_2$$

wherein x is a number in the range of about 2 to about 5; y is a number in the range of 1 to about 6, preferably 1 to about 3; and R is an alkyl group having from about 4 to about 20 carbon atoms. The R group may be a straight chain or branched chain group that is large enough to maintain the solubility of the compositions of the invention in oil. Typical diesters include the butyl, amyl, hexyl, heptyl, octyl, nonyl, decyl, tridecyl, myristyl, pentadecyl, cetyl, heptadecyl, stearyl, lauryl, and eicosyl diesters of thiodialkanoic acids such as propionic, butanoic, pentanoic and hexanoic acids. Of the diester sulfides, a specific example is dilauryl 3,3'-thiodipropionate.

Sulfurized Olefins Useful as the Sulfur Source (B):

In one embodiment, the sulfur source (B) is at least one sulfurized olefin. These include the organic polysulfides which can be prepared by the sulfochlorination of olefins containing four or more carbon atoms and further treatment with inorganic higher polysulfides according to U.S. Pat. No. 2,708,199, the teachings of which are hereby incorporated by reference.

In one embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to 5 carbon atoms and examples include ethylene, propylene, butylene, isobutylene, amylene, etc. Briefly, in the first step, sulfur monochloride is reacted with from one to two moles of the olefin per mole of the sulfur monochloride, and the reaction is conducted by mixing the reactants at a temperature of from about 20° C. to 80° C. In the second step, the product of the first step is reacted with an alkali metal, preferably sodium sulfide, and sulfur. The mixture consists of up to about 2.2 moles of the metal sulfide per gram atom of sulfur, and the mole ratio of alkali metal sulfide to the product of the first step is about 0.8 to about 1.2 moles of metal sulfide per mole of step (1) product. Generally, the second step is conducted in the presence of an alcohol or an alcohol-water solvent under reflux conditions. The third step of the process is the reaction between the phosphosulfurized olefin which contains from about 1 to about 3% of chlorine with an inorganic base in a water solution. Alkali metal hydroxide such as sodium hydroxide may be used. The reaction is continued until the chlorine content is reduced to below 0.5%, and this reaction is conducted at under reflux conditions for a period of from about 1 to 24 hours.

The sulfurized olefins which are useful in the compositions of the present invention also may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. No. 4,191,659, the disclosure of which is hereby incorporated by reference for its description of the preparation of useful sulfurized compositions. An optional final step described in this patent is the removal of active sulfur by, for example, treatment with an alkali metal sulfide.

The olefinic compounds which may be sulfurized by this method and used as a sulfur source are diverse in nature. They contain at least one olefinic double bond, which is defined as a non-aromatic double bond; that is, one connecting two aliphatic carbon atoms. In its broadest sense, the olefin may be defined by the formula $$R^1R^2C{=}CR^3R^4$$

wherein each of $R^1$, $R^2$, $R^3$ and $R^4$ is hydrogen or an organic group. In general, the R groups in the above formula which are not hydrogen may be satisfied by such groups as $-C(R^5)_3$, $-COOR^5$, $-CON(R^5)_2$, $-COON(R^5)_4$, —COOM, —CN, —X, $-YR^5$ or —Ar, wherein:

each $R^5$ is independently hydrogen, alkyl, alkenyl, aryl, substituted alkyl, substituted alkenyl or substituted aryl, with the proviso that any two $R^5$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^1$, $R^2$, $R^3$ and $R^4$ may also together form an alkylene or substituted alkylene group; i.e., the olefinic compound may be alicyclic.

The natures of the substituents in the substituted moieties described above are not normally critical and any such substituent is useful so long as it is or can be made compatible with lubricating environments and does not interfere under the contemplated reaction conditions. Thus, substituted compounds which are so unstable as to deleteriously decompose under the reaction conditions employed are not contemplated. However, certain substituents such as keto or aldehydo can desirably undergo sulfurization. The selection of suitable substituents is within the skill of the art or may be established through routine testing. Typical of such substituents include any of the above-listed moieties as well as hydroxy, amidine, amino, sulfonyl, sulfinyl, sulfonate, nitro, phosphate, phosphite, alkali metal mercapto and the like.

The olefinic compound is usually one in which each R group which is not hydrogen is independently alkyl, alkenyl or aryl, or (less often) a corresponding substituted group. Monoolefinic and diolefinic compounds, particularly the former, are preferred, and especially terminal monoolefinic hydrocarbons; that is, those compounds in which $R^3$ and $R^4$ are hydrogen and $R^1$ and $R^2$ are alkyl or aryl, especially alkyl (that is, the olefin is aliphatic). Olefinic compounds having about 3 to 30 and especially about 3 to 16 (most often less than 9) carbon atoms are particularly desirable.

Isobutene, propylene and their dimers, trimers and tetrimers, and mixtures thereof are especially preferred olefinic compounds. Of these compounds, isobutylene and diisobutylene are particularly desirable because of their availability and the particularly high sulfur-containing compositions which can be prepared therefrom.

Commercial sources of sulfur and hydrogen sulfide are normally used for the purpose of this sulfurization reaction, and impurities normally associated therewith may be present without adverse results. Thus, commercial diisobutene is believed to contain essentially two isomeric forms and this mixture is contemplated for use according to the present invention.

The amounts of sulfur and hydrogen sulfide per mole of olefinic compound are, respectively, about 0.3–3.0 gram-atoms and about 0.1–1.5 moles. Useful ranges are about 0.5–2.0 gram-atoms and about 0.4–1.25 moles respectively. In batch operations, the reactants are introduced at levels to provide these ranges. In semi-continuous and continuous operations, they may be admixed at any ratio but on a mass balance basis, they are present so as to be consumed in amounts within these ratios. Thus, for example, if the reaction vessel is initially charged with sulfur alone, the olefinic compound and hydrogen sulfide are added incrementally at a rate such that the desired ratio is obtained.

The temperature range in which the sulfurization reaction is carded out is generally about 50°–350° C. The preferred range is about 100°–200° C., with about 125°–180° C. being especially suitable. The reaction is conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature, and the vapor pressure of the reactants and products and it may vary during the course of the reaction.

It is frequently advantageous to incorporate materials useful as sulfurization catalysts in the reaction mixture. These materials may be acidic, basic or neutral. Useful neutral and acidic materials include acidified clays such as "Super Filtrol", p-toluenesulfonic acid, dialkylphosphorodithioic acids, and phosphorus sulfides such as phosphorus pentasulfide.

The preferred catalysts are basic materials. These may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl groups are alkyl, aryl, aralkyl, alkaryl or the like and contain about 1–20 carbon atoms. Suitable amines include aniline, benzylamine, dibenzylamine, dodecylamine, morpholine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine and quinoline.

The amount of catalytic material used is generally about 0.05–2.0% of the weight of the olefinic compound. In the case of the preferred ammonia and amine catalysts, about 0.0005–0.5 mole per mole of olefin is preferred, and about 0.001–0.1 mole is especially desirable.

Also present in the reaction mixture may be water, either as a catalyst or as a diluent for one or more of the catalysts recited hereinabove. The amount of water, when present, is usually about 1–25% by weight of the olefinic compound. The presence of water is, however, not essential and when certain types of reaction equipment are used it may be advantageous to conduct the reaction under substantially anhydrous conditions.

The method is usually carried out in the absence of solvents and diluents other than water. However, it may sometimes be desirable to use a substantially inert, normally liquid organic diluent in the reaction. The nature of suitable diluents will readily be apparent to those skilled in the art.

The time required for the reaction to be completed will vary depending on the reagents, ratios thereof, the reaction temperature, the presence or absence of catalysts, and the purity of the reagents. The course of the reaction is conveniently followed by monitoring the pressure in the reaction vessel; the reaction can be considered complete when the pressure levels off to a constant value.

Following the preparation of the sulfurized mixture by the procedure described hereinabove, substantially all low boiling materials are removed. The nature of these low boiling materials will vary according to the amount and type of reactants used and the reaction conditions. It will also vary to some extent according to the use to which the sulfurized product is to be put, as well as such things as odor and flammability considerations, recycling needs of reactants and by-products, and the like. Most often, the product should have a flash point above about 30° C., preferably about 70° C. and desirably above about 100° C. as determined by ASTM Procedure D93. Reference is also made to ASTM Procedures D56 and D 13 10.

In addition to starting materials such as the olefinic compound, the low boiling materials will often include mercaptans and monosulfides, especially when the starting olefin contains less than 9 carbon atoms, and under these circumstances it is preferred that the product contain no more than about 5% by weight of such starting materials, mercaptans and monosulfides. If these materials are gaseous at ambient pressure and temperature, they may be removed in part simply by venting the reaction vessel, and they may be recycled if desired. In the case of less volatile starting materials, it may be necessary to resort to such techniques as distillation at atmospheric pressure or vacuum distillation or stripping. Another useful method is the passage of an inert gas such as nitrogen through the mixture at a suitable temperature and pressure. Large-scale gas chromatography and molecular distillation may also be useful.

Any solids present in the reaction mixture may be conveniently removed, in most instances, by merely pouring off the liquid product. If further removal of solids is desired, such conventional techniques as filtration or centrifugation may be used.

The exact chemical nature of the sulfurized compositions prepared in this manner is not known with certainty, and it is most convenient to describe them in terms of the method for their preparation. It appears, however, that when prepared from olefins containing less than 9 and particularly less than 7 carbon atoms, they comprise principally disulfides, trisulfides and tetrasulfides. The sulfur content of these sulfurized compositions is usually about 2–60% by weight, preferably about 25–60% and most desirably about 40–50%.

The preparation of the sulfurized olefins is illustrated by the following Examples B-1 to B-4.

EXAMPLE B-1

526 grams of sulfur (16.4 moles) are charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 grams (16.4 moles) of isobutene and 279 grams (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% by weight sulfur.

EXAMPLE B-2

151 grams of sulfur are charged to a reactor similar to the one described in Example B-1. The sulfur is heated to 160° C. and the reactor is sealed and evacuated. 72 grams of hydrogen sulfide are added slowly to the reactor over a period of about 4.5 hours. Thereafter, 1.6 grams of the catalyst n-butylamine are added to the reactor after about 3.8 parts of hydrogen sulfide are added. 157 grams of isobutylene are added slowly to the reactor containing the sulfur, catalyst, and about 10 parts of hydrogen sulfide in such a manner that the rates of addition of isobutylene and hydrogen sulfide are such as to maintain 10% molar excess of hydrogen sulfide until all the hydrogen sulfide is added. The addition of the remainder of isobutylene is continued until the entire 157 grams are added. The temperature is maintained in the range of between 160°–171° C. throughout the foregoing additions and reactions with occasional cooling being necessary. The reaction is held for 5 hours at 171° C., then unreacted hydrogen sulfide and isobutylene are vented to a recovery system until the pressure in the vessel is reduced to atmospheric. Separation of low boiling materials from the reaction crude is accomplished by nitrogen blowing, then vacuum stripping. The residue is then filtered. The filtrate is the desired sulfurized composition containing 47% sulfur by weight.

EXAMPLE B-3

2025 grams of sulfur monochloride (15.0 moles) are heated to 45° C. Through a sub-surface gas sparger, 1468 grams (26.2 moles) of isobutylene gas are fed into the reactor over a 5-hour period. The temperature is maintained between 45°–50° C. At the end of the sparging, the reaction mixture increases in weight of 1352 grams.

In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is refluxed for 6 hours, and afterward the mixture is permitted to form into separate layers. The lower aqueous layer is discarded. The upper organic layer is mixed with two liters of 10% aqueous sodium hydroxide, and the mixture is refluxed for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 grams of a clear yellow-orange liquid.

EXAMPLE B-4

Into a reactor is charged 102.8 grams of sulfur chloride under a nitrogen atmosphere which is maintained throughout the reaction, and about 718.5 grams of gaseous isobutylene are fed into the reactor through a submerged line. The isobutylene is added as rapidly as possible while maintaining the maximum batch temperature at about 49° C. with a cooling water bath. After all of the isobutylene is added, the bath temperature decreases indicating completion of the reaction.

In a separate vessel, a mixture of 340.3 grams of an 18% sodium sulfide solution and 363.8 grams of a 50% aqueous solution of sodium hydroxide is prepared, and 128.77 grams of a 55.7% isopropyl alcohol and water mixture recovered from a previous batch are added. This addition is equivalent to 71 grams of dry isopropyl alcohol. The mixture is agitated, circulated and heated under reflux to a temperature of about 74° C. over a 2-hour period. While maintaining the batch temperature between about 75°–80° C., 168.13 grams of the isobutylene, sulfur chloride reaction product prepared above are added over a 5-hour period. The reaction mixture is maintained at about 80° C. and agitated for about 5 hours. The mixture then is cooled to about 38° C. and allowed to settle. The organic phase (138.7 grams) is separated from the aqueous phase and stripped of any remaining water and volatile materials. A filter aid is added to the residue with stirring, and the mixture then is filtered at about 50°–65° C. The filtrate is the desired product containing about 43% by weight sulfur.

SULFURIZED DIELS-ALDER ADDUCTS USEFUL AS THE SULFUR SOURCE (B)

In one embodiment, the sulfur source (B) is derived from a particular type of cyclic or bicyclic olefin which is a Diels-Alder adduct of at least one dienophile with at least one aliphatic conjugated diene. The sulfurized Diels-Alder adducts can be prepared by reacting various sulfurizing agents with the Diels-Alder adducts as described more fully below. Preferably, the sulfurizing agent is sulfur.

The Diels-Alder adducts are a well-known, art-recognized class of compounds prepared by the diene synthesis or Diels-Alder reaction. A summary of the prior art relating to this class of compounds is found in the Russian monograph, *Dienovyi Sintes*, Izdatelstwo Akademii Nauk SSSR, 1963 by A. S. Onischenko. (Translated into the English language by L. Mandel as A. S. Onischenko, *Diene Synthesis*, N.Y., Daniel Davey and Co., Inc., 1964.) This monograph and references cited therein are incorporated by reference into the present specification.

The adducts and processes of preparing the adducts are further exemplified by the following Examples B-5 to B-8.

EXAMPLE B-5

A mixture comprising 400 grams of toluene and 66.7 grams of aluminum chloride is charged to a two-liter flask fitted with a stirrer, nitrogen inlet tube, and a solid carbon dioxide-cooled reflux condenser. A second mixture comprising 640 grams (5 moles) of butyl acrylate and 240.8 grams of toluene is added to the $AlCl_3$ slurry while maintaining the temperature within the range of 37°–58° C. over a 0.25-hour period. Thereafter, 313 grams (5.8 moles) of butadiene is added to the slurry over a 2.75-hour period while maintaining the temperature of the reaction mass at 50°–61° C. by means of external cooling. The reaction mass is blown with nitrogen for about 0.33 hour and then transferred to a four-liter separatory funnel and washed with a solution of 150 grams of concentrated hydrochloric acid in 1100 grams of water. Thereafter, the product is subjected to two additional water washings using 1000 grams of water for each wash. The washed reaction product is subsequently distilled to remove unreacted butyl acrylate and toluene. The residue of this first distillation step is subjected to further distillation at a pressure of 9–10 millimeters of mercury whereupon 785 grams of the desired product is collected over the temperature of 105°–115° C.

EXAMPLE B-6

The adduct of isoprene and acrylonitrile is prepared by mixing 136 grams of isoprene, 106-grams of acrylonitrile, and 0.5 gram of hydroquinone (polymerization inhibitor) in a rocking autoclave and thereafter heating for 16 hours at a temperature within the range of 130°–140° C. The autoclave is vented and the contents decanted thereby producing 240 grams of a light yellow liquid. This liquid is stripped at a temperature of 90° C. and a pressure of 10 mm Hg. thereby yielding the desired liquid product as the residue.

EXAMPLE B-7

Using the procedure of Example B-6, 136 grams of isoprene, 172 grams of methyl acrylate, and 0.9 gram of hydroquinone are converted to the isoprene methyl acrylate adduct.

EXAMPLE B-8

The general procedure of Example B-6 is repeated except that only 270 grams (5 moles) of butadiene is included in the reaction mixture.

The sulfur-containing compounds are readily prepared by heating a mixture of a sulfurizing agent such as sulfur, and at least one of the Diels Alder adducts of the types discussed hereinabove at a temperature within the range of from about 110° C. to just below the decomposition temperature of the Diels-Alder adducts. Temperatures within the range of about 110° C. to about 200° C. will normally be used. This reaction results in a mixture of products, some of which have been identified. In the compounds of known structure, the sulfur reacts with the substituted, unsaturated, cycloaliphatic reactants at a double bond in the nucleus of the unsaturated reactant.

The molar ratio of sulfur to Diels-Alder adduct used in the preparation of the sulfur-containing composition is from about 0.5:1 to about 10:1 although the molar ratio generally will be less than about 4:1. In one embodiment of the invention, the molar ratio is less than about 1.7:1 and more preferably less than about 1:1.

The sulfurizing reaction can be conducted in the presence of suitable inert organic solvents such as mineral oils, alkanes of 7 to 18 carbons, etc., although no solvent is generally necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

It is sometimes advantageous to remove $H_2S$. This can be done by blowing with steam, alcohols, air, or nitrogen gas. It can also be done by heating at reduced pressures with or without the blowing.

It is sometimes advantageous to incorporate materials useful as sulfurization catalysts in the reaction mixture. These materials may be acidic, basic or neutral. Useful neutral and acidic materials include acidified clays such as "Super Filtrol", p-toluene sulfonic acid, dialkylphosphorodithioic acids, phosphorus sulfides such as phosphorus pentasulfide and phosphites such as triaryl phosphites (e.g., triphenyl phosphite).

The basic materials may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl radicals are alkyl, aryl, aralkyl, alkaryl or the like and contain about 1–20 carbon atoms. Suitable amines include aniline, benzylamine, dibenzylamine, dodecylamine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine, morpholine and quinoline.

When a catalyst is used, the amount is generally about 0.05–2.0% of the weight of the adduct.

The following Examples B-9 to B-14 illustrate the preparation of the sulfur-containing compounds derived from Diels-Alder adducts.

EXAMPLE B-9

To 255 grams (1.65 moles) of the isoprene-methacrylate adduct of Example B-7 heated to a temperature of 110°–120° C., there are added 53 grams (1.65 moles) of sulfur flowers over a 45-minute period. The heating is continued for 4.5 hours at a temperature in the range of 130°–160° C. After cooling to room temperature, the reaction mixture is filtered through a medium sintered glass funnel. The filtrate consists of 301 grams of the desired sulfur-containing products.

EXAMPLE B-10

A reaction mixture comprising 1175 grams (6 moles) of the Diels Alder adduct of butyl acrylate and isoprene and 192 grams (6 moles) of sulfur flowers is heated for 0.5 hour at 108°–110° C. and then to 155°–165° C. for 6 hours while bubbling nitrogen gas through the reaction mixture at 0.25 to 0.5 cfh. At the end of the heating period, the reaction mixture is allowed to cool and filtered at room temperature. Thereafter, the product is permitted to stand for 24 hours and refiltered. The filtrate is the desired product.

EXAMPLE B-11

Sulfur (4.5 moles) and the adduct of isoprene-methyl methacrylate (4.5 moles) are mixed at room temperature and heated for one hour at 110° C. while blowing nitrogen through the reaction mass at 0.25–0.5 cfh. Subsequently the reaction mixture is raised to a temperature of 150°–155° C. for 6 hours while maintaining the nitrogen blowing. After heating, the reaction mass is permitted to stand for several hours while cooling to room temperature and is thereafter filtered. The filtrate consists of 842 grams of the desired sulfur-containing product.

EXAMPLE B-12

A mixture of 1703 grams (9.4 moles) of a butyl acrylate-butadiene adduct prepared as in Example B-8, 280 grams (8.8 moles) of sulfur and 17 grams of triphenyl phosphite is prepared in a reaction vessel and heated gradually over 2 hours to a temperature of about 185° C. while stirring and sweeping with nitrogen. The reaction is exothermic near 160°–170° C., and the mixture is maintained at about 185° C. for 3 hours. The mixture is cooled to 90° C. over a period of 2 hours and filtered using a filter aid. The filtrate is the desired product containing 14.0% by weight sulfur.

EXAMPLE B-13

The procedure of Example B-12 is repeated except that the triphenyl phosphite is omitted from the reaction mixture.

EXAMPLE B-14

The procedure of Example B-12 is repeated except that the triphenyl phosphite is replaced by 2.0 grams of triamyl amine as a sulfurization catalyst.

SULFURIZED TERPENES USEFUL AS THE SULFUR SOURCE (B)

The sulfur source may be at least one sulfurized terpene compound or a composition prepared by sulfurizing a mixture comprising at least one terpene and at least one other olefinic compound.

The term "terpene compound" as used herein is intended to include the various isomeric terpene hydrocarbons having the empirical formula $C_{10}H_{16}$, such as contained in turpentine, pine oil and dipentenes, and the various synthetic and naturally occurring oxygen-containing derivatives. Mixtures of these various compounds generally will be utilized, especially when natural products such as pine oil and turpentine are used. Pine oil, for example, which is obtained by destructive distillation of waste pine wood with superheated steam comprises a mixture of terpene derivatives such as alpha-terpineol, beta-terpineol, alpha-fenchol, camphor, borneol/isoborneol, fenchone, estragole, dihydro alpha-terpineol, anethole, and other mono-terpene hydrocarbons. The specific ratios and mounts of the various components in a given pine oil will depend upon the particular source and the degree of purification. A group of pine oil-derived products are available commercially from Hercules Incorporated. It has been found that the pine oil products generally known as terpene alcohols available from Hercules Incorporated are particularly useful in the preparation of the sulfurized products used in the invention. Examples of such products include alpha-Terpineol containing about 95–97% of alpha-Terpineol, a high purity tertiary terpene alcohol mixture typically containing 96.3% of tertiary alcohols; Terpineol 318 Prime which is a mixture of isomeric terpineols obtained by dehydration of terpene hydrate and contains about 60–65 weight percent of alpha-terpineol and 15–20% beta-terpineol, and 18–20% of other tertiary terpene alcohols. Other mixtures and grades of useful pine oil products also are available from Hercules under such designations as Yarmor 302, Herco pine oil, Yarmor 302W, Yarmor F and Yarmor 60.

The terpene compounds which can be utilized as the sulfur source may be sulfurized terpene compounds, sulfurized mixtures of terpene compounds or mixtures of at least one terpene compound and at least one sulfurized terpene compound. Sulfurized terpene compounds can be prepared by sulfurizing terpene compounds with sulfur, sulfur halides, or mixtures of sulfur or sulfur dioxide with hydrogen sulfide as will be described more fully hereinafter. Also, the sulfurization of various terpene compounds has been described in the prior art. For example, the sulfurization of pine oil is described in U.S. Pat. No. 2,012,446.

The other olefinic compound which may be combined with the terpene compound may be any of several olefinic compounds such as those described earlier under the subtitle "Sulfurized Olefins Useful as the Sulfur Source (B)".

The other olefin used in combination with the terpene also may be an unsaturated fatty acid, an unsaturated fatty acid ester, mixtures thereof, or mixtures thereof with the olefins described above. The term "fatty acid" as used herein refers to acids which may be obtained by hydrolysis of naturally occurring vegetable or animal fats or oils. These fatty acids usually contain from about 16 to about 20 carbon atoms and are mixtures of saturated and unsaturated fatty acids. The unsaturated fatty acids generally contained in the naturally occurring vegetable or animal fats and oils may contain one or more double bonds and such acids include palmitoleic acid, oleic acid, linoleic acid, linolenic acid, and erucic acid.

The unsaturated fatty acids may comprise mixtures of acids such as those obtained from naturally occurring animal and vegetable oils such as lard oil, tall oil, peanut oil, soybean oil, cottonseed oil, sunflower seed oil, or wheat germ oil. Tall oil is a mixture of rosin acids, mainly abietic acid, and unsaturated fatty acids, mainly oleic and linoleic acids. Tall oil is a by-product of the sulfate process for the manufacture of wood pulp.

It is frequently advantageous to incorporate materials useful as sulfurization promoters in the reaction mixture. These promoters which may be acidic, basic or neutral have been discussed earlier.

The amount of promoter material used is generally about 0.0005–2.0% of the combined weight of the terpene and olefinic compounds. In the case of the preferred ammonia and amine catalysts, about 0.0005–0.5 mole per mole of the combined weight is preferred, and about 0.001–0.1 mole is especially desirable.

Water is also present in the reaction mixture either as a promoter or as a diluent for one or more of the promoters recited hereinabove. The amount of water, when present, is usually about 1–25% by weight of the olefinic compound. The presence of water is, however, not essential and when certain types of reaction equipment are used it may be advantageous to conduct the reaction under substantially anhydrous conditions.

When promoters are incorporated into the reaction mixture as described hereinabove, it is generally observed is that the reaction can be conducted at lower temperatures, and the product generally is lighter in color.

The sulfurizing reagent used to sulfurize the terpenes may be, for example, sulfur, a sulfur halide such as sulfur monochloride or sulfur dichloride, a mixture of hydrogen sulfide and sulfur or sulfur dioxide, or the like. Sulfur, or mixtures of sulfur and hydrogen sulfide often are preferred. However, it will be understood that other sulfurization reagents may, when appropriate, be substituted therefor. Commercial sources of all the sulfurizing reagents are normally used for the purpose of this invention, and impurities normally associated with these commercial products may be present without adverse results.

When the sulfurization reaction is effected by the use of sulfur alone, the reaction is effected by merely heating the reagents with the sulfur at temperatures of from about 50° to 250° C., usually, from about 150° C. to about 210° C. The weight ratio of the combination of terpene and other olefin to sulfur is between about 5:1 and about 15:1, generally between about 5:1 and about 10:1. The sulfurization reaction is conducted with efficient agitation and generally in an inert atmosphere (e.g., nitrogen). If any of the components or reagents are appreciably volatile at the reaction temperature, the reaction vessel may be sealed and maintained under pressure. It is frequently advantageous to add the sulfur portionwise to the mixture of the other components.

When mixtures of sulfur and hydrogen sulfide are utilized, the amounts of sulfur and hydrogen sulfide per mole of terpene and other olefin are, respectively, usually about 0.3 to about 3 gram-atoms and about 0.1 to about 1.5 moles. A useful range is from about 0.5 to about 2.0 gram-atoms and about 0.4 to about 1.25 moles, respectively, and the most desirable ranges are about 0.8 to about 1.8 gram-atoms, and about 0.4 to about 0.8 mole, respectively. In batch operations, the components are introduced at levels to provide these ranges. In semi-continuous operations, they may be admixed at any ratio, but on a mass balance basis, they are present so as to be consumed in amounts within these ratios. Thus, for example, if the reaction vessel is initially charged with sulfur alone, the olefinic compound and hydrogen sulfide are added incrementally at a rate such that the desired ratio is obtained.

When mixtures of sulfur and hydrogen sulfide are utilized in the sulfurization reaction, the temperature range of the sulfurization reaction is generally from about 50° C. to about 350° C. The preferred range is about 100° C. to about 200° C. with about 120° C. to about 180° C. being especially suitable. The reaction often is conducted under super atmospheric pressure which may be and usually is autogenous pressure (i.e., pressure which naturally developed during the course of the reaction), but may also be externally applied pressure. The exact pressure developed during the reaction is dependent upon such factors as design and operation of the system, the reaction temperature, and the vapor pressure of the reactants and products, and it may vary during the course of the reaction.

While it is preferred generally that the reaction mixture consists entirely of the components and reagents described above, the reaction also may be carded out in the presence of an inert solvent (e.g., an alcohol, ether, ester, aliphatic hydrocarbon, halogenated aromatic hydrocarbon, etc.) which is liquid within the temperature range employed. When the reaction temperature is relatively high, for example, at about 200° C., there may be some evolution of sulfur from the product which is avoided when a lower reaction temperature such as from about 150°–170° C. is used.

The time required for the sulfurization reaction to be completed will vary depending upon the reagents, the ratios thereof, the reaction temperature, the presence or absence of promoters, and the purity of the reagents. When a mixture of sulfur and sulfur dioxide is used as the sulfurizing agent and the reaction is conducted at an elevated pressure in a closed vessel, the course of the reaction can be followed conveniently by monitoring the pressure in the reaction vessel.

The reaction generally can be considered complete when the pressure levels off to a constant value. Following the preparation of the sulfurized mixture by the procedures described above, it is generally preferred to remove substantially all low boiling materials, typically by venting the reaction vessel or by distillation at atmospheric pressure, vacuum distillation or stripping, or the passage of an inert gas such as nitrogen through the mixture at a suitable temperature and pressure. Any solids which are present in the reaction mixture may be removed conveniently, in most instances, by merely pouring off the liquid product. If further removal of solids is desired, such conventional techniques as filtration or centrifugation may be used.

The following Examples B-15 to B-18 illustrate the preparation of sulfurized terpene compounds and sulfurized mixtures of terpenes and olefinic compounds which are useful as the sulfur source (B).

EXAMPLE B-15

To a reaction vessel there is charged 372 grams (2 equivalents) of a commercially available pine oil. The pine oil is heated to 35° C. with stirring. 128 grams of sulfur are added slowly with nitrogen blowing while the reaction temperature is maintained at about 35° C. After addition of the sulfur is completed, nitrogen is bubbled through the reaction mixture while it is heated to reflux at about 145° C. After a total reaction time of about 8 hours, the mixture is filtered through filter aid. The filtrate is the desired sulfurized product containing 23.35% by weight sulfur.

EXAMPLE B-16

The procedure of Example B-15 is repeated except that the reaction mixture comprises 186 grams of pine oil (1 equivalent) and 32 grams of sulfur (1.0 equivalent). The product obtained in this matter has a sulfur content of 15.6% by weight.

EXAMPLE B-17

To a reaction vessel is added 372 grams (2 equivalents) of pine oil and 96 parts (3 grams) of sulfur. When all of the sulfur is added, the mixture is heated to 150° C. with nitrogen blowing, and the mixture is maintained at this temperature for about 10 hours. The reaction mixture is filtered through a filter aid, and the filtrate is the desired product having a sulfur content of 17.25% by weight.

EXAMPLE B-18

A mixture of 186 grams (1 equivalent) of pine oil and 168 grams (1 equivalent) of polypropylene is prepared, and 96 grams (3 equivalents) of sulfur are added with stirring. The reaction mixture is heated to a temperature of about 170° C. with nitrogen blowing and maintained at this temperature for 10 hours. The reaction mixture then is cooled and filtered through filter aid. The filtrate is the desired product having a sulfur content of 16.79% by weight.

SULFUR-COUPLED DITHIOCARBAMATES USEFUL AS THE SULFUR SOURCE (B)

In one embodiment, the sulfur source (B) is a sulfur-coupled dithiocarbamate represented by the formula

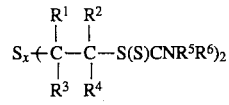

(V)

wherein $R^1$, $R^2$ and $R^3$ are independently H or a hydrocarbyl group; $R^4$ is H, OH or a hydrocarbyl group; $R^5$ and $R^6$ are independently H, a hydrocarbyl group or hydroxyhydrocarbyl group; or $R^3$ and $R^4$ together and/or $R^5$ and $R^6$ together and/or $R^1$ and $R^3$ together and/or $R^2$ and $R^4$ together may form cyclic groups, and x is a number from 1 to about 8.

The hydrocarbyl groups of $R^1$ through $R^4$ may be straight-chain or branched-chain hydrocarbyl groups. Each of $R^1$ through $R^6$ may independently contain from 1 to about 100 carbon atoms, preferably from 1 to about 30 carbon atoms.

The groups $R^1$ through $R^4$ may be aliphatic or aromatic groups such as alkyl, cycloalkyl, alkaryl, aralkyl or aryl groups. $R^3$ and $R^4$ together and/or $R^5$ and $R^6$ together may be alkylene groups containing from about 4 to about 7 carbon atoms. In these embodiments, $R^3$ and $R^4$ together with the carbon atom bonded to $R^3$ and $R^4$ in Formula V will form a cycloalkyl group, and $R^5$ and $R^6$, together with the nitrogen atom bonded to $R^5$ and $R^6$ in Formula V forms a heterocyclic group.

Specific examples of hydrocarbyl groups $R^1$ through $R^6$ include methyl, ethyl, isopropyl, isobutyl, secondary butyl, cyclohexyl, cyclopentyl, octyl, dodecyl, octadecyl, eicosyl, behenyl, triacontronyl, phenyl, naphthyl, phenethyl, octylphenyl, tolyl, xylyl, dioctadecylphenyl, triethylphenyl, chlorophenyl, methoxyphenyl, dibromophenyl, nitrophenyl, 3-chlorohexyl, etc.

In one embodiment of the present invention, the sulfur-coupled dithiocarbamate is characterized by the structural formula

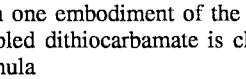

(V-A)

wherein x is a number of from 1 to 2, $R^3$ and $R^4$ are hydrogen or a hydrocarbyl group, and $R^5$ and/or $R^6$ are each individually hydrocarbyl groups. The hydrocarbyl groups may be any of the hydrocarbyl groups described above with respect to Formula V. Generally, $R^5$ and $R^6$ will contain from 1 to about 50 carbon atoms, and $R^3$ and $R^4$ are hydrocarbyl groups contain from 1 to about 100 carbon atoms.

In one embodiment, the dithiocarbamates are characterized by the formula

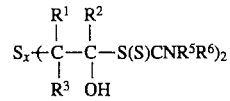

(V-B)

wherein $R^1$, $R^2$, $R^3$, $R^5$, $R^6$ and x are as defined above with respect to Formula V.

In one embodiment the sulfur-coupled dithiocarbamates are prepared by a process comprising the steps of (A) reacting a sulfur halide with about a stoichiometric equivalent of (i) at least one olefinic hydrocarbon or (ii) an aldehyde or ketone at a temperature and for a period of time sufficient to produce a di(halohydrocarbyl)sulfur intermediate or a dialdehyde or diketo sulfur intermediate, and (B) reacting the intermediate with a salt of a dithiocarbamate in an amount sufficient generally to replace both halo groups with the dithiocarbamate groups or to react with both carbonyl groups of the dialdehyde or diketone.

When the starting material is (i) at least one olefinic hydrocarbon, the resulting product is characterized by either Formula V or Formula V-A or the product is a mixture comprising principally materials characterized by Formulae V and V-A. When the starting material is (ii) an aldehyde or a ketone, the product is characterized primarily by Formula V-B.

The sulfur halide utilized in the first step (A) may be sulfur monochloride (i.e., $S_2Cl_2$), sulfur dichloride, sulfur monobromide, sulfur dibromide, or mixtures of any of the above sulfur halides with elemental sulfur in varying mounts.

Various olefins and olefin mixtures may be used as the starting material in step (A). Olefin mixtures resulting from the oligomerization of ethylene and/or propylene are available at low cost. The olefinic hydrocarbons contain at least one olefinic double bond which is defined as a non-aromatic double bond. That is, the double bond connects two aliphatic carbon atoms. The olefin may be defined by the formula $$R^1R^3C{=}CR^2R^4$$

wherein each of $R^1$, $R^2$, $R^3$ and $R^4$ is hydrogen or a hydrocarbyl group as defined above with respect to Formulae V, V-A or V-B. Although diolefinic hydrocarbons may be utilized, it is preferred that the olefin be a monoolefin and the olefin may be a terminal monoolefinic hydrocarbon; that is, those olefins in which $R^1$ and $R^3$ are hydrogen and $R^2$ and/or $R^4$ are alkyl or aryl. Internal olefinic compounds, e.g., where $R^1$ and $R^2$ are alkyl or aryl groups also are useful. Olefinic compounds containing 3 to about 100 carbon atoms and more generally from 3 to about 30 carbon atoms are particularly desirable.

Isobutene, propylene, and their dimers, trimers, tetramers, etc., and mixtures thereof are also useful olefinic compounds. Of these compounds, isobutylene, diisobutylene, triisobutylene and tetraisobutylene are particularly desirable because of their availability.

The product which is obtained from the reaction of a sulfur halide with one or more of the above-identified olefinic hydrocarbons is a di(halohydrocarbyl)sulfide intermediate produced by the addition of the elements of the sulfur halide to the unsaturated carbon atoms of the olefin. The reaction proceeds on mixing of the olefin and the sulfur halide although the rate of the reaction is increased by elevating the temperature of the mixture. Thus, the mixture generally is between about −20° C. and about 120° C. until the reaction is completed. The reaction temperature is dictated by the reactivity of the starting olefin and the thermal stability of the reaction product.

Alternatively, the olefin can be warmed to the desired temperature whereupon the sulfur halide can be added dropwise, generally in an inert atmosphere at a rate sufficient to maintain the desired temperature. Following the completion of the addition of the sulfur halide, the reaction mixture may be heated for an extended period to complete the reaction.

The amount of sulfur halide reacted with the olefinic hydrocarbon generally is a stoichiometric equivalent. For example, when a sulfur monohalide is utilized as the sulfur halide source, one mole of sulfur monohalide is reacted with two moles of the olefin or olefin mixture.

Catalysts or reaction promoters may be utilized although they are generally found to be unnecessary. Examples of such catalysts or promoters include the lower aliphatic amines and aromatic amines, especially tertiary amines.

The aldehydes or ketones which may be utilized as a starting material for reaction with a sulfur halide may be characterized by the following formula $$R^1R^3CHC(O)R^2$$

wherein $R^1$, $R^2$ and $R^3$ are each individually hydrogen or hydrocarbyl groups as defined above with respect to Formulae V, V-A or V-B. When the starting material is an aldehyde, the intermediate will contain two aldehyde carbonyl groups, and when the starting material is a ketone, the sulfur intermediate will contain two keto groups.

The aldehydes and ketones may be reacted with sulfur halides such as sulfur monochloride, sulfur dichloride, sulfur monobromide, sulfur dibromide, and mixtures of sulfur halide with elemental sulfur.

The reaction of an aldehyde or ketone with a sulfur halide may be effected simply by mixing the two reactants at the desired temperature which may range from about −30° C. to about 250° C. or higher. A preferred reaction temperature generally is within the range of from about 10° C. to about 80° C. The reaction may be carried out in the presence of a diluent or solvent such as benzene, naphtha, hexane, carbon tetrachloride, chloroform, mineral oil, etc. The diluent/solvent facilitates the control of the reaction temperature and a thorough mixing of the reactants.

The relative amounts of the aldehyde or ketone and the sulfur halide may vary over wide ranges. In most instances, the reaction involves two moles of the aldehyde or ketone and one mole of the sulfur halide. In other instances, an excess of either one of the reactants may be used. When sulfur compounds are desired which contain more than two sulfur atoms, (e.g., x is an integer from 3–8) these compounds can be obtained by reacting the aldehydes and ketones with a mixture of sulfur halide and sulfur. This is usually accomplished by reacting the sulfur halide and sulfur prior to reaction with the aldehyde or ketone.

Specific examples of aldehydes that can be reacted with sulfur halides include, for example, acetaldehyde, propionaldehyde, butyraldehyde, isobutyraldehyde, 2-ethyl-1-hexaldehyde, cyclohexanecarboxaldehyde, ($C_6H_{11}CHO$). Examples of ketones include dimethylketone, methylethylketone, diethylketone, methylisopropylketone, methylisobutylketone, etc.

The sulfur-coupled dithiocarbamates are prepared by reacting the above-described sulfur intermediates with a salt of a dithiocarbamate in an amount sufficient to replace the halo groups with dithiocarbamate groups or to react with both carbonyl groups of the dialdehyde or diketone intermediate. The dithiocarbamate salts may be represented by the formula $$R^5R^6NC(S)SX$$

wherein $R^5$ and $R^6$ are each individually hydrogen, hydrocarbyl or hydroxyhydrocarbyl groups and X is an alkali metal, tertiary amine, or other basic material. The salts of the dithiocarbamic acids may be prepared by the reaction of an amine $R^5R^6NH$ with carbon disulfide in the presence of a base, usually an alkali metal hydroxide, generally, at a molar ratio of 1:1:1. Preferably the base is an alkali metal hydroxide such as sodium or potassium hydroxide, and more generally, sodium hydroxide. However, the base can be a tertiary amine or in excess of the amine being used on the reaction.

The hydrocarbyl or hydroxyhydrocarbyl groups $R^5$ and $R^6$ may contain from 1 to about 50 carbon atoms. Preferably, $R^5$ and $R^6$ are lower hydrocarbyl groups. In one embodiment, $R^5$ and $R^6$ are alkylene groups containing from about 4 to about 7 carbon atoms, and in this embodiment, $R^5$ and $R^6$ together with the nitrogen atom bonded to $R^5$ and $R^6$ will form a heterocyclic group. The heterocyclic group (and the alkylene group) may contain other atoms such as oxygen and sulfur.

Specific examples of the amines ($R^5R^6NH$) used to form the dithiocarbamates include, for example, methylamine, propylamine, dimethylamine, diethylamine, dipropylamine, dibutylamine, methylethylamine, methylcyclohexylamine, piperidine, morpholine, dihexylamine, dioctylamine, dicocoamine, methylhydroxyethylamine, dihydroxyethylamine, piperazine, etc.

The metal salts of dithiocarbamates are known in the art and can be prepared readily by one skilled in the art. One method of preparing alkali metal salts of dithiocarbamic acids involves the reaction of an amine, carbon disulfide and an alkali metal hydroxide. Generally, these reactants are mixed and reacted at low temperatures such as between about zero and 15° C. In one embodiment, an aqueous amine is cooled to zero to 15° C. and carbon disulfide is added dropwise, generally in an inert atmosphere before or during the addition of the alkali metal hydroxide. In another embodiment, the aqueous amine is cooled whereupon the alkali metal hydroxide is added followed by the carbon disulfide. When all of the reactants have been mixed at the low temperature of zero to 15° C., the mixture is allowed to warm to ambient temperature with stirring.

The salts of dithiocarbamic acids prepared by the above procedure generally are reacted immediately with the sulfur intermediates which have been described above. Solvents may be included to facilitate the reaction, and alcohols have been found to be satisfactory solvents. The reaction between the sulfur intermediate and the dithiocarbamate salts generally is conducted at from ambient temperature to the reflux temperature of the mixture. The reaction is conducted until the reaction is completed which is generally from about 5 to about 24 hours. At the end of the reaction, the aqueous phase is separated, and the product is recovered from the organic phase.

The product of the reaction of the sulfur monohalide with an olefinic hydrocarbon followed by reaction with the dithiocarbamate generally is a mixture of products which can be represented by the Formulae V or V-A. When the reaction is conducted with an aldehyde or a ketone in lieu of the olefinic hydrocarbon, the reaction product also is a mixture in which the major product is believed to be represented by the structural Formula V-B.

The sulfur-coupled dithiocarbamates also may be prepared by a process which comprises the steps of (A) reacting an olefinic hydrocarbon with a halogen to produce a halogen-containing intermediate, and (B) reacting said intermediate with an alkali metal sulfide and a salt of a dithiocarbamate in an amount sufficient to replace the halogen groups present partially with dithiocarbamate groups and/or partially with sulfide groups.

Any of the olefinic hydrocarbons and salts of dithiocarbamates described above may be utilized in this process. The reaction of a halogen with an olefinic hydrocarbon is well known in the art, and any procedure for effecting the reaction of a halogen with an olefinic hydrocarbon to produce a halogen-containing intermediate can be utilized.

The alkali metal sulfide utilized in the second step may be generally represented by the structural formula $$M_2S_x$$

wherein M is an alkali metal and x is 1, 2 or 3. Sodium sulfide is preferred as the alkali metal sulfide for reasons of economy and effectiveness.

In one embodiment, the halogen-containing intermediate is reacted first with the alkali metal sulfide and then with the salt of a dithiocarbamate. Although the above reactants can be reacted at various ratios, it is generally desired to react four equivalents of the halogen-containing intermediate with one mole of the alkali metal sulfide and two moles of the dithiocarbamate salt. The reactions may be conducted at any convenient temperature such as from ambient temperature up to about 100° C. or higher in some instances. The product obtained by this reaction generally will be a mixture which comprises primarily sulfur-coupled dithiocarbamates which are useful in lubricants and functional fluids.

Preparation of the Sulfurized Overbased Product:

The inventive sulfurized overbased products are made by contacting the overbased product (A) or the boron-containing overbased-product (A') with the sulfur or sulfur source (B) for an effective period of time and at a sufficient temperature to form the desired sulfurized product. As indicated above, it is believed that the sulfurized product is at least in part a thiosulfate. The contacting can be effective by mixing the sulfur or sulfur source with the overbased product using standard mixing or blending techniques. The contact time is typically from about 0.1 to about 200 hours, preferably about 1 to about 100 hours, more preferably about 5 to about 50 hours, and in many instances from about 10 to about 30 hours. The temperature is generally from about room temperature up to the decomposition temperature of the reactants or desired products having the lowest such temperature, preferably from about 20° C. to about 300° C., more preferably about 20° C. to about 200° C., more preferably about 20° C. to about 150° C. Typically, the ratio of equivalents of sulfur or sulfur source per equivalent of overbased product is from about 0.1 to about 10, preferably about 0.3 to about 5, more preferably about 0.5 to about 1.5. In one embodiment the ratio is about 0.65 to about 1.2 equivalents of sulfur or sulfur source per equivalent of overbased product.

For purposes of this reaction, an equivalent of the sulfur or sulfur source (B) is based upon the number of moles of sulfur available to react with the $SO_2$ in the overbased product (A) or the boron-containing overbased-product (A'). Thus, for example, elemental sulfur has an equivalent weight equal to its atomic weight. An equivalent of the overbased product (A) or boron-containing overbased product (A') is based upon the number of moles of $SO_2$ in the overbased product available to react with the sulfur. Thus, an overbased product (A) or boron-containing overbased product (A') containing one mole of $SO_2$ has an equivalent weight equal to its actual weight. An overbased product containing two moles of $SO_2$ has an equivalent weight equal to one-half its actual weight.

While not wishing to be bound by theory, it is believed that the product that is formed using $SO_2$ or a source of $SO_2$ as the acidic material (A)(V) or is formed using $SO_2$ or a source of $SO_2$ to displace the acidic material (A)(V) is a mixture of a number of products but includes, at least in part, a sulfite, and the product that is formed as a result of the sulfurization with the sulfur or sulfur source (B) is also a mixture of a number of products but includes at least in part, a thiosulfate. Thus, for example, if the overbased product (A) is a sodium sulfonate made using $CO_2$ as the acidic material, it can be represented by the formula $$RSO_3Na(Na_2CO_3)_x \text{ Overbased Sodium Sulfonate}$$

the sulfite formed by contacting this sodium sulfonate with the $SO_2$ or source of $SO_2$ can be represented by the formula $$RSO_3Na(Na_2SO_3)_x \text{ Sulfite}$$

and the thiosulfate formed by the sulfurization of this sulfite with the sulfur or sulfur source (B) can be represented by the formula $$RSO_3Na(Na_2S_2O_3)_x \text{ Thiosulfate}$$

wherein in each formula x is a number that is generally one or higher. The progress of both of these reactions can be measured using infrared or base number analysis. One technique for quantitatively measuring the sulfite and thiosulfate content of the inventive sulfurized overbased products is through the use of differential pulse polarography which is a known analytical technique involving measuring current vs. potential applied to a sample within an electrolytic cell.

The following Examples 1–13 are illustrative of the preparation of the sulfurized overbased products of the present invention.

EXAMPLE 1

A mixture of 1400 grams (5.5 equivalents) of a first sulfite derived from the product of Example A-1 and $SO_2$ having a sulfur content of 12.6% by weight and a sodium content of 17.6% by weight, 300 grams (1.0 equivalent) of a second sulfite derived from the product of Example A-1 and $SO_2$ having a sulfur content 10.7% by weight and a sodium content of 16.2% by weight, and 208 grams (6.5 equivalents) of sulfur are heated to a temperature of 140° C. and maintained at that temperature with stirring for 22 hours to provide 1535 grams of the desired product which is in the form of a brown oil. The product has a sulfur content of 22% by weight and a sodium content of 16.9% by weight.

EXAMPLE 2

A mixture of 1172 grams (4 equivalents) of the product from Example A-47 and 64 grams (2 equivalents) of sulfur are heated to a temperature of 140°–150° C. and maintained at that temperature with stirring for 21 hours to provide 1121 grams of the desired product which is in the form of a brown oil. The product has a sulfur content of 15.7% by weight and a sodium content of 17.2% by weight.

EXAMPLE 3

A mixture of 1172 grams (4 equivalents) of the product from Example A-47 and 102 grams (3.2 equivalents) of sulfur are heated to a temperature of 140°–150° C. and maintained at that temperature with stirring for 21 hours to provide 1246 grams of the desired product which is in the form of a brown oil. The product has a sulfur content of 17.5% by weight and a sodium content of 16.6% by weight.

EXAMPLE 4

A mixture of 1464 grams (6 equivalents) of the product from Example A-47 and 125 grams (3.9 equivalents) of sulfur are heated to a temperature of 135° C. and maintained at that temperature with stirring for 23 hours. The mixture is filtered using diatomaceous earth to provide 1430 grams of the desired product.

EXAMPLE 5

A mixture of 500 grams of the product from Example A-47 and 77 grams of sulfur are heated to a temperature of 149°–153° C. and maintained at that temperature with stirring for 23 hours to provide 472 grams of the desired product.

EXAMPLE 6

A mixture of 880 grams (2 equivalents) of the product from Example A-49 and 77 grams (2.4 equivalents) of sulfur are heated to a temperature of 130° C. and maintained at that temperature with stirring for 17.5 hour. 100 grams of diluent oil are added. The reaction mixture is heated to 140°–150° C. with stirring for one hour. The mixture is filtered to provide 985 grams of the desired product which is in the form of a brown oil. The product has a sulfur content of 12.1% by weight, a sodium content of 10.48% by weight, and a boron content of 5.0% by weight.

EXAMPLE 7

A mixture of 1310 grams (3.36 equivalents) of the product from Example A-48 and 53.4 grams (1.67 equivalents) of sulfur are heated to a temperature of 140°–150° C. and maintained at that temperature with stirring for 29.5 hours. The reaction mixture is cooled to 100° C. and filtered using diatomaceous earth to provide 1182 grams of the desired product which is in the form of a brown-black oil. The product has a sulfur content of 12.0% by weight and a sodium content of 17.5% by weight, and a base number (bromophenol blue) of 241. The product has copper strip ratings (ASTM D130) of 1B-2A (100° C., 3 hours, 1%) and 2A-2B (100° C., 3 hours, 5% ).

EXAMPLE 8

A mixture of 1500 grams (3.84 equivalents) of the product from Example A-48 and 98.4 grams (3.10 equivalents) of sulfur are heated to a temperature of 150° C. and maintained at that temperature under a nitrogen blanket with stirring for 24 hours. The reaction mixture is filtered using diatomaceous earth to provide 1418 grams of the desired product. The product has a sulfur content of 14.0% by weight, a sodium content of 16.6% by weight and a base number (bromophenol blue) of 150. The product has copper strip ratings (ASTM D130) of 2B-2C (100° C., 3 hours, 1%) and 4B (100° C., 3 hours, 5%).

EXAMPLE 9

A mixture of 8960 grams (70 equivalents) of the product from Example A-1 and 1024 grams (32 equivalents) of sulfur is heated to 140°–150° C. with stirring. 2240 grams (70 equivalents) of $SO_2$ are blown through the mixture at a rate of 1.5 cfh over a period of 34 hours. The reaction mixture is blown with nitrogen for one hour at 150° C. and filtered using diatomaceous earth to provide 9330 grams of the desired product which is in the form of a clear brown oil and has a sulfur content of 21.68% by weight, a sodium content of 15.86% by weight and a copper strip rating (ASTM D130) of 1A (100° C., 3 hours, 5%).

EXAMPLE 10

A mixture of 1468 grams (4 equivalents) of the product from Example A-50 and 128 grams (4 equivalents) of sulfur are heated to a temperature of 140° C. and maintained at that temperature with stirring for 1.5–2 hours to provide 1488 grams of the desired product which is in the form of a brown oil. The product has a sulfur content of 16.0% by weight and a sodium content of 11.8% by weight.

EXAMPLE 11

A mixture of 1222 grams (3.33 equivalents) of the product from Example A-50 and 80 grams (2.5 equivalents) of sulfur are heated under a nitrogen blanket to a temperature of 140° C. with stirring and maintained at that temperature for 2–3 hours. The reaction mixture is filtered using diatomaceous earth to provide 1150 grams of the desired product which is in the form of a brown oil. The product has a sulfur content of 14.4% by weight and a sodium content of 11.9% by weight.

EXAMPLE 12

A mixture of 3480 grams (20 equivalents) of the product from Example A-43 and 320 grams (10 equivalents) of sulfur are blown with 640 grams (20 equivalents) of $SO_2$ at a rate of 1.5 cfh and a temperature of 140°–150° C. The reaction mixture is blown with nitrogen and filtered using diatomaceous earth to provide 3728 grams of the desired product which is in the form of a brown oil. The product has a sulfur content of 15.9% by weight and a sodium content of 11.3% by weight.

EXAMPLE 13

A mixture of 336 grams (0.5 equivalent) of an overbased calcium sulfite derived from one equivalent of the product from Example A-2 and one equivalent of $SO_2$ and 16 grams (0.5 equivalent) of sulfur are heated to a temperature of 135° C. for 8.5 hours and then a temperature of 150° C. for 6 hours. The mixture is filtered using diatomaceous earth to provide 255 grams of the desired product. The product has a calcium content of 12.1% by weight and a sulfur content of 5.7% by weight.

Active Sulfur Reduction:

In one embodiment the inventive sulfurized overbased products are contacted with an effective amount of at least one active-sulfur reducing agent to reduce the active-sulfur content of such products. This can be done in instances wherein the sulfurized overbased products are considered to be too corrosive for the desired application. The term "active sulfur" is used herein to mean sulfur in a form that can cause staining of copper and similar materials. Standard tests such as ASTM D130 are available for measuring sulfur activity.

The active-sulfur reducing agent can be air in combination with activated carbon, steam, one or more of the boron compounds (e.g., bode acid) described above under the sub-title "Boron-Containing Overbased Products (A')", one or more of the phosphites (e.g., di- and tributylphosphite, triphenyl phosphite) described above under the sub-title "Phosphorus-Containing Acids (A)(I)(c)", or one or more of the olefins (e.g., $C_{16-18}$ α-olefin mixture) described above under the subtitles "Sulfurized Olefins Useful as the Sulfur Source (B)", "Sulfurized Diels-Alder Adducts Useful as the Sulfur Source (B)", or "Sulfurized Terpenes Useful as the Sulfur Source (B)".

In one embodiment the active-sulfur reducing agent is the reaction product of one or more of the carboxylic acids or derivatives thereof described above under the sub-title "Carboxylic Acids (A)(I)(a)" with one or more nitrogen containing compounds such as amines or organic hydroxy compounds such as phenols or alcohols. Maleic anhydride and polyisobutenyl ($\overline{M}n$=700–2000) succinic anhydride are particularly preferred carboxylic acids. Useful amines are disclosed in U.S. Pat. No. 4,234,435 at Col. 21, line 4 to Col. 27, line 50, and useful alcohols are disclosed in this patent at Col. 28, line 63 to Col. 35, line 54. The reaction product of the carboxylic acid or derivative with the nitrogen-containing compound or hydroxy compound can be post-treated with one or more of the above nitrogen-containing compounds and/or one or more of the post-treating reagents (e.g., boric acid) disclosed in U.S. Pat. No. 4,234,435 at Col. 41, line 48 to Col. 42, line 17. The procedures for preparing these carboxylic acid reaction products and post-treated reaction products are the same as those described in U.S. Pat. No. 4,234,435 at Col. 27, line 51 to Col. 28, line 62; Col. 35, line 55 to Col. 36, line 33; and Col. 42, lines 18–50; all that is necessary is that the carboxylic acids disclosed herein be substituted for the acylating reagents or high-molecular weight acylating agents disclosed in said patent, usually on an equivalent basis. The foregoing passages from U.S. Pat. No. 4,234,435 are incorporated hereby by reference.

In one embodiment the inventive composition is a lubricating composition or an oil-based functional fluid, and in this embodiment the active sulfur-content of the sulfurized overbased product can be reduced by blending into said composition an effective amount of a Group II metal salt of one or more of the phosphorodithioic acids described above under the sub-title "Phosphorus-Containing Acids (A)(I)(c)". These include zinc dicyclohexylphosphorodithioate, zinc dioctylphosphorodithioate, barium di(heptylphenyl)-phosphorodithioate, cadmium dinonylphosphorodithioate, the zinc salt of a phosphorodithioic acid produced by the reaction of phosphorus pentasulfide with an equimolar mixture of isopropyl alcohol and n-hexyl alcohol, and preferably the zinc salt of a phosphorodithioic acid produced by the reaction of phosphorus pentasulfide with an alcohol mixture of 60 mole percent 4-methyl-2-pentanol and 40 mole percent isopropyl alcohol. The lubricating compositions or functional fluids thus formulated typically include up to about 20% by weight, preferably up to about 10% by weight, more preferably up to about 5% by weight of these Group II metal phosphorodithioiates.

The copper strip test provided for in ASTM D130 can be used as a measure of the level of active sulfur in the inventive sulfurized overbased products. An improved copper strip rating indicates a reduction in active sulfur and a reduced likelihood of being corrosive.

The contacting of the sulfurized overbased product with the active-sulfur reducing agent is conducted for an effective period of time and at a sufficient temperature to reduce the active sulfur content to a level sufficient to provide a desired copper strip rating. The contacting can be effected by mixing the active-sulfur reducing agent with the sulfurized overbased product using standard mixing or blending techniques. The contact time is typically from about 0.1 to about 50 hours, preferably about 1 to about 30 hours, and often about 1 to about 10 hours. The temperature is generally from about room temperature up to the decomposition temperature of the reactants or desired products having the lowest such temperature, preferably from about 20° C. to about 300° C., more preferably about 120° C. to about 180° C.

Typically, the weight ratio of the active-sulfur reducing agent to the sulfurized overbased product can be up to about 1, but is preferably up to about 0.5. In one embodiment the active-sulfur reducing agent is boric acid and the weight ratio between it and the sulfurized overbased product is from about 0.001 to about 0.1, preferably about 0.005 to about 0.03. In one embodiment the active-sulfur reducing agent is one of the above-indicated phosphites, preferably triphenyl phosphite, and the weight ratio of it to the sulfurized overbased product of from about 0.1 to about 0.2. In one embodiment the active-sulfur reducing agent is one of the above-discussed olefins and the weight ratio of it to the sulfurized overbased product is from about 0.2 to about 0.7.

The following Examples 14–36 are illustrative of the preparation of the inventive sulfurized overbased products using an active-sulfur reducing agent.

EXAMPLES 14–19

In Examples 14–19, a product made in accordance with the procedure described in Example 1 is contacted with boric acid in the amount indicated below, the contacting being for two hours at a temperature of 140°–160° C. with nitrogen blowing. The mixture is vacuum stripped to 150° C. and filtered using diatomaceous earth to provide the desired product. The resulting products are subjected to the copper strip test provided for by ASTM D130 (5% by weight, 3 hours, 100° C.) with the results being as follows:

| Example | $H_3BO_3$* | Cu Strip Rating |
|---|---|---|
| 10 | 14.06 | 4C |
| 11 | 7.01 | 3A |
| 12 | 3.5 | 2C |
| 13 | 1.8 | 2A |
| 14 | 0.9 | 1B |
| 15 | 0.4 | 2B |
| 1** | 0 | 4B |

*Weight % $H_3BO_3$ based upon combined weight of sulfurized overbased product and $H_3BO_3$.
**Product from Example 1 is indicated for comparative purposes.

EXAMPLE 20

A mixture of 500 grams (2 equivalents) of a product made in accordance with the procedures described in Example A-47 and 77 grams (2.4 equivalents) of sulfur are heated at a temperature of 140°–155° C. for 23 hours with stirring. 289 grams of a $C_{16-18}$ α-olefin mixture are added. The mixture is heated at 147°–155° C. with stirring for 23 hours. The product has a copper strip rating (ASTM D130) of 2C (5%, 3 hours, 100° C.).

EXAMPLE 21

A mixture of 435 grams of a product made in accordance with the procedures described in Example 1 and 37.5 grams of tributyl phosphite are heated at a temperature of 100° C. for 6 hours with stirring. The mixture is filtered using diatomaceous earth to provide the desired product which has a sulfur content of 19.8% by weight, a sodium content of 15.5% by weight and a phosphorus content of 0.8% by weight. The product has a copper strip rating (ASTM D130) of 1A (5%, 3 hours, 100° C.).

EXAMPLE 22

A mixture of 490 grams of a product made in accordance with the procedure described in Example 1 and 111 grams of triphenyl phosphite are heated at a temperature of 100°–110° C. for 6 hours with stirring and nitrogen blowing at a rate of 0.1 cfh. The mixture is filtered using a filter aid to provide the desired product which has a sulfur content of 17.41% by weight, a phosphorus content of 1.8% by weight and a sodium content of 13.57% by weight.

EXAMPLE 23

Part A: A mixture of 1683 grams (1.5 equivalents) of a polyisobutenyl ($\overline{M}n$=950) succinimide derived from polyethylene diamine bottoms and 495 grams of diluent oil is heated to 80°–90° C. 115 grams (4.5 equivalents) of phosphoric acid are added over a one-hour period. The reaction mixture is heated to 180°–200° C. for 3–4 hours to remove 65 grams of water, then heated to 210° C. for 3 hours. The mixture is filtered using diatomaceous earth to provide 2430 grams of product which is in the form of a brown oil.

Part B: A mixture of 293 grams of a product made in accordance with the procedure described in Example 5 and 200 ml. of toluene are heated to 60°–70° C. 292 grams of the product from Part A of this example are added dropwise over a period of one hour. The reaction mixture is heated under reflux conditions for 2 hours. Solvent is stripped from the mixture using a vacuum. The mixture is filtered using diatomaceous earth to provide 560 grams of product which is in the form of a brown oil having a sulfur content of 8.35% by weight, a phosphorus content of 2.8% by weight and a sodium content of 8.46% by weight.

EXAMPLE 24

430 grams of a product made in accordance with the procedures described in Example 3 and having a sulfur content of 19.8% by weight and a sodium content of 15.7% by weight is heated to 150° C. with nitrogen blowing at a rate of 1 cfh. Steam is bubbled through the reaction mixture for 2.25 hours. The steam is turned off and the reaction mixture is cooled to 100° C. 10 grams of toluene are added. The mixture is heated to 155° C. for 0.5 hour under vacuum. The mixture is filtered using diatomaceous earth to provide 370 grams of the desired product. The product has a copper strip rating (ASTM D130) of 2E-3A (100° C., 3 hours, 5%).

EXAMPLE 25

A mixture of 1505 grams of a product made in accordance with the procedures described in Example 3 and having a sulfur content of 19.8% by weight and a sodium content of 15.7% by weight and 15.1 grams of activated carbon is heated to 150° C. with nitrogen blowing at a rate of 0.5 cfh. Air is bubbled through the reaction mixture at a flow rate of 1.5 cfh for 3.75 hours. The mixture is filtered using diatomaceous earth to provide 1230 grams of the desired product. The product has a copper strip rating (ASTM D130) of 2E (100° C., 3 hours, 5%).

EXAMPLE 26

A mixture of 1000 grams of a product prepared in accordance with the procedure described in Example 5 having a sulfur content of 21.8% by weight and 512 grams of a commercially available mixture of $C_{16-18}$ α-olefins is heated at 140°– 150° C. with stirring for 32 hours. The product is filtered using diatomaceous earth to provide 1430 grams of desired product. The product has a sulfur content of 10.86% by weight, a sodium content of 9.11% by weight and a copper strip rating (ASTM D130) of 1A (100° C., 3 hours, 5%).

EXAMPLE 27

A mixture of 435 grams of a product prepared in accordance with the procedure described in Example 5 having a sulfur content of 22% by weight and a sodium content of 16.9% by weight, and 29 grams of dibutyl phosphite is heated at 100° C. with stirring for 5 hours. The product is filtered using diatomaceous earth to provide 4 15 grams of desired product. The product has a sulfur content of 18.65% by weight, a sodium content of 15.38% by weight, a phosphorus content of 1.0% by weight and a copper strip rating (ASTM D130) of 1A (100° C., 3 hours, 5%).

EXAMPLE 28

A mixture of 867 grams of a product prepared in accordance with the procedure described in Example 5 having a sulfur content of 22.3% by weight and a sodium content of 15.5% by weight, and 145 grams of a diester derived from maleic anhydride and a commercially available mixture of $C_8$–$C_{10}$ alcohols is heated at 150° C. with stirring for 8–10 hours. The product is filtered using diatomaceous earth to provide 989 grams of desired product. The product has a sulfur content of 19.7% by weight, a sodium content of 13.6% by weight, and a copper strip rating (ASTM D130) of 2B (100° C., 3 hours, 5%).

EXAMPLE 29

A mixture of 282 grams of an overbased sodium thiosulfate made by simultaneously reacting 1 equivalent of the product from Example A-1 with 1 equivalent of $SO_2$ and 0.5 equivalent of elemental sulfur, and 115.8 grams of a product made by the reaction of polyisobutenyl ($\overline{M}n$=950) succinic anhydride with polyethyleneamine post-treated with boric acid is heated to 150° C. with stirring for 3 hours. The mixture is filtered using diatomaceous earth to provide 340 grams of product which is in the form of a brown oil. The product has a copper strip rating (ASTM D-130) of 3A (100° C., 3 hours, 5%).

EXAMPLE 30

A mixture of 268 grams of an overbased sodium thiosulfate made by simultaneously reacting 1 equivalent of the product from Example A-1 with 1 equivalent of $SO_2$ and 0.5 equivalent of elemental sulfur, and 112 grams of a product made by the reaction of polyisobutenyl ($\overline{M}n$=950) succinic anhydride with polyethyleneamine is heated to 150° C. with stirring for 3 hours. The mixture is filtered using diatomaceous earth to provide 310 grams of product which is in the form of a brown oil. The product has a copper strip rating (ASTM D-130) of 3B (100° C., 3 hours, 5%).

EXAMPLE 31

A mixture of 268 grams (1 equivalent) of an overbased sodium thiosulfate made by simultaneously reacting 1 equivalent of the product from Example A-1 with 1 equivalent of $SO_2$ and 0.5 equivalent of elemental sulfur, 76 grams (0.2 equivalent) of a product made by the reaction of maleic anhydride with oleylamine, and 100 ml. of xylene is heated to 150°–160° C. with stirring under a nitrogen blanket for 3–4 hours. Solvent is stripped from the reaction mixture using a vacuum. 50 grams of a 100 Neutral oil are added with stirring. The mixture is filtered using diatomaceous earth to provide 330 grams of product which is in the form of a brown oil. The product has a copper strip rating (ASTM D-130) of 1A (100° C., 3 hours, 5%).

EXAMPLE 32

A mixture of 134 grams of an overbased sodium thiosulfate made by simultaneously reacting 1 equivalent of the product from Example A-1 with 1 equivalent of $SO_2$ and 0.5 equivalent of elemental sulfur, 134 grams of a product made by the reaction of maleic anhydride with oleyl amine and 50 ml. of xylene is heated to 140°–150° C. with stirring for 4 hours. Solvent is stripped from the mixture using a vacuum. The mixture is filtered using diatomaceous earth to provide 100 grams of product which is in the form of a brown oil. The product has a copper strip rating (ASTM D-130) of 1B (100° C., 3 hours, 5%).

EXAMPLE 33

A mixture of 882 grams of an overbased sodium thiosulfate made by simultaneously reacting 1 equivalent of the product from Example A-1 with 1 equivalent of $SO_2$ and 0.4 equivalent of elemental sulfur, 235 grams of a product made by the reaction of maleic anhydride with hydroxy thioether of t-dodecyl mercaptan and propylene oxide post-treated with oleyl amine, and 200 ml. of xylene is heated to 150°–160° C. with stirring for 3–4 hours. Solvent is stripped from the mixture using a vacuum. The mixture is filtered using diatomaceous earth to provide 640 grams of product which is in the form of a brown oil. The product has a copper strip rating (ASTM D-130) of 1A (100° C., 3 hours, 5%).

EXAMPLE 34

A mixture of 1029 grams of an overbased sodium thiosulfate made by simultaneously reacting 1 equivalent of the product from Example A-1 with 1 equivalent of $SO_2$ and 0.4 equivalent of elemental sulfur, 235 grams of a product made by the reaction of maleic anhydride with Ethomeen S/12 (a product of Armak identified as bis-(2-hydroxyethyl) soyaamine) at a 1:1 molar ratio, and 200 ml. of xylene is heated to 150°–160° C. with stirring for 3–4 hours. Solvent is stripped from the mixture using a vacuum. The mixture is filtered using diatomaceous earth to provide 1040 grams of product which is in the form of a brown paste. The product has a copper strip rating (ASTM D-130) of 2B (100° C., 3 hours, 5%).

EXAMPLE 35

A mixture of 1029 grams of an overbased sodium thiosulfate made by simultaneously reacting 1 equivalent of the product from Example A-1 with 1 equivalent of $SO_2$ and 0.4 equivalent of elemental sulfur, 270 grams of a product made by the reaction of maleic anhydride with 2-ethylhexylamine at a 1:1 molar ratio which is post-treated with dodecylbenzotriazole at a 1:1 molar ratio, and 200 ml. of xylene is heated to 150°–160° C. with stirring for 3–4 hours. Solvent is stripped from the mixture using a vacuum. The mixture is filtered using diatomaceous earth to provide 1148 grams of product which is in the form of a brown oil. The product has a copper strip rating (ASTM D-130) of 1A (100° C., 3 hours, 5%).

EXAMPLE 36

A mixture of 1029 grams of an overbased sodium thiosulfate made by simultaneously reacting 1 equivalent of the product from Example A-1 with 1 equivalent of $SO_2$ and 0.4 equivalent of elemental sulfur, 250 grams of a product made by the reaction of maleic anhydride with Propomeen T/12 (a product of Azko identified as bis-(2-hydroxypropyl) tallowamine) at a 1:1 molar ratio, and 200 ml. of xylene is heated to 150°–160° C. with stirring for 3–4 hours. The mixture is filtered using diatomaceous earth to provide 1090 grams of product which is in the form of a brown oil. The product has a copper strip rating (ASTM D-130) of 1A (100° C., 3 hours, 5%).

Sulfurized Overbased Product/Non-Sulfurized Boron-Containing Overbased Product Combinations:

When the sulfurized overbased products are made using the overbased products (A), the inventive compositions can also include at least one non-sulfurized boron-containing overbased product. The non-sulfurized boron-containing overbased product can be any of the boron-containing overbased products (A') discussed above. These compositions can be prepared using standard mixing procedures. The weight ratio of the non-sulfurized boron-containing overbased product to the sulfurized overbased product preferably ranges up to about 20:1, more preferably up to about 10:1, more preferably up to about 5:1. In one embodiment, the ratio is from about 20:1 to about 1:20, more preferably about 10:1 to about 1:10, more preferably about 5:1 to about 1:5, more preferably about 2:1 to about 1:2, and advantageously about 1:1.

The mixing time is typically from a few seconds up to about 20 hours. The mixing temperature is generally from about room temperature up to the decomposition temperature of the reactants or desired products having the lowest such temperature, preferably from about 20° C. to about 150° C. These ingredients are typically mixed or blended together during the preparation of the concentrates, lubricants or functional fluids as discussed in greater detail below.

The following example is illustrative of the sulfurized overbased product/non-sulfurized boron-containing overbased product combinations of the invention.

EXAMPLE 37

The following compositions are mixed together at room temperature.

| | Wt. % |
|---|---|
| Product of Ex. 5 | 50 |
| Product of Ex. A-44 | 50 |

The inventive sulfurized overbased compositions are useful as additives in normally liquid fuels, lubricants and functional fluids. Lubricants and functional fluids containing the sulfurized overbased compositions of the present invention exhibit improved EP, anti-wear and/or antioxidant properties. The fuels exhibit improved anti-wear and/or antioxidant properties. The functional fluids can be oil-based or water-based.

Oil-Based Concentrates, Lubricating Compositions and Oil-Based Functional Fluids:

The oil-based lubricant and functional fluid compositions of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions containing the sulfurized overbased compositions of the invention are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metalworking lubricants, hydraulic fluids, and other lubricating oil and grease compositions can benefit from the incorporation of the sulfurized overbased products of this invention. The lubricating compositions are particularly effective as gear oil lubricants and the functional fluids are particularly effective as cutting fluids.

The lubricants and functional fluid compositions of this invention employ an oil of lubricating viscosity which is generally present in a major amount (i.e. an amount greater than about 50% by weight). Preferably, the oil of lubricating viscosity is present in an amount greater than about 60%, or greater than about 70%, or greater than about 80% by weight of the composition. In one embodiment, the oil of lubricating viscosity is present in an amount greater than about 90% by weight.

In one embodiment, the sulfurized overbased products of the present invention are used in gear oil and advantageously the use of other phosphorus-containing extreme pressure and/or antiwear agents is avoided. These gear oil compositions generally contain less than about 0.5%, or less than about 0.25%, or less than about 0.1% by weight phosphorus, and in one embodiment, less than about 0.05% by weight phosphorus.

In one embodiment, the oil of lubricating viscosity is selected to provide a lubricating composition having a kinematic viscosity of at least about 3.5, or at least about 4.0 cSt at 100° C. In one embodiment, the oil of lubricating viscosity is selected to provide a lubricating composition of at least an SAE gear oil viscosity number of about 60 or about 65, more preferably about SAE 75. The lubricating composition may also have a so-called multigrade rating such as SAE 60W-80, 65W-80, 65W-90, 75W-80, 75W-90, 80W-90, 80W-140 or 85W-140. Multigrade lubricants may include a minor viscosity improving amount of a viscosity improver which is formulated with the oil of lubricating viscosity to provide the above lubricant grades. Useful viscosity improvers include polyolefins, such as polybutylene; rubbers, such as styrene-butadiene or styrene-isoprene; or polyacrylates, such as polymethacrylates. Useful viscosity improvers that are available commercially include Acryloid viscosity improvers available from Rohm& Haas; Shellvis rubbers available from Shell Chemical; and Lubrizol 3174 available from The Lubrizol Corporation.

In another embodiment, the oil of lubricating viscosity is selected to provide lubricating compositions with crankcase applications such as for gasoline and diesel engines. Typically, the lubricating compositions are selected to provide an SAE crankcase viscosity number of 10W, 20W or 30W grade lubricants. The lubricating compositions may also have a so-called multi-grade rating such as SAE 10W-30, 10W-40, 10W-50, etc. As described above, the multi-grade lubricants include a viscosity improver which is formulated with the oil of lubricating viscosity to provide the above lubricant grades.

Generally, the lubricants and functional fluids of the present invention contain an amount of the inventive sulfurized overbased product which is sufficient to provide the lubricants and functional fluids with the desired properties such as improved antioxidant, extreme pressure, thermal stability and/or anti-wear properties. Normally, this amount of additive will be from about 0.01 to about 20% by weight of the total weight of the lubricant or functional fluid. In one embodiment, the sulfurized overbased product is present in an amount from about 0.5%, or about 1%, or about 2% up to about 10%, or to about 8%, or to about 7% by weight of a lubricating composition or functional fluid. In lubricating compositions operated under extremely adverse conditions, such as lubricating compositions for marine diesel engines, the sulfurized overbased products of this invention may be present in amounts up to about 30% by weight, or more, of the total weight of the lubricating composition.

The sulfurized overbased products of this invention can be added directly to the lubricants, functional fluids and fuels, or they can be diluted with a substantially inert, normally liquid organic solvent/diluent such as naphtha, benzene, toluene, xylene or a normally liquid fuel as described above, to form an additive concentrate. These concentrates generally contain from about 0.01%, or about 1% or about 5%, or about 10% by weight to about 70%, or about 80% or about 90% by weight of the sulfurized overbased products of this invention and may contain, in addition, one or more other conventional additives known in the art or described herein.

In one embodiment, the sulfurized overbased products are used in metal working operations. Metal working operations include cutting and forming operations. The cutting operations include drilling, tapping, broaching, punching, and milling. Forming operations include bending, stamping, rolling, and pressing. The operations are conducted on ferrous or non-ferrous metals. Examples of metals and alloys include steel, copper, aluminum, bronze, brass and titanium. Typically, the overbased sulfurized products are used in an amount from about 1%, or about 2%, or about 3% up to about 20%, or to about 15%, or to about 10%, or to about 8% by weight of the metal working lubricant. The metal working lubricant contains an oil of lubricating viscosity and usually, contains a low viscosity mineral oil, such as those having a kinematic viscosity, up to about 5, or up to about 4.5 cSt at 100° C. The metal working lubricant contains a metal working base fluid. The metal working base fluids include the oils of lubricating viscosity described above. In one embodiment, the oils of lubricating viscosity are 100 neutral or 200 neutral, preferably 100 neutral base oils.

NATURAL AND SYNTHETIC OILS

The natural oils useful in making the inventive lubricants and functional fluids include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof; alkyl-benzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl) silicate, hexyl-(4-methyl-2-pentoxy)disiloxane, poly(methyl) siloxanes, poly-(methylphenyl)siloxanes, etc.). Other synthetic lubricating oils include liquid esters of phosphorus-containing acids (e.g., tricresyl phosphate, trioctyl phosphate, diethyl ester of de, cane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting Operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

METAL DEACTIVATORS

In one embodiment, the sulfurized overbased products of the present invention is used in combination with at least one metal deactivator. In this embodiment, the metal deactivator is present in an inventive lubricant or functional fluid composition in an amount sufficient to provide a metal deactivating effect. The metal deactivator is present in the inventive lubricating composition or functional fluid at a level of up to about 20% by weight, preferably up to about 10% by weight, based on the total weight of the lubricant or functional fluid. Typically, the metal deactivator is present at a level of about 0.01%, or about 0.05%, or about 0.08% by weight up to about 2%, or about 1%, or about 0.5% by weight based on the weight of the lubricating composition or functional fluid.

The metal deactivators that are useful herein reduce the corrosion of metals, such as copper. Metal deactivators are also referred to as metal passivators. These metal deactivators are typically nitrogen and/or sulfur containing heterocyclic compounds, such as dimercaptothiadiazoles, triazoles, amino-mercaptothiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, and derivatives of any one or more thereof. The metal deactivator preferably comprises at least one triazole which may be substituted or unsubstituted. Examples of suitable compounds are benzotriazole, alkyl-substituted benzotriazole (e.g., tolyltriazole, ethylbenzotriazole, hexylbenzotriazole, octylbenzotriazole, etc.), aryl-substituted benzotriazole (e.g., phenol benzotriazoles, etc.), and alkylaryl- or arylalkyl-substituted benzotriazole and substituted benzotriazoles where the substituent may be hydroxy, alkoxy, halo (especially chloro), nitro, carboxy and carboxyalkoxy. Preferably, the triazole is a benzotriazole or an alkylbenzotriazole in which the alkyl group contains 1 to about 20 carbon atoms, preferably 1 to about 8 carbon atoms. Benzotriazole and tolyltriazole are useful.

In one embodiment, the metal deactivator is the reaction product of a dispersant with a dimercaptothiadiazole. The dispersants may be generally characterized as the reaction products of carboxylic acids with amines and/or alcohols. These reaction products are commonly used in the lubricant arts as dispersants and are sometimes referred to generically as dispersants despite the fact that they may have other uses in addition to or instead of that as dispersants. The carboxylic dispersants include succinimide dispersants, ester type dispersants and the like. Succinimide dispersants are generally the reaction of a polyamine with an alkenyl succinic anhydride or acid. Ester type dispersants are the reaction product of an alkenyl succinic anhydride or acid with a polyol compound. The reaction product may then be further treated with an amine such as a polyamine. Examples of useful dispersants are disclosed in U.S. Pat. Nos. 3,219,666 and 4,234,435 which are incorporated herein by reference. Useful dispersants also include the ashless dispersants discussed below under the heading "Detergents and Dispersants". Generally the reaction occurs between the dispersant and the dimercaptothiadiazole by mixing the two and heating to a temperature above about 100° C. U.S. Pat. Nos. 4,140,643 and 4,136,043 describe compounds made by the reaction of such dispersants with a dimercaptothiadiazole. These patents are incorporated herein by reference for their disclosure of dispersants, dimercaptothiadiazole, the method for reacting the two and the products obtained from such reaction.

In one embodiment, the metal deactivator is the reaction product of a phenol with an aldehyde and a dimercaptothiadiazole. The phenol is preferably an alkyl phenol wherein the alkyl group contains at least about 6, preferably from 6 to about 24, more preferably about 6, or about 7, to about 12 carbon atoms. The aldehyde is preferably an aldehyde containing from 1 to about 7 carbon atoms or an aldehyde synthon, such as formaldehyde. Preferably, the aldehyde is formaldehyde or paraformaldehyde. The aldehyde, phenol and dimercaptothiadiazole are typically reacted by mixing them at a temperature up to about 150° C., preferably about 50° C. to about 130° C., in molar ratios of about 0.5 to about 2 moles of phenol and about 0.5 to about 2 moles of aldehyde per mole of dimercaptothiadiazole. Preferably, the three reagents are reacted in equal molar amounts.

In one embodiment, the metal deactivator is a bis(hydrocarbyldithio)thiadiazole. Preferably each hydrocarbyl group is independently an alkyl, aryl or aralkyl group, having from 6 to about 24 carbon atoms. Each hydrocarbyl can be independently t-octyl, nonyl, decyl, dodecyl or ethylhexyl. The metal deactivator can be bis-2,5-tert-octyl-dithio-1,3,4-thiadiazole or a mixture thereof with 2-tert-octyl-thio-5-mercapto-1,3,4-thiadiazole. These materials are available commercially under the trade name of Amoco 150 which is available from Amoco Chemical Company. These dithiothiadiazole compounds are disclosed as Component (B) in PCT Publication WO 88/0355 1 which is hereby incorporated by reference for its disclosure of dithiothiadiazole compounds.

The metal deactivator may also be the reaction product of a benzotriazole with at least one amine. The amine can be one or more mono or polyamines. These monoamines and polyamines can be primary amines, secondary amines or tertiary amines. Useful amines include those amines disclosed in U.S. Pat. No. 4,234,435 at Col. 21, line 4 to Col. 27, line 50, these passages being incorporated herein by reference.

The monoamines generally contain from 1 to about 24 carbon atoms, with 1 to about 12 carbon atoms being more preferred, with 1 to about 6 being more preferred. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

The polyamines may be aliphatic, cycloaliphatic, heterocyclic or aromatic. Examples of the polyamines include alkylene polyamines and heterocyclic polyamines. The alkylene polyamines can be represented by the formula

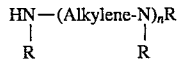

wherein n has an average value between about 1 and about 10, preferably about 2 to about 7, the "Alkylene" group has from 1 to about 10 carbon atoms, preferably about 2 to about 6 carbon atoms, and R is an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the afore-described polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines. Ethylene polyamine mixtures are useful.

The amine may also be a heterocyclic polyamine. Among the heterocyclic polyamines are aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

These alkylene polyamine bottoms can be reacted solely with the acylating agent, in which case the amino reactant consists essentially of alkylene polyamine bottoms, or they can be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols contain from 2 to about 10, preferably 2 to about 6, preferably 2 to about 4 hydroxyl groups and up to 40 aliphatic carbon atoms, preferably from 2 to about 30, more preferably 2 to about 10. The polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and penterythritols, including di- and tripentaerythritol. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric mines include tri-(hydroxypropyl)amine,tris-(hydroxymethyl)aminomethane,2-amino-2-methyl- 1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM).

Polyamine reactants, which react with the polyhydric alcohol or amine to form the condensation products or condensed amines, are described above. Preferred polyamine reactants include triethylenetetramine GRETA), tetraethylenepentamine (TEPA), pentaethylenehexamine (PEHA), and mixtures of polyamines such as the above-described "amine bottoms".

The condensation reaction of the polyamine reactant with the hydroxy compound is preferably conducted at an elevated temperature, usually about 60° C. to about 265° C., preferably about 220° C. to about 250° C., in the presence of an acid catalyst.

The amine condensates and methods of making the same are described in PCT publication WO86/05501 which is incorporated by reference for its disclosure to the condensates and methods of making. The preparation of such polyamine condensates is exemplified by Example M-1 as follows.

EXAMPLE M-1

A mixture of 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and 727 grams of 40% aqueous tris(hydroxymethyl)aminomethane (THAM) is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230°–235° C. for 5 hours, then heated to 240° C. over 0.75 hour, and then held at 240°–245° C. for 5 hours. The mixture is cooled to 150° C. and filtered with a diatomaceous earth filter aid to provide 1221 grams of the desired product.

The metal deactivator may also be the reaction product of a triazole and at least one compound selected from acylated nitrogen compounds (described above as carboxylic dispersants), hydrocarbyl substituted amines (described below as amine dispersants) and Mannich reaction products (described below as Mannich dispersants).

The acylated nitrogen compounds include reaction products of amines with carboxylic acylating agents such as those described above under the heading "Carboxylic Acids (A)(I)(a)". The amines that are useful are described above as being reactive with benzotriazole to form metal deactivators. Typically the amines are polyamines, preferably the amines are ethylene amines, amine bottoms or amine condensates.

The hydrocarbyl-substituted amines, which may be reacted with a triazole, are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Typically, hydrocarbyl-substituted amines are prepared by reacting olefins and olefin polymers (polyalkenes) with amines (mono- or polyamines). The polyalkene may be any of the polyalkenes described above under the heading "Carboxylic Acids (A) (I) (a)". The amines may be any of the amines described above as being reactive with benzotriazole to form metal deactivators. Examples of these substituted amines include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-polybutene)ethylenediamine; N-poly(propylene)trimethylenediamine; N-polybutene)diethylenetriamine; N',N'-poly(butene)tetraethylenepentamine; N,N-dimethyl-N'-poly(propylene)-1,3-propylenediamine and the like.

The triazole may also be reacted with a Mannich reaction product. Mannich reaction products are formed by the reaction of at least one aldehyde, at least one of the above described amines and at least one hydroxyaromatic compound, such as a phenol. The reaction may occur from room temperature to about 225° C., usually from about 50° C. to about 200° C., preferably about 75° C. to about 125° C., with the amounts of the reagents being such that the molar ratio of hydroxyaromatic compound to formaldehyde to amine is in the range from about (1:1:1) to about (1:3:3). Useful Mannich reaction products are described in the following patents: U.S. Pat. Nos. 3,980,569; 3,877,899; and 4,454,059. These patents are incorporated by reference for their disclosure of Mannich reaction products, also referred to as Mannich dispersants.

The triazole-amine, triazole-acylated amine, triazole-hydrocarbyl substituted amine and triazole-Mannich reaction products may be prepared by blending the reagents and allowing the reaction to proceed. The reaction may occur at a temperature in the range of about 15° C. to about 160° C., with temperatures in the range of about 60° C. to about 140° C. being preferred. The triazole-amine, triazoleacylated nitrogen compound, triazole-hydrocarbyl substituted amine and triazole-Mannich reaction products may be reacted in any proportion but are preferably reacted at an equal equivalent ratio.

Phosphorus-Containing Antiwear Agents:

In one embodiment, the sulfurized overbased product of the invention is used in combination with at least one phosphorus-containing antiwear agent. In this embodiment, the phosphorus-containing antiwear agent is present in the inventive lubricants and functional fluids in a sufficient amount to impart antiwear properties to said lubricants and functional fluids. The phosphorus-containing antiwear agent is typically present in the inventive lubricants and functional fluids at a level of up to about 20% by weight, preferably up to about 10% by weight, based on the total weight of the lubricant or functional fluid. Typically, the phosphorus-containing antiwear agent is present in the inventive lubricants and functional fluids at a level of about 0.01%, or about 0.05%, or about 0.08% by weight up to about 2%, or about 1% or about 0.5% by weight.

The phosphorus-containing antiwear agents that are useful herein include phosphorus acid, phosphorus acid ester, phosphorus acid salt, or derivatives thereof. The phosphorus acids include the phosphoric, phosphonic, phosphinic and thiophosphoric acids including dithiophosphoric acid as well as the monothiophosphoric, thiophosphinic and thiophosphonic acids.

In one embodiment, the phosphorus-containing antiwear agent is a phosphorus acid ester prepared by reacting a phosphorus acid or anhydride with an alcohol containing from 1 or about 3 carbon atoms up to about 30, or about 24, or about 12 carbon atoms. The phosphorus acid or anhydride is generally an inorganic phosphorus reagent such as phosphorus pentaoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

Alcohols used to prepare the phosphorus acid esters include butyl, amyl, hexyl, octyl, oleyl, and cresol alcohols. Higher synthetic monohydric alcohols of the type formed by Oxo process (e.g., 2-ethylhexyl), the Aldol condensation, or by organo aluminum catalyzed oligomerization of alpha-olefins (especially ethylene), followed by oxidation and hydrolysis, also are useful. Examples of some preferred monohydric alcohols and alcohol mixtures include the commercially available "Alfol" alcohols marketed by Continental Oil Corporation. Alfol 810 is a mixture of alcohols containing primarily straight chain, primary alcohols having from 8 to 10 carbon atoms. Alfol 12 is a mixture of alcohols containing mostly $C_{12}$ fatty alcohols. Alfol 1218 is a mixture of synthetic, primary, straight-chain alcohols containing primarily 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols containing primarily, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.595 of $C_{10}$ alcohol, 66.095 of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example is tricresol phosphate.

In one embodiment, the phosphorus acid ester is a monothiophosphoric acid ester or a monothiophosphate. Monothiophosphates are prepared by the reaction of a sulfur source and a dihydrocarbyl phosphite. The sulfur source may be elemental sulfur or one or more of the sulfur compounds described above under the heading "Sulfur or Sulfur Source (B)". The sulfur source may be a monosulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638 which are incorporated herein by reference for their disclosure of monothiophosphates, sulfur sources for preparing monothiophosphates and the process for making monothiophosphates.

Monothiophosphates may also be formed in the lubricant blend by adding a dihydrocarbyl phosphite to a lubricating composition containing a sulfur source. The phosphite may react with the sulfur source under blending conditions (i.e., temperatures from about 30° C. to about 100° C. or higher) to form the monothiophosphate. It is also possible that the monothiophosphate is formed under the conditions found when the lubricating composition is in an operating engine.

In one embodiment, the phosphorus containing antiwear agent is a dithiophosphoric acid or phosphorodithioic acid. The dithiophosphoric acid can be reacted with an epoxide or a glycol to form an intermediate. The intermediate is then reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecane oxide, styrene oxide, etc. Propylene oxide is preferred. The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like. These are described in U.S. Pat. No. 3,197,405 which is incorporated herein by reference for its disclosure of dithiophosphoric acids, glycols, epoxides, inorganic phosphorus reagents and methods of reacting the same.

The following Examples P-1 and P-2 exemplify the preparation of useful phosphorus acid esters.

EXAMPLE P-1

64 grams of phosphorus pentoxide are added at 58° C. over a period of 45 minutes to 514 grams of hydroxypropyl O,O-di(4-methyl-2-pentyl)phosphorodithioate (prepared by reacting di(4-methyl-2pentyl)-phosphorodithioic acid with 1.3 moles of propylene oxide at 25° C.). The mixture is heated at 75° C. for 2.5 hours, mixed with a diatomaceous earth filtering aid, and filtered at 70° C. The filtrate has a phosphorus content of 11.8% by weight, a sulfur content of 15.2% by weight, and an acid number of 87 (bromophenol blue indicator).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate has 15.3% by weight phosphorus content, a 19.6% by weight sulfur content, and an acid number of 126 (bromophenol blue indicator).

When the phosphorus acid esters are acidic, they may be reacted with an amine compound or metallic base to form the corresponding amine or metal salt. The salts may be formed separately and then the salt of the phosphorus acid ester is added to the lubricating composition. Alternatively, the salts may also be formed when the phosphorus acid ester is blended with other components to form the lubricating composition. The phosphorus acid ester could then form salts with basic materials which are in the lubricating composition functional such as basic nitrogen containing compounds (e.g., carboxylic dispersants) and overbased materials.

The amine salts of the phosphorus acid esters may be formed from ammonia, or a primary, secondary or tertiary amine, or mixtures thereof. The primary amines are described above under the heading "Metal Deactivators".

Secondary amines include dialkylamines having two of the above alkyl groups described for primary amines including such commercial fatty secondary amines as Armeen amines described above and also mixed dialkylamines where, for example, one alkyl group is a fatty amine and the other alkyl group may be a lower alkyl group (1–7 carbon atoms) such as methyl, ethyl, n-propyl, i-propyl, butyl, etc., or the other alkyl group may be an alkyl group bearing other non-reactive or polar substituents (CN, alkyl, carboxy, amide, ether, thioether, halo, sulfoxide, sulfone) such that the essentially hydrocarbon character of the group is not destroyed.

Other useful primary amines are the primary ether amines $R''OR'NH_2$ wherein R' is a divalent alkylene group having about 2 to about 6 carbon atoms and R" is a hydrocarbyl group of about 5 to about 150 carbon atoms. These primary ether amines are generally prepared by the reaction of an alcohol R"OH with an unsaturated nitrile. The R" group of the alcohol can be a hydrocarbyl group having up to about 150 carbon atoms. Typically, and for efficiency and economy, the alcohol is a linear or branched aliphatic alcohol with R" having up to about 50 carbon atoms, preferably up to about 26 carbon atoms, more preferably about 6 to about 20 carbon atoms. The nitrile reactant can have from about 2 to about 6 carbon atoms with acrylonitrile being preferred. Ether amines are known commercial products which are available under the name SURFAM® produced and marketed by Mars Chemical Company, Atlanta, Ga. Typical of such amines are those having from about 150 to about 400 molecular weight. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14,}$ etc.) of the SURFAMS described above and used hereinafter are approximate and include the oxygen ether linkage. For example, a $C_{14}$ SURFAM would have the following general formula $C_{10}H21OC_3H_6NH_2$.

The amines used to form the amine salts may be hydroxyamines. In one embodiment, these hydroxyamines can be represented by the formula

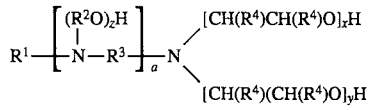

wherein: $R^1$ is a hydrocarbyl group generally containing from about 6 to about 30 carbon atoms; $R^2$ is an ethylene or propylene group; $R^3$ is an alkylene group containing up to about 5 carbon atoms; a is zero or one; each $R^4$ is hydrogen or a lower alkyl group; and x, y and z are each independently from zero to about 10, with the proviso that at least one of x, y or z is at least 1.

These hydroxyamines can be prepared by techniques well known in the art and many such hydroxyamines are commercially available. For example, primary amines containing at least about 6 carbon atoms can be reacted with various amounts of alkylene oxides such as ethylene oxide, propylene oxide, etc. The primary amines include mixtures of amines such as obtained by the hydrolysis of fatty oils (e.g., tallow oils, sperm oils, coconut oils, etc.). Specific examples of fatty amines containing from about 6 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

Useful hydroxyamines wherein a in the above formula is zero include 2-hydroxyethylhexylamine, 2-hydroxyethyloctylamine, 2-hydroxyethylpentadecylamine, 2-hydroxyethyloleylamine,2-hydroxyethylsoyamine,bis(2-hydroxyethyl-)hexylamine, bis(2-hydroxyethyl)oleylamine, and mixtures thereof. Also included are the comparable members wherein in the above formula at least one of x and y is at least 2, as for example, 2-hydroxyethoxyethylhexylamine.

A number of hydroxyamines wherein a in the above formula is zero are available from the Armak Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleyl amine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

Commercially available examples of alkoxylated amines where a in the above formula is 1 include Ethoduomeen T/13 and T/20 which are ethylene oxide condensation products of N-tallow trimethylene diamine containing 3 and 10 moles of ethylene oxide per mole of diamine, respectively.

The fatty polyamine diamines include mono- or dialkyl, symmetrical or asymmetrical ethylene diamines, propane diamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available diamines described in Product Data Bulletin No. 7-10R1 of Armak Chemical Co., Chicago, Ill. In one embodiment, the secondary amines may be cyclic amines such as piperidine, piperazine, morpholine, etc.

The metal salts of the phosphorus acid esters are prepared by the reaction of a metal base with the phosphorus acid ester. The metal base may be in any convenient form such as oxide, hydroxide, carbonate, sulfate, borate, or the like. The metals of the metal base include Group IA, IIA, IB through VIIB and VIII metals (CAS version of the Periodic Table of the Elements). These metals include the alkali metals, alkaline earth metals and transition metals. In one embodiment, the metal is a Group IIA metal such as calcium or magnesium, Group IIB metal such as zinc, or a Group VIIB metal such as manganese. Preferably the metal is magnesium, calcium, manganese or zinc, more preferably magnesium, calcium or zinc, more preferably magnesium or zinc. Specific examples of useful metal bases include those described above under the heading "Metal Base (A)(III)".

The following Examples P-3 to P-6 exemplify the preparation of useful phosphorus acid ester salts.

EXAMPLE P-3

To 217 grams of the filtrate from Example P-1 there is added at 25°–60° C. over a period of 20 minutes, 66 grams of a commercial aliphatic primary amine having an average molecular weight of 191 in which the aliphatic radical is a mixture of tertiaryalkyl radicals containing from 11 to 14 carbon atoms. The resulting product has a phosphorus content of 10.2% by weight, a nitrogen content of 1.5% by weight, and an acid number of 26.3.

EXAMPLE P-4

1752 grams of the filtrate from Example P-2 are mixed at 25°–82° C. with 764 grams of the aliphatic primary amine used in of Example P-3. The resulting product has a phosphorus content of 9.95% by weight, a nitrogen content of 2.72% by weight nitrogen, and a sulfur content of 12.6% by weight.

EXAMPLE P-5

(a) 852 grams of phosphorus pentoxide are added to 2340 grams of iso-octyl alcohol over a period of 3 hours. The temperature increases from room temperature but is maintained below 65° C. After the addition is complete the mixture is heated to 90° C. and maintained at that temperature for 3 hours. 30 grams of a siliceous filter aid are added, and the mixture is filtered. The filtrate has a phosphorus content of 12.4% by weight, an acid neutralization number to bromophenol blue of 192 and an acid neutralization number to phenolphthalein of 290.

(b) The filtrate from part (a) is mixed with 200 grams of toluene, 130 grams of mineral oil, 1 gram of acetic acid, 10 grams of water and 45 grams of zinc oxide and heated to 60°–70° C. at a pressure of 30 torr. The resulting product mixture is filtered using a siliceous filter aid. The filtrate has zinc content of 8.58% by weight and a phosphorus of 7.03% by weight.

EXAMPLE P-6

208 grams of phosphorus pentoxide are added to the product prepared by reacting 280 grams of propylene oxide with 1184 grams of O,O'-di-isobutylphosphorodithioic acid at 30°–60° C. The addition is made at a temperature of 50°–60° C. and the resulting mixture is then heated to 80° C. and held at that temperature for 2 hours. 384 grams of the commercial aliphatic primary amine identified in Example P-3 is added while maintaining the temperature in the range of 30°–60° C. The reaction mixture is filtered. The filtrate has a phosphorus content of 9.31% by weight, a sulfur content of 11.37% by weight sulfur, a nitrogen content of 2.50% by weight, and a base number of 6.9 (bromphenol blue indicator).

The phosphorus-containing antiwear agent may also be a phosphite. In one embodiment, the phosphite is a di- or trihydrocarbyl phosphite. Preferably each hydrocarbyl group has from 1 to about 24 carbon atoms, more preferably from 1 to about 18 carbon atoms, and more preferably from about 2 to about 8 carbon atoms. Each hydrocarbyl group may be independently alkyl, alkenyl or aryl. When the hydrocarbyl group is an aryl group, then it contains at least about 6 carbon atoms; preferably about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, napthyl, heptylphenol, etc. Preferably each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Particularly useful phosphites are dibutylhydrogen phosphite, trioleyl phosphite and triphenyl phosphite.

In one embodiment, the phosphorus-containing antiwear agent may be a phosphorus-containing amide. The phosphorus-containing amides may be prepared by the reaction of a phosphorus acid, preferably a dithiophosphoric acid, as described above, with an unsaturated amide. Examples of unsaturated amides include acrylamide, N,N'-methylene bisacrylamide, methacrylamide, crotonamide, and the like. The reaction product of the phosphorus acid with the unsaturated amide may be further reacted with linking or coupling compounds, such as formaldehyde or paraformaldehyde to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

The following Examples P-7 and P-8 exemplify the preparation of useful phosphorus containing amides.

EXAMPLE P-7

1017 grams of O,O'-di-4-methyl-2-pentyl phosphorodithioic acid are added under nitrogen to 213 grams of acrylamide. The reaction exotherms to 65° C. and is held for 1–3 hours at 65°–75° C. The product mixture is filtered through diatomaceous earth. The filtrate, which is the desired product, has a phosphorus content of 7.65% by weight, a nitrogen content of 3.51% by weight and a sulfur content of 16.05% by weight.

EXAMPLE P-8

To a mixture of 1494 grams of O,O'-di-isooctyl phosphorodithioic acid and 800 grams of toluene are added under nitrogen 537 grams of a 50% by weight aqueous acrylamide solution over a period of one hour. The reaction mixture exotherms to about 53° C. 64 parts of paraformaldehyde and 18 grams of p-toluenesulfonic hydrate are added. The mixture is heated at reflux (91°–126° C.) for 4 hours while collecting 305 grams of water. The mixture is cooled to 90° C. and 7.6 grams of a 50% by weight aqueous sodium hydroxide solution are added. Cooling is continued to about 30° C. and a vacuum is applied (15 mm Hg). Toluene solvent is removed while raising the temperature to 110° C. The residue is filtered through diatomaceous earth and the filtrate is the desired product. The product has a phosphorus of 6.90% by weight and a nitrogen content of 2.92% by weight.

In one embodiment, the phosphorus-containing antiwear agent is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol.

The vinyl ester of a carboxylic acid may be represented by the formula RCH=CH—O(O)CR$^1$ wherein R is a hydrogen or hydrocarbyl group having from 1 to about 30 carbon atoms, preferably hydrogen or a hydrocarbyl group having 1 to about 12, more preferably hydrogen, and R$^1$ is a hydrocarbyl group having 1 to about 30 carbon atoms, preferably i to about 12, more preferably I to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula RO—(O)CH—HC=CH—C(O)OR wherein each R is independently a hydrocarbyl group having 1 to about 18 carbon atoms, preferably 1 to about 12, more preferably 1 to about 8 carbon atoms.

Examples of unsaturated carboxylic esters, useful in the present invention, include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus-containing antiwear agent is the reaction product of a phosphorus acid and a vinyl ether. The vinyl ether is represented by the formula R—CH$_2$=CH—OR$^1$ wherein R is hydrogen or a hydrocarbyl group having 1 to about 30, preferably 1 to about 24, more preferably 1 to about 12 carbon atoms, and R$^1$ is a hydrocarbyl group having 1 to about 30 carbon atoms, preferably 1 to about 24, more preferably 1 to about 12 carbon atoms. Examples of vinyl ethers include vinyl methylether, vinyl propylether, vinyl 2-ethylhexylether and the like.

DETERGENTS AND DISPERSANTS

The inventive lubricating compositions and functional fluids can contain one or more detergents or dispersants of the ash-producing or ashless type. The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium. These ash-producing detergents are described in greater detail above as being among the overbased products (A) used in preparing the sulfurized overbased products of the invention.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent 1,306,529 and in many U.S. patents including the following:

| | | |
|---|---|---|
| 3,163,603 | 3,351,552 | 3,541,012 |
| 3,184,474 | 3,381,022 | 3,543,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | 4,234,435 |
| 3,346,493 | 3,522,179 | 4,938,881 |
| | | Re 26,433 |

(2) Reaction products of relatively high molecular weight aliphatic or alicyclic halides with amines, preferably oxyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl group contains at least about 30 carbon atoms with aldehydes (especially formaldehyde) and amines (especially polyalkylene polyamines), which may be characterized as Mannich dispersants". The materials described in the following U.S. patents are illustrative:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(4) products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |

-continued

| | | | |
|---|---|---|---|
| 3,280,234 | 3,455,831 | 3,591,598 | 3,704,308 |
| 3,281,428 | 3,455,832 | 3,600,372 | 3,708,422 |

(5) interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

AUXILIARY EXTREME-PRESSURE AND/OR ANTIWEAR, CORROSION-INHIBITING AND OXIDATION-INHIBITING AGENTS

The inventive lubricating compositions and functional fluids can contain one or more extreme pressure and/or antiwear agents, corrosion inhibitors and/or oxidation inhibitors. Auxiliary extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Group II metal phosphorodithioates such as zinc dicyclohexylphosphorodithioate, zincdioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

ADDITIONAL ADDITIVES

The inventive lubricating compositions and functional fluids can contain one or more pour point depressants, color stabilizers and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

GREASES

The lubricant compositions of the present invention may be in the form of a grease in which any of the above-described oils of lubricating viscosity can be employed as a vehicle. Where the lubricant is to be used in the form of a grease, the lubricating oil generally is employed in an amount sufficient to balance the total grease composition and generally, the grease compositions will contain various quantifies of thickening agents and other additive components to provide desirable properties. Generally, the greases will contain from about 0.01 to about 20% or 30% by weight of the sulfurized overbased products of the invention.

A wide variety of thickening agents can be used in the preparation of the greases of this invention. Included among the thickening agents are alkali and alkaline earth metal soaps of fatty acids and fatty materials having from about 12 to about 30 carbon atoms. The metals are typified by sodium, lithium, calcium and barium. Examples of fatty materials include stearic acid, hydroxy stearic acid, stearin, oleic acid, palmitic acid, myristic acid, cottonseed oil acids, and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Particularly useful thickening agents employed in the grease compositions are essentially hydrophilic in character, but which have been converted into a hydrophobic condition by the introduction of long chain hydrocarbon radicals onto the surface of the clay particles prior to their use as a component of a grease composition, as, for example, by being subjected to a preliminary treatment with an organic cationic surface-active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, and is believed to require no further discussion. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3% to 15% by weight of the total grease composition.

Exemplary Lubricants and Functional Fluids:

The following examples illustrate the lubricant and functional fluid compositions of the invention. In Table I all numerical values are in percent by weight.

TABLE I

| | I | II | III | IV | V | VI | VII | VIII |
|---|---|---|---|---|---|---|---|---|
| Product Ex. 2 | 6 | — | — | — | — | — | — | — |
| Product Ex. 3 | — | 6 | — | — | — | 6 | 6 | 6 |
| Product Ex. 4 | — | — | 6 | — | — | — | — | — |
| Product Ex. 5 | — | — | — | 6 | — | — | — | — |
| Product Ex. 8 | — | — | — | — | 6 | — | — | — |
| DMTD* prepared and formaldehyde coupled to heptyl phenol in situ | 0.2 | 0.2 | 0.2 | 0.15 | .20 | — | — | — |
| Copolymer of ethyl acrylate and 2-ethyl-hexyl acrylate | .075 | .075 | .075 | .075 | .075 | .075 | .075 | .075 |
| Diluent oil | .275 | .275 | .275 | .275 | .225 | .225 | .225 | .225 |
| Di-t-nonyl DMTD | — | — | — | — | — | 0.35 | 0.10 | — |
| Mono-t-nonyl DMTD | — | — | — | — | — | — | — | 0.35 |
| SAE 80W-90 Base Oil | Rem** | Rem | Rem | Rem | Rem | Rem | Rem | Rem |

*DMTD means Dimercaptothiadiazole
**Rem means remainder

The formulations of Examples II, IV and V are tested using the L-37 High Torque Test and the L-42 High Speed Shock Test. The L-37 test operates under low-speed, high-torque conditions and evaluates the load carrying ability, wear stability and corrosion characteristics for gear lubricants. The L-42 test is an industry standard test for evaluating the antiscore performance of EP additives in gear lubricants under high speed, shock load conditions. The formulations for Examples II, IV and V pass each of these tests, the results being as follows:

| | Example II | Example IV | Example V |
|---|---|---|---|
| L-37 Overall | 2/0.51 | 2/1 | 2/1 |
| L-42 Ring | 2% | 1% | 3% |
| L-42 Pinion | 2% | 2% | 5% |

These results are significant due to the fact that the inventive lubricating compositions covered by these formulations pass both the L-37 and L-42 tests and yet do not contain phosphorus and sulfurized olefin anti-wear systems previously thought to be necessary to obtain passage of both tests.

EXAMPLE IX

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.35% by weight of an oleyl amine; and the remainder being an SAE 80W-90 base oil.

EXAMPLE X

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.25% by weight of a $C_{12}$ succinic acid; and the remainder being an SAE 80W-90 base oil.

EXAMPLE XI

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.030% by weight of monoisopropanolamine; and the remainder being an SAE 80W-90 base oil.

EXAMPLE XII

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.10% by weight of 1-hydroxyethyl-2-heptadecenyl imidazoline; 0.02% by weight of Tolad 7 (a product of Petrolite identified as a polyether in aromatic solvent); and the remainder being an SAE 80W-90 base oil.

EXAMPLE XIII

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.20% by weight ethoxylated nonyl phenol; and the remainder being an SAE 80W-90 base oil.

EXAMPLE XIV

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.20% by weight oleyl amide; and the remainder being an SAE 80W-90 base oil.

EXAMPLE XV

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.05% by weight Polyglycol 112-2 (a product of Dow Chemical identified as ethoxylated-propoxylated glycol); and the remainder being an SAE 80W-90 base oil.

EXAMPLE XVI

A lubricating composition having the following formulation is prepared: 6.0% by weight of the product of Example 3; 0.20% by weight of a dimercaptothiadiazole prepared and formaldehyde coupled to heptyl phenol in situ; 1.0% by weight of an esterified styrene-maleic anhydride copolymer post-treated with N-aminopropyl morpholine; 0.075% by weight diluent oil; 0.05% by weight of Pluronic L101 (a product of Wyandotte identified as a poly(propoxy-ethoxy-)alcohol); and the remainder being an SAE 80W-90 base oil.

EXAMPLE XVII

A lubricating composition having the following formulation is prepared: 3.0% by weight of the product of Example 5; 3.0% by weight of the product from Example A-54, 0.15% by weight of a dimercaptothiadiazole prepared and formaldehyde coupled to heptyl phenol in situ; 0.75% % by weight copolymer of ethyl acrylate and 2-ethylhexyl acrylate; 0.275% by weight diluent oil; and the remainder being an SAE 80W-90 base oil. This formulation is tested using the L-37 and L-42 test methods, with the results being in each instance a pass:

| | |
|---|---|
| L-37 | 2/0.51 |
| L-42 Ring | 0% |
| L-42 Pinion | 1% |

EXAMPLES XVIII–XXI

The following tractor hydraulic fluids are prepared (all numerical values being in percent by weight):

| | XVIII | XIX | XX | XXI |
|---|---|---|---|---|
| Product Ex. 2 | 3.00 | — | — | — |
| Product Ex. 3 | — | 3.00 | — | — |
| Product Ex. 22 | — | — | 3.00 | — |
| Product Ex. 26 | — | — | — | 3.00 |
| Styrene-maleic anhydride copolymer esterified with $C_4$–$C_{18}$ alcohols, post-treated with aminopropyl morpholine and containing a hindered phenol antioxidant | 6.60 | 6.60 | 6.60 | 6.60 |
| Esterified-maleic anhydride copolymers post-treated with aminopropylmorpholine | 0.30 | 0.30 | 0.30 | 0.30 |
| Silicone Antifoam agent | 0.02 | 0.02 | 0.02 | 0.02 |
| Base oil (60% by wt. 60–70N, 30% by wt. 160N, 10% by wt. naphthenic 60N) | 90.08 | 90.08 | 90.08 | 90.08 |

EXAMPLE XXII

A lubricating composition having the following formulation is prepared: 3% by weight of the product from Example 3; 2.7% by weight of the zinc salt of a phosphorodithioic acid produced by the reaction of phosphorus pentasulfide with an alcohol mixture of 60 mole percent 4-methyl-2-pentanol and 40 mole percent isopropyl alcohol; 1% by weight of a calcium overbased fatty acid carboxylate; 0.2% by weight of Duomeen T (a product of Akzo identified as N-tallow trimethylene diamine); 0.075% by weight silicone anti-foam agent; 0.225% by weight diluent oil; and the remainder being SAE 80W-90 base oil. This formulation has a copper strip rating (ASTM D130 at 100° C.) of 1A.

EXAMPLE XXIII

A cutting fluid having the following formulation is prepared:

| | Wt. % |
|---|---|
| Product of Ex. 5 | 5 |
| 100 Neutral base oil | 95 |

This cutting fluid is tested using tapping test number 035.003.04 with the results being:

| Tapping % Eff. | |
|---|---|
| Mild Steel | Stainless Steel |
| 148 | 112 |

Fuel Compositions:

The fuel compositions of the present invention contain a major proportion of a normally liquid fuel, usually a hydrocarbonaceous petroleum distillate fuel such as motor gasoline as defined by ASTM Specification D439 and diesel fuel or fuel oil as defined by ASTM Specification D396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures are combinations of gasoline and ethanol and of diesel fuel and ether. Particularly preferred is gasoline, that is, a mixture of hydrocarbons having an ASTM distillation range from about 60° C. at the 10% distillation point to about 205° C. at the 90% distillation point.

Generally, these fuel compositions contain a property improving amount of the sulfurized overbased products of the invention. Usually this amount is about 1 to about 50,000 parts by weight, preferably about 4 to about 5000 parts, of the sulfurized overbased products of the invention per million parts of fuel.

The fuel compositions can contain, in addition to the composition of this invention, other additives which are well known to those of skill in the art. These include anti-knock agents such as tetraalkyl lead compounds, lead scavengers such as haloalkanes (e.g., ethylene dichloride and ethylene dibromide), deposit preventers or modifiers such as triaryl phosphates, dyes, cetane improvers, antioxidants such as 2,6-di-tertiary-butyl-4-methyl-phenol, rust inhibitors such as alkylated succinic acids and anhydrides, bacteriostatic agents, gum inhibitors, metal deactivators, demulsifiers, upper cylinder lubricants and anti-icing agents.

Water-Oil Emulsions, Water-Based Concentrates and Water-Based Functional Fluids:

The invention also includes water-oil emulsions, water-based concentrates and water-based functional fluids containing the sulfurized overbased product of the invention. The water-oil emulsions can be water-in-oil emulsions or oil-in-water emulsions. The term "oil-in-water" emulsion (abbreviated "o/w" emulsion) refers to emulsions wherein the continuous phase is aqueous and the discontinuous phase is organic, the discontinuous organic phase being dispersed in the continuous aqueous phase. The term "water-in-oil" emulsion (abbreviated "w/o" emulsion) refers to emulsions wherein the continuous phase is organic and the discontinuous phase is aqueous, the discontinuous aqueous phase being dispersed in the continuous organic phase. The concentrates generally contain about 20% to about 80% by weight water. The water-based functional fluids contain generally over about 80% by weight of water. The water-oil emulsions and the water-based functional fluids generally contain from about 0.05% to about 20% by weight of the inventive sulfurized overbased products. The water-oil emulsions generally contain from about 1% to about 80% by weight water and from about 20% to about 99% by weight oil. The water-based functional fluids generally contain less than about 15%, preferably less than about 5%, and more preferably less than about 2% oil. The oils that can be used are described above under the heading "Natural and Synthetic Oils".

These emulsions, concentrates and water-based functional fluids can optionally include other conventional additives commonly employed in water-oil emulsions and water-based functional fluids. These other additives include emulsifiers or dispersants; surfactants; thickeners; oil-soluble, water-insoluble functional additives such as anti-wear agents, extreme pressure agents, etc.; and supplemental additives such as corrosion-inhibitors, shear stabilizing agents, bactericides, dyes, water-softeners, odor masking agents, anti-foam agents and the like.

The concentrates are analogous to the emulsions and the water-based functional fluids except that they contain less water and proportionately more of the other ingredients. The concentrates can be converted to emulsions or water-based functional fluids by dilution with water. This dilution is usually done by standard mixing techniques. This is often a convenient procedure since the concentrate can be shipped to the point of use before additional water is added. Thus, the cost of shipping a substantial amount of the water in the final emulsion or water-based functional fluid is saved. Only the water necessary to formulate the concentrate (which is determined primarily by ease of handling and convenience factors), need be shipped.

Generally these emulsions and water-based functional fluids are made by diluting the concentrates with water, wherein the ratio of water to concentrate is usually in the range of about 1:100 to about 100:1 by weight.

In one embodiment of the invention, the water-based functional fluids are in the form of solutions while in another embodiment they are in the form of micelle dispersions or microemulsions which appear to be true solutions. Whether a solution, micelle dispersion or microemulsion is formed is dependent, inter alia, on the particular components employed.

Also included within this invention are methods for preparing the emulsions, concentrates and water-based functional fluids, containing other conventional additives commonly employed in water-oil emulsion, water-based functional fluids. These methods comprise the steps of:

(1) mixing the inventive sulfurized overbased product with such other conventional additives either simultaneously or sequentially to form a dispersion or solution; optionally (2) combining said dispersion or solution with water (and optionally oil in the preparation of an emulsion) to form said concentrate; and/or (3) diluting said dispersion or solution, or concentrate with water (and optionally oil in the preparation of an emulsion) wherein the total amount of water used is in the amount required to provide the desired concentration of the components of the invention and other functional additives in said concentrates or said emulsion or water-based functional fluids.

These mixing steps are preferably carded out using conventional equipment and generally at room or slightly elevated temperatures, usually below 100° C. and often below 50° C. As noted above, the concentrate can be formed and then shipped to the point of use where it is diluted with water and optionally oil to form the desired emulsion or water-based functional fluid. In other instances the finished emulsion or water-based functional fluid can be formed directly in the same equipment used to form the concentrate or the dispersion or solution.

The dispersants or emulsifiers that are useful in accordance with the present invention include the nitrogen-containing, phosphorus-free carboxylic solubilizers disclosed in U.S. Pat. Nos. 4,329,249; 4,368,133; 4,435,297; 4,447,348; and 4,448,703. These patents are incorporated herein by reference. Briefly, these dispersants are made by reacting (I) at least one carboxylic acid acylating agent having at least one hydrocarbyl-based substituent of about 12 to about 500 carbon atoms with (II) at least one (a) N-(hydroxyl-substituted hydrocarbyl)amine, (b) hydroxyl-substituted poly(hydrocarbyloxy) analog of said amine (a), or (c) mixtures of (a) and (b). Preferred acylating agents include the substituted succinic acids or anhydrides. Preferred amines include the primary, secondary and tertiary alkanol amines or mixtures thereof. These dispersants are preferably used at effective levels to disperse or dissolve the various additives, particularly the functional additives discussed below, in the concentrates, emulsions and/or water-based functional fluids of the present invention. In one embodiment, the dispersant is the reaction product of polyisobutenyl ($\overline{M}n$=950)-substituted succinic anhydride with diethylethanolamine.

The surfactants that are useful can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J., U.S.A., which is hereby incorporated by reference for its disclosures in this regard.

Among the nonionic surfactant types are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention are the alkylene oxide-treated alkyl phenols such as the ethylene oxide alkyl phenol condensates sold by the Rohm & Haas Company. A specific example of these is Triton X-100 which contains an average of 9–10 ethylene oxide units per molecule, has an HLB value of about 13.5 and a molecular weight of about 628. Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this regard.

As noted above, cationic, anionic and amphoteric surfactants can also be used. Generally, these are all hydrophilic surfactants. Anionic surfactants contain negatively charged polar groups while cationic surfactants contain positively charged polar groups. Amphoteric dispersants contain both types of polar groups in the same molecule. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by reference for their disclosures relating to cationic, amphoteric and anionic surfactants.

Among the useful anionic surfactant types are the widely known carboxylate soaps, organo sulfates, sulfonates, sulfocarboxylic acids and their salts, and phosphates. Useful cationic surfactants include nitrogen compounds such as amine oxides and the well-known quaternary ammonium salts. Amphoteric surfactants include amino acid-type materials and similar types. Various cationic, anionic and amphoteric dispersants are available from the industry, particularly from such companies as Rohm & Haas and Union Carbide Corporation, both of America. Further information about anionic and cationic surfactants also can be found in the texts "Anionic Surfactants", Parts II and III, edited by W. M. Linfield, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

These surfactants, when used, are generally employed in effective amounts to aid in the dispersal of the various additives, particularly the functional additives discussed below, in the concentrates, emulsions and water-based functional fluids of the invention. Preferably, the concentrates can contain up to about 75% by weight, more preferably from about 10% to about 75% by weight of one or more of these surfactants. The emulsions and water-based functional fluids can contain up to about 15% by weight, more preferably from about 0.05% to about 15% by weight of one or more of these surfactants.

Often the emulsions and water-based functional fluids of this invention contain at least one thickener for thickening said compositions. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

In one embodiment, it is a requirement that the thickener be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity.

These thickeners can also be synthetic thickening polymers. Many such polymers are known to those of skill in the art. Representative of them are polyacrylates, polyacrylamides, hydrolyzed vinyl esters, water-soluble homo- and interpolymers of acrylamidoalkane sulfonates containing 50 mole percent at least of acryloamido alkane sulfonate and other comonomers such as acrylonitrile, styrene and the like. Poly-n-vinyl pyrrolidones, homo- and copolymers as well as water-soluble salts of styrene, maleic anhydride and isobutylene maleic anhydride copolymers can also be used as thickening agents.

Other useful thickeners are known to those of skill in the art and many can be found in the list in the afore-mentioned McCutcheon Publication: "Functional Materials," 1976, pp. 135–147, inclusive. The disclosures therein, relative to water-soluble polymeric thickening agents meeting the general requirements set forth above are hereby incorporated by reference.

Useful thickeners, particularly when the compositions of the invention are required to be stable under high shear applications, are the water-dispersible reaction products formed by reacting at least one hydrocarbyl-substituted succinic acid and/or anhydride represented by the formula

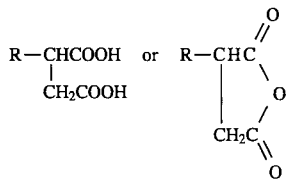

wherein R is a hydrocarbyl group of from about 8 to about 40 carbon atoms, with at least one water-dispersible amine terminated poly(oxyalkylene) or at least one water-dispersible hydroxy-terminated polyoxyalkylene. R preferably has from about 8 to about 30 carbon atoms, more preferably from about 12 to about 24 carbon atoms, still more preferably from about 16 to about 18 carbon atoms. In a preferred embodiment, R is represented by the formula

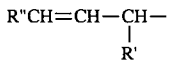

wherein R' and R" are independently hydrogen or straight chain or substantially straight chain hydrocarbyl groups, with the proviso that the total number of carbon atoms in R is within the above-indicated ranges. Preferably R' and R" are alkyl or alkenyl groups. In a particularly advantageous embodiment, R has from about 16 to about 18 carbon atoms, R' is hydrogen or an alkyl group of from 1 to about 7 carbon atoms or an alkenyl group of from 2 to about 7 carbon atoms, and R" is an alkyl or alkenyl group of from about 5 to about 15 carbon atoms.

The water-dispersible amine terminated poly(oxyalkylene)s are preferably alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amine-terminated poly(oxy-alkylene) can also be a urea condensate of such alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amine-terminated poly(oxyalkylene) can also be a polyamino (e.g., triamino, tetramino, etc.) polyoxyalkylene provided it is mine-terminated and it is water-dispersible.

Examples of water-dispersible amine-terminated poly(oxyalkylene)s that are useful in accordance with the present invention are disclosed in U.S. Pat. Nos. 3,021,232; 3,108,011; 4,444,566; and Re No. 31,522. The disclosures of these patents are incorporated herein by reference. Water-dispersible amine terminated poly(oxyalkylene)s that are useful are commercially available from the Texaco Chemical Company under the trade name Jeffamine.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. Examples of these compounds include the hydroxy-terminated polyoxyalkylenes which are represented by the formula

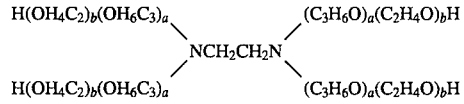

wherein a and b are integers such that the collective molecular weight of the oxypropylene chains range from about 900 to about 25,000, and the collective weight of the oxyethylene chains constitute from about 20% to about 90%, preferably from about 25% to about 55% by weight of the compound. These compounds are commercially available from BASF Wyandotte Corporation under the tradename "Tetronic". Additional examples include the hydroxy-terminated polyoxyalkylenes represented by the formula $$HO(C_2H_4O)_x(C_3H_6O)_y(C_2H_4O)_zH$$

wherein y is an integer such that the molecular weight of the oxypropylene chain is at least about 900, and x and z are integers such that the collective weight of the oxyethylene chains constitute from about 20% to about 90% by weight of the compound. These compounds preferably have a molecular weight in the range of about 1100 to about 14,000. These compounds are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the carboxylic agent and the amine- or hydroxy-terminated polyoxyalkylene can be carried out at a temperature ranging from the highest of the melt temperatures of the reaction components up to the lowest of the decomposition temperatures of the reaction components or products. Generally, the reaction is carded out at a temperature in the range of about 60° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The weight of an equivalent of the carboxylic agent can be determined by dividing its molecular weight by the number of carboxylic functions present. The weight of an equivalent of the amine-terminated polyoxyalkylene can be determined by dividing its molecular weight by the number of terminal amine groups present. The weight of an equivalent of the hydroxy-terminated polyoxyalkylene can be determined by dividing its molecular weight by the number of terminal hydroxyl groups present. The number of terminal amine and hydroxyl groups can usually be determined from the structural formula of the polyoxyalkylene or empirically through well known procedures. The amide/acids and ester/acids formed by the reaction of the carboxylic agent and amine-terminated or hydroxy-terminated polyoxyalkylene can be neutralized with, for example, one or more alkali metals, one or more amines, or a mixture thereof, and thus converted to amide/salts or ester/salts, respectively. Additionally, if these amide/acids or ester/acids are added to concentrates or functional fluids containing alkali metals or amines, amide/salts or ester/salts usually form, in situ.

U.S. Pat. Nos. 4,659,492; 4,661,275; 4,664,834; and 4,749,500 are incorporated herein by reference for their teachings with respect to the use of hydrocarbyl-substituted succinic acid or anhydride/hydroxy-or amine-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above under the subtitle "Surfactants" can be used in this regard. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that can be used in the water-oil emulsions and water-based functional fluids are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 milliliters of water at 25° C., but is soluble in mineral oil to the extent of at least 1 gram per liter at 25° C.

These functional additives can also include certain solid lubricants such as graphite, molybdenum disulfide and polytetrafluoroethylene and related solid polymers.

These functional additives can also include frictional polymer formers. Briefly, these are potential polymer forming materials which are dispersed in a liquid carder at low concentration and which polymerize at rubbing or contacting surfaces to form protective polymeric films on the surfaces. The polymerizations are believed to result from the heat generated by the rubbing and, possibly, from catalytic and/or chemical action of the freshly exposed surface. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids. Typically such salts are of carboxylic acids of 1 to 22 carbon atoms including both aromatic and aliphatic acids; sulfur acids such as alkyl and aromatic sulfonic acids and the like; phosphorus acids such as phosphoric acid, phosphorus acid, phosphinic acid, acid phosphate esters and analogous sulfur homologs such as the thiophosphoric and dithiophosphoric acid and related acid esters; boron acids include boric acid, acid borates and the like. Useful functional additives also include metal dithiocarbamates such as molybdenum and antimony dithiocarbamates; as well as dibutyl tin sulfide, tributyl tin oxide, phosphates and phosphites; borate amine salts, chlorinated waxes; trialkyl tin oxide, molybdenum phosphates, and chlorinated waxes.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smalheer and R. K. Smith, The Lezius-Hiles Co., Cleveland, Ohio, U.S.A. These references are hereby incorporated by reference for their disclosures of functional additives useful in the compositions of this invention.

In one embodiment, the functional additive is a sulfur or chloro-sulfur extreme pressure agent, known to be useful in oil-base systems. Such materials include chlorinated aliphatic hydrocarbons, such as chlorinated wax; organic sulfides and polysulfides, such as benzyl-disulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite and polypropylene substituted phenol phosphite; metal thiocarbamates, such as zinc dioctyldithiocarbamate and barium heptylphenol dithiocarbamate; and Group II metal salts of a phosphorodithioic acid, such as zinc dicyclohexyl phosphorodithioate.

The functional additive can also be a film former such as a synthetic or natural latex or emulsion thereof in water. Such latexes include natural rubber latexes and polystyrene butadienes synthetic latex.

The functional additive can also be an anti-chatter or anti-squawk agent. Examples of the former are the amide metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the emulsions and water-based functional fluids of the present invention.

Typically, a functionally effective amount of the functional additive is present in the emulsions and water-based functional fluids of this invention. The term "functionally effective amount" refers to a sufficient quantity of an additive to impart desired properties intended by the addition of said additive. For example, if an additive is a rust-inhibitor, a functionally effective amount of said rust-inhibitor would be an amount sufficient to increase the rust-inhibiting characteristics of the composition to which it is added. Similarly, if the additive is an anti-wear agent, a functionally effective amount of said anti-wear agent would be a sufficient quantity of the anti-wear agent to improve the anti-wear characteristics of the composition to which it is added.

The emulsions and water-based functional fluids of this invention often contain at least one inhibitor for corrosion of metals. These inhibitors can prevent corrosion of either ferrous or non-ferrous metals (e.g., copper, bronze, brass, titanium, aluminum and the like) or both. The inhibitor can be organic or inorganic in nature. Usually it is sufficiently soluble in water to provide a satisfactory inhibiting action though it can function as a corrosion-inhibitor without dissolving in water, it need not be water-soluble. Many suitable inorganic inhibitors useful in the aqueous systems of the present invention are known to those skilled in the art. Included are those described in "Protective Coatings for Metals" by Bums and Bradley, Reinhold Publishing Corporation, Second Edition, Chapter 13, pages 596–605. This disclosure relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Many suitable organic inhibitors are known to those of skill in the art. Specific examples include hydrocarbyl amine and hydroxy-substituted hydrocarbyl amine neutralized acid compound, such as neutralized phosphates and hydrocarbyl phosphate esters, neutralized fatty acids (e.g., those having about 8 to about 22 carbon atoms), neutralized aromatic carboxylic acids (e.g., 4-tertiarybutyl benzoic acid), neutralized naphthenic acids and neutralized hydrocarbyl sulfonates. Mixed salt esters of alkylated succinimides are also useful. Particularly useful amines include the alkanol amines such as ethanol amine, diethanolamine. Mixtures of two or more of any of the afore-described corrosion-inhibitors can also be used. The corrosion-inhibitor is usually present in concentrations in which they are effective in inhibiting corrosion of metals with which the aqueous composition comes in contact.

Certain of the emulsions and water-based functional fluids of the present invention (particularly those that are used in cutting or shaping of metal) can also contain at least one polyol with inverse solubility in water. Such polyols are those that become less soluble as the temperature of the water increases. They thus can function as surface lubricity agents during cutting or working operations since, as the liquid is heated as a result of friction between a metal workpiece and worktool, the polyol of inverse solubility "plates out" on the surface of the workpiece, thus improving its lubricity characteristics.

The emulsions and water-based functional fluids of the present invention can also include at least one bactericide. Such bactericides are well known to those of skill in the art and specific examples can be found in the afore- mentioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The emulsions and water-based functional fluids of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The emulsions and water-based functional fluids of this invention may also include an anti-activeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the emulsions and water-based functional fluids of this invention are industrial products which exhibit or confer more than one property on such emulsions and water-based functional fluids. Thus, a single ingredient can provide several functions thereby eliminating or reducing the need for some other additional ingredient. Thus, for example, an extreme pressure agent such as tributyl tin oxide can also function as a bactericide.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A composition comprising at least one sulfurized overbased product made by contacting (A) at least one overbased product with (B) sulfur and/or at least one source of sulfur selected from the group consisting of a sulfur halide, a combination of sulfur or a sulfur oxide with hydrogen sulfide, and a sulfurized organic compound;

said overbased product (A) being made using at least one acidic material and at least one organic material to be overbased, with the proviso that when said acidic material is other than $SO_2$ or a source of $SO_2$ said overbased product (A) is contacted with an effective amount of $SO_2$ or a source of $SO_2$ to displace at least part of said acidic material, and wherein said organic material to be overbased is at least one sulfur containing acid other than a phosphorus containing acid.

2. The composition of claim 1 wherein said overbased product (A) is contacted with said $SO_2$ or source of $SO_2$ prior to being contacted with component (B).

3. The composition of claim 1 wherein said overbased product (A) is contacted with said $SO_2$ or source of $SO_2$ simultaneously with component (B).

4. The composition of claim 1 wherein said overbased product (A) is made using at least one organic material to be overbased (A)(I) and a reaction medium (A)(II), said organic material to be overbased (A)(I) being soluble in said reaction medium (A)(II) and being at least one sulfonic acid, sulfamic acid, thiosulfonic acid, sulfinic acid, sulfenic acid, partial ester sulfuric acid, sulfurous acid or thiosulfuric acid.

5. The composition of claim 1 wherein said overbased product (A) is made using at least one organic material to be overbased (A)(I) and a reaction medium (A)(II), said organic material to be overbased (A)(I) being soluble in said reaction medium (A)(II) and being at least one compound represented by the formulae $$(R_a—T—(SO_3)_b)_cM_d \text{ or } (R—(SO_3)_b)_cM_d$$

wherein R is an aliphatic hydrocarbyl group, T is a cyclic hydrocarbyl group, M is hydrogen or a metal cation, and each of a, b, c and d are at least 1.

6. The composition of claim 1 wherein said overbased product (A) is made using at least one organic material to be overbased, said organic material to be overbased being selected from the group consisting of one or more of the following acids or metal salts of said acids: mahogany sulfonic acid; bright stock sulfonic acid; sulfonic acid derived from lubricating oil fractions having a Saybolt viscosity from about 100 seconds at 100° F. to about 200 seconds at 210° F.; petrolatum sulfonic acid; mono- and poly-wax-substituted sulfonic and polysulfonic acids of benzene, naphthalene, phenol, diphenyl ether, naphthalene disulfide, diphenylamine, thiophene or alpha-chloronaphthalene; alkyl ($C_4$ to $C_{40}$) benzene sulfonic acid; cetylphenol mono-sulfide sulfonic acid; dicetyl thianthrene disulfonic acid; dilauryl beta naphthyl sulfonic acid; and dicapryl nitronaphthalene sulfonic acid.

7. The composition of claim 1 wherein said overbased product (A) is made using at least one organic material to be overbased, said organic material to be overbased being selected from the group consisting of one or more of the following acids or metal salts of said acids: paraffin wax sulfonic acid, unsaturated paraffin wax sulfonic acid, hydroxy-substituted paraffin wax sulfonic acid, hexapropylene sulfonic acid, tetra-amylene sulfonic acid, polyisobutene sulfonic acid wherein the polyisobutene has an $\overline{M}n$ of about 280 to about 100,000, chloro-substituted paraffin wax sulfonic acid, nitroparaffin wax sulfonic acid, petroleum naphthalene sulfonic acid, cetyl cyclopentyl sulfonic acid, lauryl cyclohexyl sulfonic acid, bis-(diisobutyl) cyclohexyl sulfonic acid and mono- or poly-wax-substituted cyclohexyl sulfonic acid.

8. The composition of claim 1 wherein said overbased product (A) is made using at least one organic material to be overbased, and at least one solvent for said organic material to be overbased, said solvent being at least one mineral oil, Stoddard solvent, aliphatic hydrocarbon, cycloaliphatic hydrocarbon, aromatic hydrocarbon, halogenated aliphatic hydrocarbon, halogenated cycloaliphatic hydrocarbon or halogenated aromatic hydrocarbon.

9. The composition of claim 1 wherein said overbased product (A) is made using at least one metal, said metal being selected from the group consisting of alkali metals, alkaline earth metals, titanium, zirconium, molybdenum, iron, copper, zinc, aluminum or a mixture of two or more thereof.

10. The composition of claim 1 wherein said overbased product (A) is made using at least one metal, said metal being selected from the group consisting of lithium, sodium, potassium, or a mixture of two or more thereof.

11. The composition of claim 10 wherein overbased product (A) is made using sodium.

12. The composition of claim 1 wherein said overbased product (A) is made using at least one promoter, said promoter being water, nitromethane, at least one alcohol, at least one phenol, at least one alkali metal hydroxide, ammonium hydroxide, at least one organic acid of up to about 8 carbon atoms, hydrochloric acid, at least one salicylaldoxime, or mixture of two or more thereof.

13. The composition of claim 1 wherein said acidic material is selected from the group of acids consisting of carbamic acid, acetic acid, formic acid, boric acid, trinitromethane, $SO_2$, $CO_2$, sources of said acids, and mixtures of two or more of said acids or sources of said acids.

14. The composition of claim 1 wherein said acidic material is $SO_2$ or a source of $SO_2$.

15. The composition of claim 1 wherein said acidic material is CO2 or a source of $CO_2$.

16. The composition of claim 1 wherein component (A) has a metal ratio of up to about 40.

17. The composition of claim 1 wherein component (B) is elemental sulfur.

18. The composition of claim 1 wherein component (B) is at least one sulfur halide.

19. The composition of claim 1 wherein component (B) is a mixture of sulfur or at least one sulfur oxide with hydrogen sulfide.

20. The composition of claim 1 wherein component (B) is at least one aromatic or alkyl sulfide.

21. The composition of claim 1 wherein component (B) is at least one sulfurized olefin.

22. The composition of claim 1 wherein component (B) is at least one sulfurized fatty acid ester.

23. The composition of claim 1 wherein component (B) is at least one sulfurized aliphatic ester of at least one olefinic mono- or dicarboxylic acid.

24. The composition of claim 1 wherein component (B) is at least one compound represented by the formula $$S_y((CH_2)_xCOOR)_2$$

wherein x is a number in the range of about 2 to about 5, y is a number in the range of 1 to about 6, and R is an alkyl group of about 4 to about 20 carbon atoms.

25. The composition of claim 1 wherein component (B) is at least one sulfurized Diels-Alder adduct.

26. The composition of claim 1 wherein component (B) is at least one sulfurized terpene or a composition prepared by sulfurizing a mixture comprising at least one terpene and at least one other olefinic compound.

27. The composition of claim 1 wherein component (B) is at least one compound represented by the formula

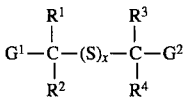

wherein:

$R^1$, $R^2$, $R^3$ and $R^4$ are each independently H or hydrocarbyl groups;

$R^1$ and/or $R^3$ may be $G^1$ or $G^2$;

$R^1$ and $R^2$ and/or $R^3$ and $R^4$ together may be alkylene groups containing about 4 to about 7 carbon atoms;

$G^1$ and $G^2$ are each independently C(X)R, COOR, C≡N, $R^5$—C═$NR^6$, $CON(R)_2$ or $NO_2$, and $G^1$ also may be $CH_2OH$, wherein X is O or S, and each of R, $R^5$ and $R^6$ is independently H or a hydrocarbyl group;

when both $G^1$ and $G^2$ are $R^5C{=}NR^6$, the two $R^6$ groups together may be a hydrocarbylene group linking the two nitrogen atoms;

when $G^1$ is $CH_2OH$ and $G^2$ is COOR, a lactone may be formed by intramolecular condensation of $G^1$ and $G^2$; and x is a number of from 1 to about 8.

28. The composition of claim 1 wherein component (B) is 2,2'-dithiodisobutyraldehyde.

29. The composition of claim 1 wherein component (B) is at least one compound represented by the formula

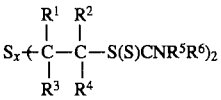

wherein $R^1$, $R^2$ and $R^3$ are independently H or hydrocarbyl groups; $R^4$ is H, OH or a hydrocarbyl group; $R^5$ and $R^6$ are independently H, hydrocarbyl, or hydroxyhydrocarbyl; or $R^3$ and $R^4$ together and/or $R^5$ and $R^6$ together and/or $R^1$ and $R^3$ together and/or $R^2$ and $R^4$ together may form cyclic groups; and x is a number from 1 to about 8.

30. The composition of claim 1 further comprising at least one nonsulfurized boron-containing overbased product.

31. A concentrate comprising from about 0.01% to about 90% by weight of the composition of claim 1 and at least one substantially inert, normally liquid organic solvent/diluent.

32. A lubricant or functional fluid comprising a major amount of an oil of lubricating viscosity and a minor extreme-pressure, anti-wear and/or antioxidant improving amount of the composition of claim 1.

33. A gear oil composition comprising a major amount of an oil of lubricating viscosity and a minor extreme-pressure, anti-wear and/or antioxidant improving amount of the composition of claim 1.

34. A gear oil composition comprising a major amount of an oil having a kinematic viscosity of at least about 3.5 cSt at 100° C. and a minor extreme pressure, anti-wear and/or antioxidant improving amount of the composition of claim 1.

35. A gear oil composition comprising a major amount of an oil of lubricating viscosity, a minor viscosity improving amount of at least one viscosity improver, and a minor extreme pressure, anti-wear and/or antioxidant improving amount of the composition of claim 1.

36. A cutting fluid comprising a major amount of a cutting fluid base oil and a minor extreme-pressure, anti-wear and/or antioxidant improving amount of the composition of claim 1.

37. A grease composition comprising a major amount of an oil of lubricating viscosity, a thickening amount of at least one thickener, and a minor extreme pressure, anti-wear and/or antioxidant improving amount of the composition of claim 1.

38. A composition comprising at least one overbased thiosulfate with the proviso that the thiosulfate is prepared from sulfur and/or at least one source of sulfur selected from the group consisting of a sulfur halide, a combination of sulfur or a sulfur oxide with hydrogen sulfide, and a sulfurized organic compound.

39. A composition comprising at least one overbased sodium thiosulfate with the proviso that the thiosulfate is prepared from sulfur and/or at least one source of sulfur selected from the group consisting of a sulfur halide, a combination of sulfur or a sulfur oxide with hydrogen sulfide, and a sulfurized organic compound.

40. A composition comprising at least one overbased thiosulfate with the proviso that the thiosulfate is prepared from sulfur and/or at least one source of sulfur selected from the group consisting of a sulfur halide, a combination of sulfur or a sulfur oxide with hydrogen sulfide, and a sulfurized organic compound and at least one non-sulfurized boron-containing overbased product.

41. A composition comprising at least one sulfurized overbased product made by contacting (A) at least one overbased product with (B) sulfur and/or at least one sulfur source selected from the group consisting of a sulfur halide a combination of sulfur or a sulfur oxide with hydrogen sulfide, and a sulfurized organic compound;

said overbased product (A) being made using $CO_2$ or a source of $CO_2$ and at least one organic material to be overbased, said overbased product (A) being contacted with an effective amount of $SO_2$ or a source of $SO_2$ to displace at least part of said $CO_2$ or source of $CO_2$ prior to or during the contacting with said sulfur and/or sulfur source (B), and wherein said organic material to be overbased is at least one sulfur containing acid other than a phosphorus containing acid.

42. A composition comprising at least one sulfurized overbased product made by contacting (A) at least one overbased product with (B) sulfur and/or at least one sulfur source selected from the group consisting of a sulfur halide, a combination of sulfur or a sulfur oxide with hydrogen sulfide, and a sulfurized organic compound;

said overbased product (A) being made using at least one sulfonic acid, $CO_2$ or a source of $CO_2$, and at least one metal or metal base, said metal being one or more metals selected from the group consisting of lithium, sodium and potassium, said overbased product (A) being contacted with an effective amount of $SO_2$ or a source of $SO_2$ to displace at least part of said $CO_2$ or source of $CO_2$ prior to or during the contacting of said overbased product with said sulfur and/or sulfur source (B).

43. A composition comprising at least one sulfurized overbased sodium sulfonate made by contacting at least one overbased sodium sulfonate with sulfur and/or at least one sulfur source selected from the group consisting of a sulfur halide, a combination of sulfur or a sulfur oxide with hydrogen sulfide, and a sulfurized organic compound;

said overbased sodium sulfonate being made using at least one sulfonic acid, sodium or at least one sodium compound and $CO_2$ or a source of $CO_2$, said overbased sodium sulfonate being contacted with an effective amount of $SO_2$ or a source of $SO_2$ to displace at least part of said $CO_2$ prior to or during the contacting with said sulfur and/or sulfur source.

44. A composition comprising at least one sulfurized overbased sodium sulfonate made by contacting at least one overbased sodium sulfonate with sulfur and/or at least one sulfur source selected from the group consisting of a sulfur halide, a combination of sulfur or a sulfur oxide with hydrogen sulfide, and a sulfurized organic compound;

said overbased sodium sulfonate being made using at least one sulfonic acid, sodium or at least one sodium compound and $CO_2$ or a source of $CO_2$, said overbased sodium sulfonate being contacted with an effective amount of $SO_2$ or a source of $SO_2$ to displace at least part of said $CO_2$ prior to or during the contacting with said sulfur and/or sulfur source, the ratio of equivalents of sulfur or sulfur source to equivalents of said overbased sodium sulfonate ranging from about 0.65 to about 1.2.

45. A composition comprising at least one sulfurized overbased product made by contacting (A) at least one overbased product with (B) sulfur and/or at least one source of sulfur selected from the group consisting of a sulfur halide, a combination of sulfur or a sulfur oxide with hydrogen sulfide, and a sulfurized organic compound;

said overbased product (A) being made using at least one acidic material and at least one organic material to be overbased, with the proviso that when said acidic material is other than $SO_2$ or a source of $SO_2$ said overbased product (A) is contacted with an effective amount of $SO_2$ or a source of $SO_2$ to displace at least part of said acidic material, and wherein said organic material to be overbased is at least one sulfur containing acid other than a phosphorus containing acid; and at least one metal deactivator.

46. A composition comprising at least one sulfurized overbased product made by contacting (A) at least one overbased product with (B) sulfur and/or at least one source of sulfur selected from the group consisting of a sulfur halide, a combination of sulfur or a sulfur oxide with hydrogen sulfide, and a sulfurized organic compound;

said overbased product (A) being made using at least one acidic material and at least one organic material to be overbased, with the proviso that when said acidic material is other than $SO_2$ or a source of $SO_2$ said overbased product (A) is contacted with an effective amount of $SO_2$ or a source of $SO_2$ to displace at least part of said acidic material, and wherein said organic material to be overbased is at least one sulfur containing acid other than a phosphorus containing acid;

at least one phosphorus-containing antiwear agent.

47. A composition comprising at least one sulfurized overbased boron-containing metal sulfonate made by contacting at least one overbased boron-containing metal sulfonate with sulfur and/or at least one sulfur source, said metal being selected from the group consisting of one or more of lithium, sodium or potassium;

said overbased boron-containing metal sulfonate being made by contacting at least one overbased metal sulfonate with boric acid;

said overbased metal sulfonate being made using at least one sulfonic acid and $CO_2$;

said overbased boron-containing sodium sulfonate being contacted with an effective amount of $SO_2$ or a source of $SO_2$ to displace at least part of said $CO_2$ prior to or during the contacting with said sulfur and/or sulfur source.

48. A composition comprising at least one sulfurized overbased product made by contacting (A) at least one overbased product with (B) sulfur and/or at least one source of sulfur selected from the group consisting of a sulfur halide, a combination of sulfur or a sulfur oxide with hydrogen sulfide, and a sulfurized organic compound, said overbased product (A) being made using at least one organic material to be overbased (A)(I) and at least one acidic material, with the proviso that when said acidic material is other than $SO_2$ or a source of $SO_2$ said overbased product (A) is contacted with an effective amount of $SO_2$ or a source of $SO_2$ to displace at least part of said acidic material and wherein said organic material to be overbased (A)(I) is a sulfur-containing acid other than a phosphorus sulfide.

* * * * *